US006548234B2

(12) United States Patent
Gibson

(10) Patent No.: US 6,548,234 B2
(45) Date of Patent: Apr. 15, 2003

(54) PHOTOGRAPHIC ELEMENTS CONTAINING A CYAN DYE-FORMING COUPLER, STABILIZER AND SOLVENT

(75) Inventor: Danuta Gibson, Garston (GB)

(73) Assignee: Eastman Kodak Company, Rochester, NY (US)

( * ) Notice: Subject to any disclaimer, the term of this patent is extended or adjusted under 35 U.S.C. 154(b) by 29 days.

(21) Appl. No.: 09/934,143

(22) Filed: Aug. 21, 2001

(65) Prior Publication Data

US 2002/0061480 A1 May 23, 2002

(30) Foreign Application Priority Data

Sep. 20, 2000 (GB) ..... 0023096

(51) Int. Cl.[7] ..... G03C 7/46

(52) U.S. Cl. ..... 430/384; 430/383; 430/385; 430/543; 430/546; 430/551; 430/552; 430/553; 430/512; 430/931

(58) Field of Search ..... 430/383, 384, 430/385, 543, 546, 551, 552, 553, 512, 931

(56) References Cited

U.S. PATENT DOCUMENTS

| | | | | |
|---|---|---|---|---|
| 4,537,857 A | | 8/1985 | Takada et al. | |
| 4,820,614 A | | 4/1989 | Takada et al. | |
| 4,882,267 A | | 11/1989 | Hirabayashi et al. | |
| 5,047,314 A | | 9/1991 | Sakai et al. | |
| 5,057,408 A | | 10/1991 | Takahashi et al. | |
| 5,162,197 A | | 11/1992 | Aoki et al. | |
| 5,378,596 A | | 1/1995 | Naruse et al. | |
| 6,110,658 A | * | 8/2000 | Honan et al. | 430/546 |
| 6,132,947 A | | 10/2000 | Honan et al. | |
| 6,261,755 B1 | * | 7/2001 | Gibson et al. | 430/551 |

FOREIGN PATENT DOCUMENTS

DE 199 32 617 1/2001

* cited by examiner

*Primary Examiner*—Geraldine Letscher
(74) *Attorney, Agent, or Firm*—Arthur E. Kluegel

(57) ABSTRACT

The invention provides a photographic element comprising at least one light-sensitive silver halide emulsion layer having associated therewith at least one cyan dye-forming coupler, UV absorber and (A) a stabilizer of formula (I)

(I)

wherein $R^1$ is an unsubstituted or substituted alkyl or aryl group or a 5- to 10- membered heterocyclic ring which contains one or more heteroatoms selected from nitrogen, oxygen and sulfur, which ring is unsubstituted or substituted;

Z is a hydrogen atom or a substituent group;

X is a group selected from —$SO_2$—, —SO—, —COO—, —CO— and —CS—,

W is one or more unsubstituted or independently substituted alkylene groups connecting the nitrogen atom to X, and p is 0 or 1;

$R^2$ is a substituent group; or the groups represented by Z and $R^2$ can be joined to form a ring which may be substituted; and (B) a high-boiling solvent of formula (II)

(II)

wherein $R^3$ is an unsubstituted or substituted alkyl or aryl group; and

G is an unsubstituted or substituted alkyl group.

The invention provides improved light and dark stability in a photographic element without degradation in hue or reactivity of the dyes therein.

30 Claims, No Drawings

PHOTOGRAPHIC ELEMENTS CONTAINING A CYAN DYE-FORMING COUPLER, STABILIZER AND SOLVENT

FIELD OF THE INVENTION

The present invention relates to a colour photographic element containing one or more cyan dye-forming couplers, in particular one or more phenolic cyan couplers, a UV absorber, and a specific class of stabilizer and solvent.

BACKGROUND OF THE INVENTION

In silver halide based colour photography, a typical photographic element contains multiple layers of light-sensitive photographic silver halide emulsions coated on a support with one or more of these layers being spectrally sensitized to each of blue light, green light and red light. The blue, green and red light-sensitive layers typically contain yellow, magenta, and cyan dye-forming couplers, respectively. After exposure to light, colour development is accomplished by immersing the exposed material in an aqueous alkali solution containing an aromatic primary amine colour developing agent. The dye-forming couplers are selected so as to react with the oxidized colour developing agent to provide yellow, magenta and cyan dyes in the so called subtractive colour process to reproduce their complementary colours, blue, green and red as in the original image.

The important features for selecting the dye-forming coupler include; efficient reaction with oxidized colour developing agent, thus minimizing the necessary amounts of coupler and silver halide in the photographic element; the formation of dyes with hues appropriate for the photographic use of interest: for colour photographic paper applications this requires that dyes have low unwanted side absorption leading to good colour reproduction in the photographic print; minimization of image dye loss contributing to improved image permanence under both ambient illumination and conventional storage conditions; and in addition the selected dye-forming coupler must exhibit good solubility in coupler solvents, provide good dispersibility in gelatin and remain stable during handling and manipulation for maximum efficiency in manufacturing processes. The hue of a dye is a function of both the shape and the position of its spectral absorption band. Traditionally, the cyan dyes used in colour photographic papers have had nearly symmetrical absorption bands centred in the region of 620 to 680 nm.

It is well known that the spectral characteristics of the image dyes from couplers can be manipulated by incorporating different function groups into the molecular structure of the coupler, and that the environment in which the dye is situated can also influence the hue of the dye. The choice of permanent solvent is very important not only because of its effect on the final properties of the dye, but also because of its effect on the efficiency of dye formation. The choice of permanent solvent also determines whether an auxiliary solvent is necessary to aid dissolution of coupler. There is a need to avoid the use of auxiliary solvent during the preparation of the coupler dispersion, because the auxiliary solvent needs to be removed, either by washing or evaporation, before dispersion preparation is completed. It takes a long time to remove the auxiliary solvent and this is costly in time and equipment. In addition, with ever-increasing environmental concerns, reducing the amount of auxiliary organic solvent used in dispersions has been of paramount importance. Naturally, without auxiliary solvent, the temperature at which coupler dissolves can be excessively high so any material which can reduce the solubility temperature, would be advantageous.

In recent years, a great deal of study has been conducted to improve dye-forming couplers for silver halide photosensitive materials in terms of improved colour reproducibility and image dye stability. However, further improvements are needed, particularly in the area of cyan couplers. In general, cyan dyes are formed from naphthols and phenols as described, for example, in U.S. Pat. Nos. 2,367,351, 2,423,730, 2,474,293, 2,772,161, 2,772,162, 2,895,826, 2,920,961, 3,002,836, 3,466,622, 3,476,563, 3,552,962, 3,758,308, 3,779,763, 3,839,044, 3,880,661, 3,998,642, 4,333,999, 4,990,436, 4,960,685, 5,476,757 and 5,614,357; in French Patent Nos. 1,478,188 and 1,479,043 and in UK Patent No. 2,070,000.

These types of couplers can be used either by being incorporated in the photographic silver halide emulsion layers or externally in the processing baths. In the former case the couplers must have ballast substituents built into the molecule to prevent the couplers from migrating from one layer into another. Although these couplers have been used extensively in colour photographic film and paper products, the dyes derived from them still suffer from poor stability to heat, humidity or light, low coupling efficiency or optical density, and from undesirable blue and green absorptions which cause considerable reduction in colour reproduction and colour saturation.

Cyan couplers which have been recently proposed to overcome some of these problems are 2,5-diacylaminophenols containing a sulfone, sulfonamido or sulfate moiety in the ballasts at the 5-position, as disclosed in U.S. Pat. Nos. 4,609,619, 4,775,616, 4,849,328, 5,008,180, 5,045,442, and 5,183,729; and Japanese patent applications JP02035450 A2, JP01253742 A2, JP04163448 A2, JP04212152 A2 and JP05204110 A2. Cyan image dyes formed from these couplers show improved stability to heat and humidity, enhanced optical density and resistance to reduction by ferrous ions in the bleach bath.

The 2,5-diacylaminophenol couplers in U.S. Pat. Nos. 5,047,314, 5,047,315, 5,057,408, 5,162,197 and 5,726,003 are of the type which yield dyes with symmetrical absorption bands and high side-band absorptions. The use of certain ester coupler solvents is described in both U.S. Pat. Nos. 5,047,315 and 5,057,408, where examples show these solvents with 2,5-diacylaminophenols. The couplers in these patents are typically embodied in formats with benzotriazole UV absorbers which can provide improved dye stability to light. However these patents do not provide teaching suitable for understanding how these couplers or stabilizers, and especially the couplers of U.S. Pat. No. 5,686,235, affect dye formation efficiency.

Combinations of two classes of phenolic cyan dye-forming couplers are disclosed in U.S. Pat. Nos. 4,537,857, 4,552,836, 4,614,710, 4,666,826, 5,084,375, 4,820,614 and in JP 02 178,259 and JP 02 237,449.

EP-A- 1 037 103 describes a blend of cyan dye-forming couplers together with a benzotriazole stabilizer and optionally an aliphatic ester solvent which provides improved light and dark stability in a photographic element without degradation in hue or reactivity of the dyes therein.

U.S. Pat. Nos. 5,017,465 and 5,082,766 and German published patent application DTOS 4,307,194 describe the use of certain stabilizers with pyrazoloazole magenta dye forming couplers to improve their dye stability. One class of stabilizers which is disclosed includes compounds of the following structure:

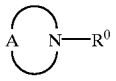

wherein A represents the group of non-metal atoms necessary to complete a 5- to 8-remembered nitrogen-containing ring and $R^0$ represents an aryl group or a heterocyclic group. Preferred compounds of such formula, as described in U.S. Pat. No. 5,017,465, include compounds wherein A represent the atoms necessary to complete a thiomorpholine 1,1-dioxide group and where $R^0$ represents an alkoxy-substituted phenol group. Such compounds are believed to stabilise by acting as singlet oxygen quenchers. The utility of thiomorpholine dioxide stabilizers in relation to 2-equivalent pyrazolones magenta couplers is also disclosed in U.S. Pat. No. 5,491,054 & U.S. Pat. No. 5,484,696. In U.S. Pat. No. 5,561,037 it is disclosed that the light stability of image dyes from cyclic azole magenta couplers can be improved by the use of a combination of stabilizers which include thiomorpholine dioxide compounds as well as substituted sulfonamido phenyl compounds.

U.S. Pat. No. 4,820,614 discloses a blend of cyan couplers with a nitrogen stabilizer combined with a hindered phenol or highly branched piperidine to improve dye stability. According to this patent specification any high-boiling solvent may be used, generally in combination with an auxiliary solvent, but the examples teach the use of an environmentally unfavourable phthalate solvent, combined with ethyl acetate auxiliary solvent. There is no mention of the use of a aliphatic ester solvent nor that the use of such a solvent can lead to an improvement in light stability.

PROBLEM TO BE SOLVED BY THE INVENTION

There is still a need to provide a photographic element containing a dispersion of one or more cyan dye-forming couplers, which can provide further improved light and dark stability under normal storage conditions and high reactivity for formation of dye with oxidized colour developing agent.

SUMMARY OF THE INVENTION

The invention provides a photographic element comprising at least one light-sensitive silver halide emulsion layer having associated therewith at least one cyan dye-forming coupler, UV absorber and (A) a stabilizer of formula (I)

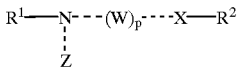

(I)

wherein $R^1$ is an unsubstituted or substituted alkyl or aryl group or a 5- to 10-membered heterocyclic ring which contains one or more heteroatoms selected from nitrogen, oxygen and sulfur, which ring is unsubstituted or substituted;

Z is a hydrogen atom or a substituent group;

X is a group selected from $—SO_2—$, —SO—, —COO—, —CO— and —CS—,

W is one or more unsubstituted or independently substituted alkylene groups connecting the nitrogen atom to X, and p is 0 or 1;

$R^2$ is a substituent group; or the groups represented by Z and $R^2$ can be joined to form a ring which may be substituted; and (B) a high-boiling solvent of formula (II)

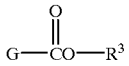

(II)

wherein $R^3$ is an unsubstituted or substituted alkyl or aryl group; and

G is an unsubstituted or substituted alkyl group.

In another embodiment of the invention there is provided a multi-colour photographic element comprising a support bearing yellow, magenta and cyan image-dye-forming units comprising at least one blue-, green- or red-sensitive silver halide emulsion layer having associated therewith at least one yellow, magenta or cyan dye-forming coupler respectively, wherein the element is as herein described.

In yet another embodiment of the invention there is provided a process of forming an image in a photographic element as hereinbefore defined after the element has been imagewise exposed to light, comprising contacting the element, as herein described, with a colour developing agent.

ADVANTAGEOUS EFFECT OF THE INVENTION

This invention allows for improved light and dark stability in a photographic element without degradation in hue or reactivity of the dyes therein by the use of a combination of one or more cyan dye-forming couplers, a UV absorber, a substituted amine stabilizer and a specific class of high-boiling solvent.

DETAILED DESCRIPTION OF THE INVENTION

The invention is as described in the Summary of the Invention and relates to a photographic element containing at least one cyan dye-forming coupler combined with a UV absorber and a certain stabilizer, combined with a specific solvent, which enables minimization of the amounts of coupler and silver necessary to achieve good photographic images, improved light stability and good thermal stability for album keeping.

As used herein and throughout the specification unless where specifically stated otherwise, the term "alkyl" refers to an unsaturated or saturated, straight or branched chain alkyl group, including alkenyl and aralkyl, and includes cyclic alkyl groups, including cycloalkenyl, having 3–8 carbon atoms and the term "aryl" includes specifically fused aryl.

In formula (I), $R^1$ is preferably an unsubstituted or substituted aryl group, such as a phenyl or 1-naphthyl group, or an unsubstituted or substituted heterocyclic group, such as, for example a 2-furyl, 2-thienyl or pyridyl group. X is a group selected from $—SO_2—$, —SO—, —COO—, —CO— and —CS— and is preferably $—SO_2$. W, when present, is one or more unsubstituted or independently substituted alkylene groups connecting the nitrogen atom to X and is preferably a substituted ethylene group. Z and $R^2$ are independently selected from substituent groups as defined hereunder for substituents on $R^o$ and are preferably each an alkyl group. In one embodiment the groups represented by Z and $R^2$ can be joined to form a ring, which may be substituted. For example $R^2$ and Z can couple to form a thiomorpholine dioxide ring.

Thus in a preferred embodiment the stabilizer has the structure (IA)

(IA)

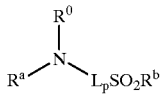

wherein $R^0$ represents an unsubstituted or substituted aryl or heterocyclic group;

$R^a$ is hydrogen or a substituent group;

L represents an unsubstituted or substituted alkylene linking group and p represents 0 or 1; and $R^b$ is a substituent group, provided that substituent groups represented by $R^a$ and $R^b$ may be joined to form a ring.

In accordance with preferred embodiments, $R^0$ represents a substituted phenyl group with one or more substituents. Substituents can include alkyl groups, sulfonyl groups, sulfinyl groups, sulfonyl oxy groups, aryloxy groups, alkylthio groups, arylthio groups, acyl groups, alkoxycarbonyl groups, carbamoyl groups (e.g., alkyl carbamoyl, alkyl carbamoyl), ureido groups (e.g., alkyl ureido, aryl ureido), sulfamoyl groups (e.g., alkyl sulfamoyl, aryl sulfamoyl), amino groups, alkylsulfonyl groups, arylsulfonyl groups, nitro groups, cyano groups, halogen atoms, carboxy groups and alkoxy groups which may be substituted by: a cycloalkyl group, and alkenyl group, an aryl group, a heterocyclic group, an acyl group, a bridged hydrocarbon group, an alkylsulfonyl group or an arylsulfonyl group. The alkyl group may include e.g., a straight-chain or branched-chain alkyl group having 1–24 carbon atoms; the cycloalkyl group e.g., a cycloalkyl group having 5–24 carbon atoms; the alkenyl group e.g., an alkenyl group having 3–24 carbon atoms; the aryl group, e.g., a phenyl group or naphthyl group, the heterocyclic group, e.g., a pyridyl group, an imidazolyl group, and a thiazolyl group; the acyl group, e.g., an acetyl group or a benzoyl group; the bridged hydrocarbon e.g., a bicyclo [2.2.1] heptyl group etc.

L represents an alkylene linking group and p represents 0 or 1. When present, L is preferably selected from alkylene groups having the formula $—(C(R)(R))_q$ where q equals 1 to 6, more preferably from 1 to 4, and most preferably 2, and each R may be independently hydrogen or an alkyl group, or two alkyl groups may be joined to form a hydrocarbon ring. Examples of such a ring containing linking groups include the following:

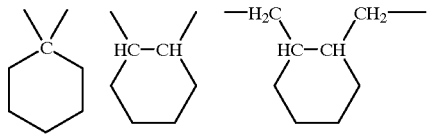

most preferably, L when present represents an substituted ethylene linking group.

$R^a$ is hydrogen or a substituent group and $R^b$ is a substituent group, provided that substituent groups represented by $R^a$ and $R^b$ may be joined to form a ring. Examples of $R^a$ and $R^b$ substituent groups include those set forth for $R^0$ above. Preferably $R^a$ and $R^b$ represent alkyl groups. In one of the preferred embodiments of the invention, p is 1 and L, $R^a$ and $R^b$ combine together to form a thiomorpholine dioxide group. In this embodiment, $R^0$ is preferably a phenyl ring with an unsubstituted or substituted alkoxy group.

In the most preferred embodiment the stabilizer of the invention is represented by formula (IB)

$$R^0—NHSO_2—R^c \quad \text{(IB)}$$

wherein at least one of $R^0$ and $R^c$ in the above formula is an unsubstituted or substituted aryl group, in particular a phenyl group which may have a substituent, preferably in the 4-position to the sulfonamide. $R^0$ is the same as in structure (1A) above.

Specific examples of stabilizers of formula (I) include the following although the invention is not to be construed as limited thereto.

ST-1

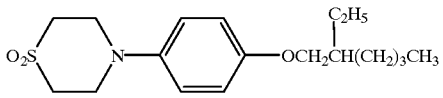

ST-2

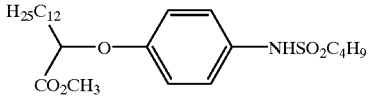

ST-3

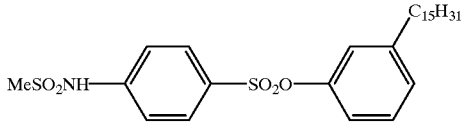

ST-4

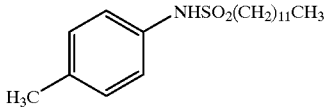

ST-5

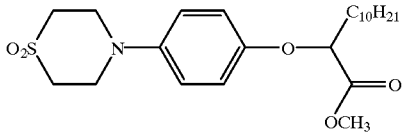

ST-6

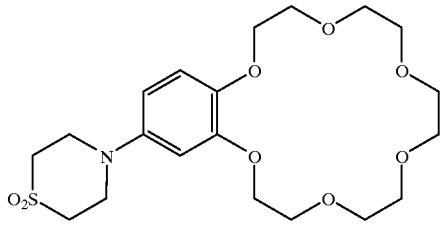

ST-7

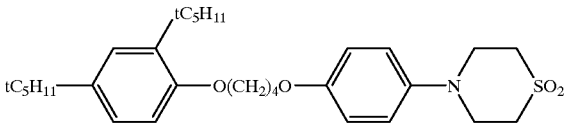

-continued

ST-8

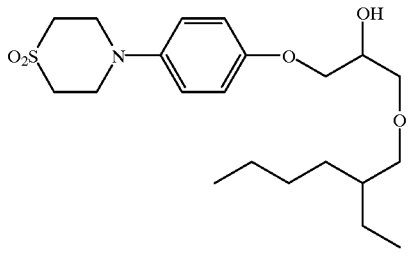

ST-9

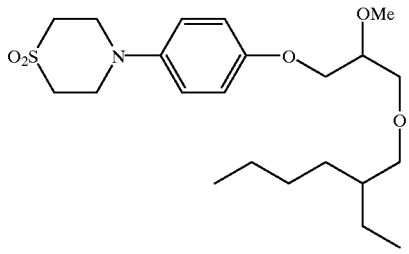

ST-10

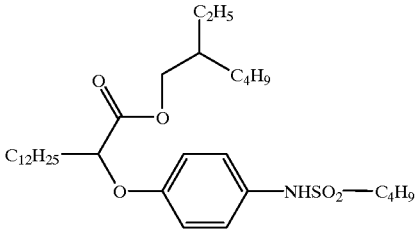

ST-11

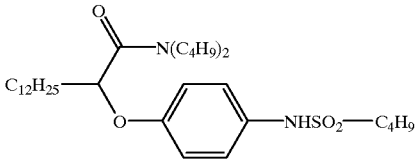

ST-12

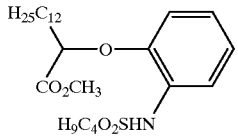

ST-13

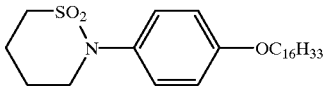

ST-14

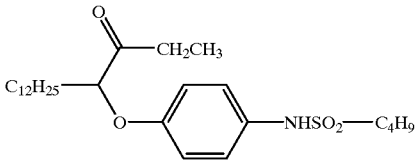

ST-15

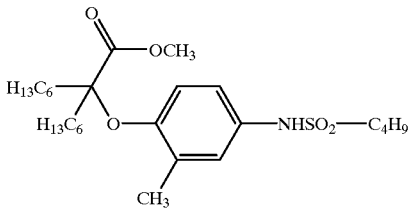

-continued

ST-16

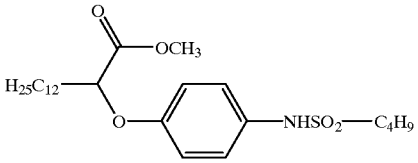

ST-17

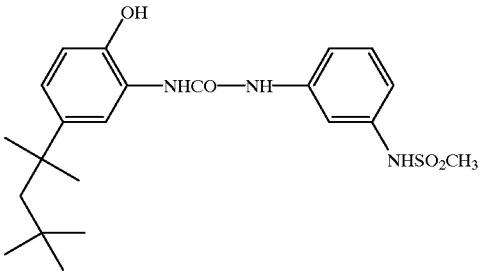

ST-18

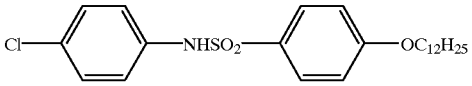

ST-19

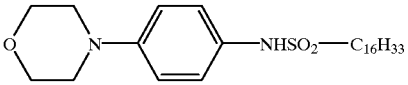

ST-20

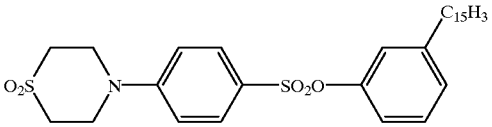

ST-21

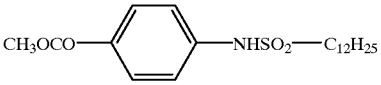

ST-22

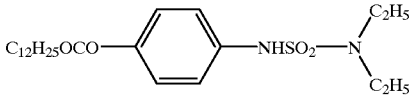

The element has associated therewith one or more high-boiling solvents of formula (II)

(II)

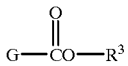

wherein $R^3$ is an unsubstituted or substituted alkyl (including aralkyl) or aryl group; and G is an unsubstituted or substituted alkyl (including aralkyl) group.

$R^3$ is preferably an alkyl group, and in particular one having 1 to 20 carbon atoms, such as methyl, ethyl, propyl, butyl, pentyl, octyl, 2-ethylhexyl, decyl, oleyl, linalyl, which may be substituted with one or more groups such as a hydroxy, alkoxy, alkoxycarbonyl or carboxylic ester group or $R^3$ is an aryl group, which may be substituted, for example, with one or more alkyl groups such as a methyl group or $R^3$ is an aralkyl group, such as benzyl.

G is preferably an alkyl group, and in particular one having 1 to 20 carbon atoms, such as methyl, ethyl, propyl, butyl, pentyl, hexyl, heptyl, octyl, nonyl, decyl, undecyl, dodecyl, oleyl, linalyl, cyclohexyl or cyclohexenyl. G may be substituted along the alkyl chain by one or more groups which are the same or different selected from —OH, —$OR^3$, $OCOR^3$, —$COR^3$, —COOH, —$COOR^3$, —CN or halogen, preferably with a hydroxy and/or one or more carboxylic ester groups. Moreover when G is an aralkyl group it may be substituted in the aryl ring with one or more groups, such as with a methoxy group, or on the alkyl part as described above for the alkyl chain.

As used herein the term "high boiling solvent" refers to a solvent having a boiling point above about 150 C.

The following solvents further illustrate solvents suitable for use in the invention. It is not to be construed that the present invention is limited to these examples.

S-1

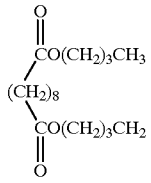

S-2

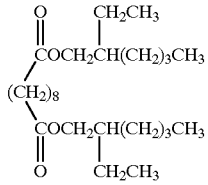

S-3

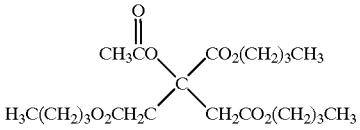

S-4

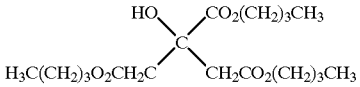

S-5

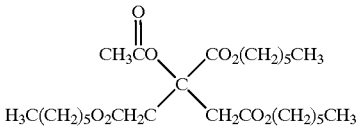

S-6

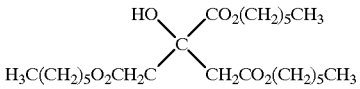

S-7

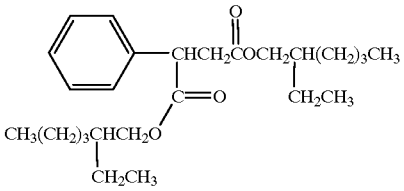

-continued

S-8

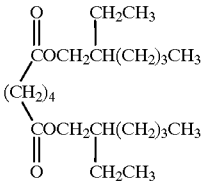

S-9

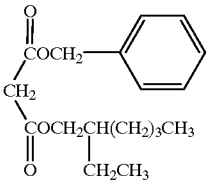

S-10

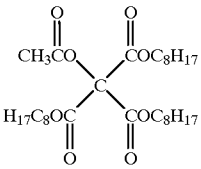

S-11

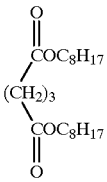

S-12

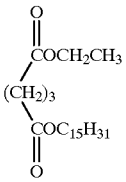

S-13

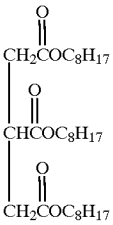

S-14

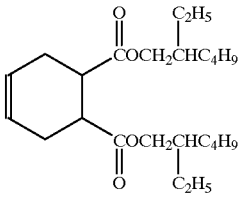

S-15

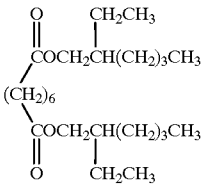

-continued

S-16

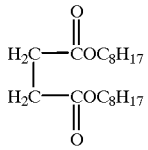

S-17

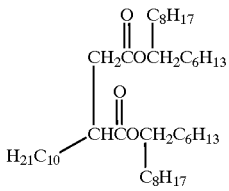

S-18

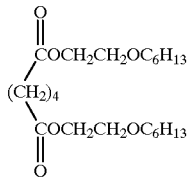

S-19

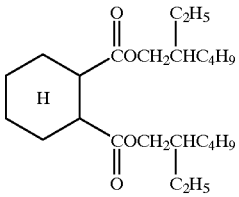

S-20

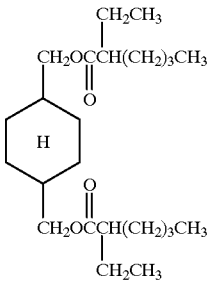

S-21

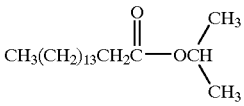

S-22

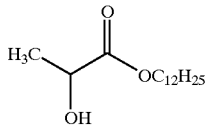

S-23

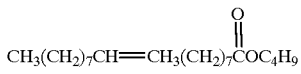

-continued

S-24

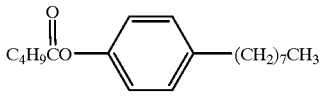

S-25

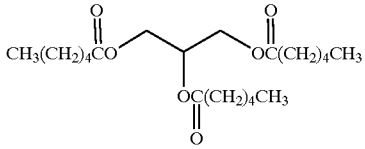

S-26

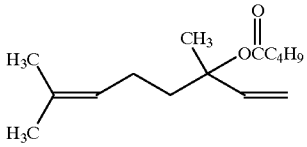

S-27

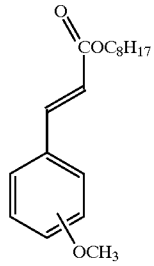

S-28

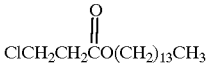

S-29

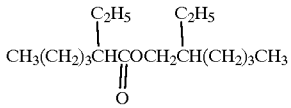

S-30

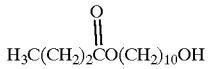

S-31

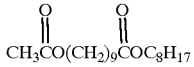

S-32

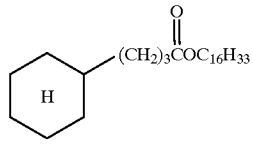

The invention may be practised with the compounds of formula (I) and (II) to enhance the image stability of the dye formed from one or more cyan dye-forming couplers.

In one embodiment of the invention the cyan dye-forming coupler that can be used with advantage either alone or in combination with another cyan dye-forming coupler is a phenolic dye-forming coupler of formulae (III):

(III)

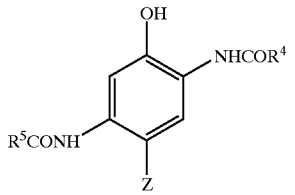

wherein $R^4$ and $R^5$ are independently selected from an unsubstituted or substituted alkyl, aryl, amino or alkoxy group or a 5–10 membered heterocyclic ring which contains one or more heteroatoms selected from nitrogen, oxygen and sulfur, which ring is unsubstituted or substituted; and Z is a hydrogen atom or a group which can be split off by the reaction of the coupler with an oxidized colour developing agent.

When $R^4$ and/or $R^5$ are an amino or alkoxy group they may, for example, be substituted with a halogen, aryl, aryloxy or alkyl- or aryl-sulfonyl group. Suitably, however, $R^4$ and $R^5$ are independently selected from an unsubstituted or substituted alkyl or aryl group or a 5–10 membered heterocyclic ring, such as a pyridyl, morpholino, imidazolyl or pyridazolyl group.

However $R^4$ is preferably an unsubstituted or substituted aryl or heterocyclic ring substituted, in particular, with an electron-withdrawing substituent (Hammett's sigma para value greater than 0) in a position meta and/or para to the amido group. Hammett's sigma values may be obtained from "Substituent constants for Correlation Analysis in Chemistry and Biology" by Hansch and Leo, available from Wiley and Sons, New York, N.Y. (1979).

For example the aryl or heterocyclic ring may be substituted with a cyano, chloro, fluoro, bromo, iodo, alkyl- or aryl-carbonyl, alkyl- or aryl-oxycarbonyl, acyloxy, carbonamido, alkyl- or aryl-carbonamido, alkyl- or aryl-oxycarbonylamino, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfamoylamino, alkyl- or aryl-sulfonamido, aryl, alkyl, alkoxy, aryloxy, nitro, alkyl-or aryl-ureido or alkyl- or aryl-carbamoyl group, any of which may be further substituted. Preferred groups are halogen, cyano, alkoxycarbonyl, alkylsulfamoyl, alkylsulfonamido, alkylsulfonyl, carbamoyl, alkylcarbamoyl or alkylcarbonamido. When $R^5$ is an aryl or heterocyclic ring it may be similarly substituted Suitably, $R^4$ is a 4-chlorophenyl, 3,4-dichlorophenyl, 3,4-difluoro-phenyl, 4-cyanophenyl, 3-chloro-4-cyanophenyl, pentafluorophenyl, or a 3- or 4-sulfonamidophenyl group.

$R^5$ is more preferably an alkyl group substituted, for example, with a halogen, alkyl, aryloxy or alkyl- or aryl-sulfonyl group, which may be further substituted. When $R^4$ is an alkyl group it may be similarly substituted.

In particular $R^5$ may be a group of the formula:

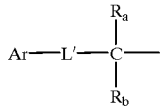

wherein

Ar is an unsubstituted or substituted aryl group, L' is a divalent linking group such as —O—, —SO—, or —$SO_2$—, and $R_a$ and $R_b$ are independently H or an alkyl group.

In another embodiment $R^5$ is the group

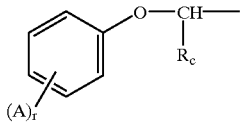

wherein each A is independently a substituent with at least one A being an alkyl- or aryl- sulfonamido or -sulfamoyl group, r is 1 or 2, and $R_c$ is hydrogen or an alkyl group.

X is hydrogen or a coupling-off group, suitably a halogen atom or a group linked by an atom of sulfur, oxygen or nitrogen. Chloro groups are conveniently employed.

One preferred form of cyan dye-forming of formula (III) is a "NB coupler" in which $R^4$ and $R^5$ are substituents independently selected such that the coupler is a "NB coupler", as described in EP-A-1 037 103.

For the purposes of this invention, an "NB coupler" is any dye-forming coupler which is capable of coupling with the developer 4-amino-3-methyl-N-ethyl-N-(2-methanesulfonamidoethyl) aniline sesquisulfate hydrate to form a dye, which in di-n-butyl sebacate provides an absorption spectrum upon "spin coating" that has a left bandwidth (LBW) at least 5 nm less than the LBW for a 3% w/v solution of the same dye in acetonitrile. The LBW of the spectral curve for a dye is the distance between the left side of the spectral curve and the wavelength of maximum absorption measured at a density of half the maximum.

The "spin coating" sample is prepared as follows:

A solution of the dye (3% w/v) and di-n-butyl sebacate (3% w/v) in ethyl acetate is prepared. If the dye is insoluble, dissolution is achieved by the addition of some methylene chloride. The solution is filtered and 0.1–0.2 ml is applied to a clear Estar support (approximately 4 cm×4 cm) and spun at 4,000 rev/min using the Spin Coating equipment, Model No. EC101, available from Headway Research Inc., Garland Tex. The transmission spectra of the so-prepared dye samples are then recorded.

Preferred "NB couplers" form a dye in di-n-butyl sebacate which has a LBW of the absorption spectrum upon "spin coating" which is at least 15 nm, preferably at least 25 nm, less than the LBW for a 3% w/v solution of the same dye in acetonitrile.

In a preferred embodiment the "NB coupler" has the formula (IIIA):

(IIIA)

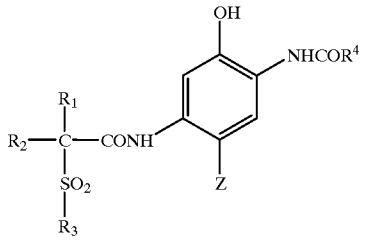

wherein $R^4$ and Z are as hereinbefore defined;

$R_1$ and $R_2$ are independently hydrogen or an unsubstituted or substituted alkyl group and $R_3$ is an unsubstituted or substituted alkyl, amino, alkoxy or aryl group or a 5–10 membered heterocyclic ring which contains one or more heteroatoms selected from nitrogen, oxygen and sulfur, which ring is unsubstituted or substituted.

Referring to formula (IIIA), $R_1$ and $R_2$ are independently hydrogen or an unsubstituted or substituted alkyl group, preferably having from 1 to 24 carbon atoms and in particular 1 to 10 carbon atoms, suitably a methyl, ethyl, n-propyl, isopropyl, butyl or decyl group or an alkyl group substituted, for example, with one or more fluoro, chloro or bromo atoms, such as a trifluoromethyl group. Suitably at least one of $R_1$ and $R_2$ is a hydrogen atom and if only one of $R_1$ and $R_2$ is a hydrogen atom then the other is preferably an alkyl group having 1 to 4 carbon atoms, more preferably one to three carbon atoms, desirably two carbon atoms and is preferably unsubstituted.

In formula (IIIA), when $R_3$ is an alkyl group it is preferably unsubstituted but may be substituted with, for example, a halogen or alkoxy group. However $R_3$ is preferably an aryl or heterocyclic group, (such as a pyridyl, morpholino, imidazolyl or pyridazolyl group) and preferably a phenyl group, any of which may be substituted, preferably in a position not adjacent to the link with the sulfonyl group, (i.e. in the case of a phenyl ring these would be the meta and/or para positions), suitably with one to three substituents. Such substituents may be independently selected from those specified hereinbefore as substituents on $R^4$, when $R^4$is an aryl or heterocyclic ring.

In particular each substituent may be an alkyl group such as methyl, t-butyl, heptyl, dodecyl, pentadecyl, octadecyl or 1,1,2,2-tetramethylpropyl; an alkoxy group such as methoxy, t-butoxy, octyloxy, dodecyloxy, tetradecyloxy, hexadecyloxy or octadecyloxy; an aryloxy group such as phenoxy, 4-t-butylphenoxy or 4-dodecylphenoxy; an alkyl- or aryl-acyloxy group such as acetoxy or dodecanoyloxy; an alkyl- or aryl-acylamino group such as acetamido, hexadecanamido or benzamido; an alkyl- or aryl-sulfonyloxy group such as methylsulfonyloxy, dodecylsulfonyloxy or 4-methylphenyl-sulfonyloxy; an alkyl- or aryl-sulfamoyl group such as N-butylsulfamoyl or N-4-t-butylphenylsulfamoyl; an alkyl- or aryl-sulfamoylamino group such as N-butyl-sulfamoylamino or N4-t-butylphenylsulfamoylamino; an alkyl- or aryl-sulfonamido group such as methanesulfonamido, hexadecanesulfonamido or 4-chlorophenylsulfonamido; an alkyl- or aryl-ureido group such as methylureido or phenylureido; an alkoxy- or aryloxy-carbonyl such as methoxycarbonyl or phenoxycarbonyl; an alkoxy- or aryloxy-carbonylamino group such as methoxy-carbonylamino or phenoxycarbonylamino; an alkyl- or aryl-carbamoyl group such as N-butylcarbamoyl or N-methyl-N-dodecylcarbamoyl; or a perfluoroalkyl group such as trifluoromethyl or heptafluoropropyl.

Suitably the above substituent groups have 1 to 30 carbon atoms, more preferably 8 to 20 aliphatic carbon atoms. A most preferred substituent is an alkyl group of 12 to 18 aliphatic carbon atoms such as dodecyl, pentadecyl or octadecyl or an alkoxy group with 8 to 18 aliphatic carbon atoms such as dodecyloxy and hexadecyloxy or a halogen such as a meta or para chloro group, carboxy or sulfonamido.

Another type of cyan dye-forming coupler that can be practised with the invention is a compound of formula (IV)

(IV)

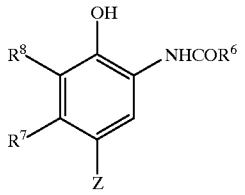

wherein $R^6$ is an unsubstituted or substituted alkyl or aryl group or a 5–10 membered heterocyclic ring which contains one or more heteroatoms selected from nitrogen, oxygen and sulfur, which ring is unsubstituted or substituted;

$R^7$ is an unsubstituted or substituted alkyl group;

$R^8$ is hydrogen, halogen or an unsubstituted or substituted alkyl or aryl group or a 5–10 membered heterocyclic ring which contains one or more heteroatoms selected from nitrogen, oxygen and sulfur, which ring is unsubstituted or substituted; and Z is a hydrogen atom or a group which can be split off by the reaction of the coupler with an oxidized colour developing agent.

Referring to formula (IV), preferably $R^6$ is an unsubstituted or substituted alkyl group, preferably substituted with an aryloxy or an alkyl- or aryl-sulfonyl group, each of which may be further substituted, for example with a substituent as hereinbefore defined for an aryl or heterocyclic ring of $R^4$. When $R^6$is an aryl or heterocyclic ring it may be substituted, for example with a halogen, cyano or an alkyl group, which may be further substituted.

$R^7$ is an alkyl group which is unsubstituted or substituted, for example with one or more halogen atoms, and is preferably an unsubstituted small chain alkyl group, especially an alkyl group having from one to four carbon atoms.

$R^8$ is hydrogen, halogen or an unsubstituted or substituted alkyl or aryl group or a 5–10 membered heterocyclic ring which contains one or more heteroatoms selected from nitrogen, oxygen and sulfur, which ring is unsubstituted or substituted. Preferably $R^8$ is halogen, more preferably chlorine, unsubstituted alkyl or an alkyl group substituted, for example with halogen. When $R^8$ is an aryl or heterocyclic ring it may be substituted, for example, with a halogen, cyano or an alkyl group, which may be further substituted. When either $R^6$ and/or $R^8$ is a heterocyclic group this may be, for example, a pyridyl, morpholino, imidazolyl or pyridazolyl group.

Z is as defined for the coupler of formula (IV) and is preferably chloro, fluoro, substituted aryloxy or thiopropionic acid, more preferably chloro.

The presence or absence of such groups determines the chemical equivalency of the coupler, i.e. whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation and colour correction.

Representative classes of such coupling-off groups include, for example, halogen, alkoxy, aryloxy, heterocyclyloxy, sulfonyloxy, acyloxy, acyl, heterocyclyl, sulfonamido, heterocyclylthio, benzothiazolyl, phosophonyloxy, alkylthio, arylthio and arylazo. These coupling-off groups are described in the art, for example, in U.S. Pat. Nos. 2,455,169, 3,227,551, 3,432,521, 3,467,563, 3,617,291, 3,880,661, 4,052,212 and 4,134,766; and in UK Patent Nos. and published applications 1,466,728, 1,531,927, 1,533,039, 2,066,755A and 2,017,704A, the disclosures of which are incorporated herein by reference. Halogen, alkoxy and aryloxy groups are most suitable.

Examples of suitable coupling-off groups are —Cl, —F, —Br, —SCN, $—OCH_3$, $—OC_6H_5$, $—OCH_2C(=O)NHCH_2CH_2OH$, $—OCH_2C(O)NHCH_2CH_2OCH_3$, $—OCH_2C(O)NHCH_2CH_2OC(=O)OCH_3$, $—P(=O)(OC_2H_5)_2$, $—SCH_2CH_2COOH$,

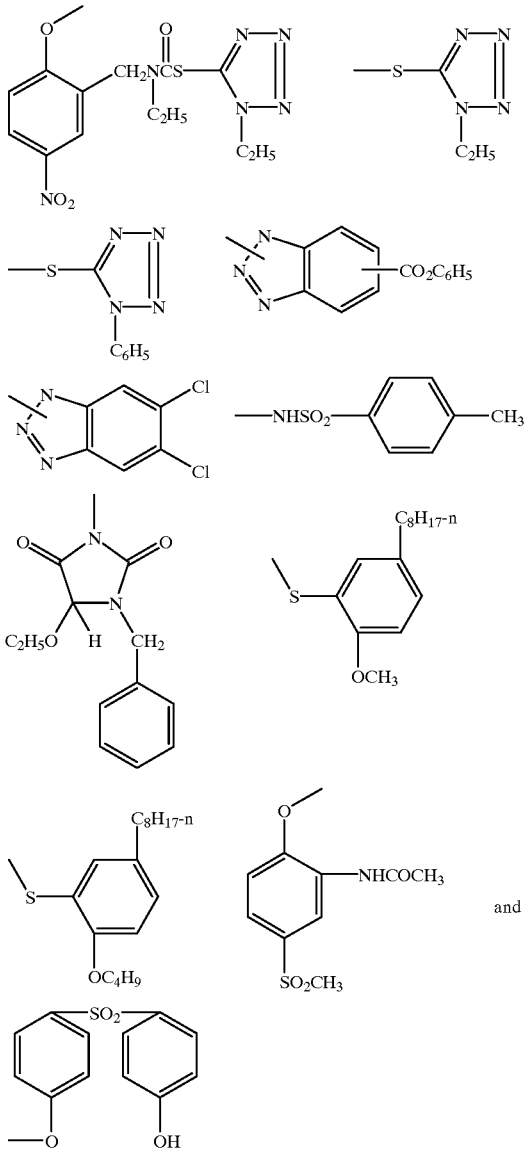

and

Typically the coupling-off group is a chlorine atom, hydrogen or a p-methoxy-phenoxy group.

It is important that the substituent groups $R^4$–$R^8$, $R_1$–$R_3$ and Z are selected so as to adequately ballast the coupler and the resulting dye in the organic solvent in which the coupler is dispersed. The ballasting may be accomplished by providing hydrophobic substituent groups in one or more of these substituent groups. Generally a ballast group is an organic radical of such size and configuration as to confer on the coupler molecule sufficient bulk and aqueous insolubility as to render the coupler substantially nondiffusible from the layer in which it is coated in a photographic element. Thus the combination of these substituent groups in the couplers for use in the invention are suitably chosen to meet these criteria. To be effective, the ballast will usually contain at least 8 carbon atoms and typically contains 10 to 30 carbon atoms. Suitable ballasting may also be accomplished by providing a plurality of groups which in combination meet these criteria. In the preferred embodiments of the invention, $R_1$ and/or $R_2$ in formula (IIIA) is hydrogen or a small alkyl group and $R^7$ in formula (IV) is a small alkyl group. Therefore, in these embodiments the ballast in formula (III) would be primarily located as part of groups $R^4$, $R_3$, Z and in formula (IV) in $R^6$, $R^8$ and Z. Furthermore, even if the coupling-off group Z contains a ballast it is often necessary to ballast the other substituents as well, since Z is eliminated from the molecule upon coupling; thus, the ballast is most advantageously provided as part of groups $R^4$, $R_3$, $R^6$ and/or $R^8$ in couplers of formulae (III) and (IV).

The following examples further illustrate couplers that may be used in the invention. It is not to be construed that the present invention is limited to these examples.

Compounds of formula (III)

AC-1

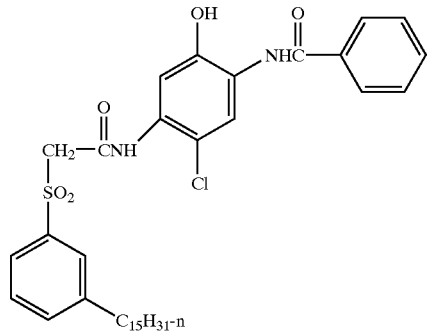

AC-2

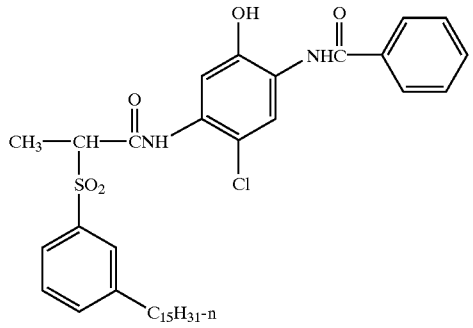

AC-3

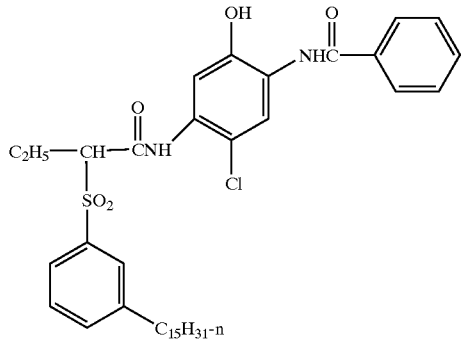

-continued
AC-4
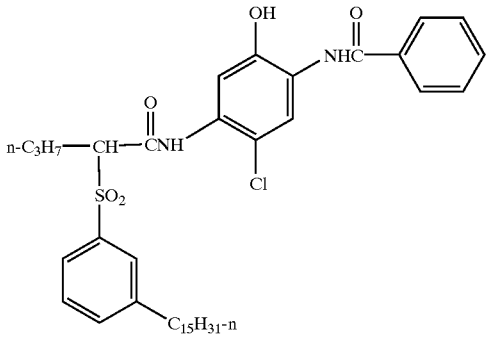
AC-5
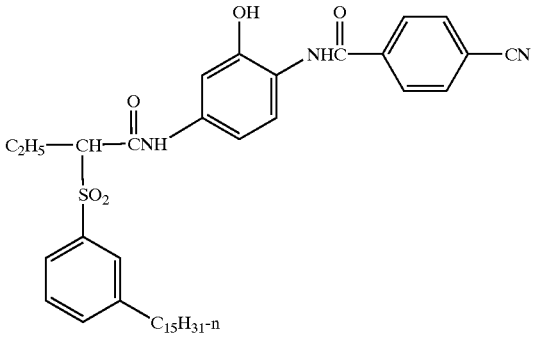
AC-6
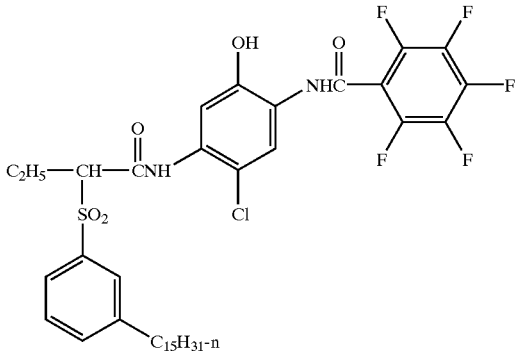
AC-7
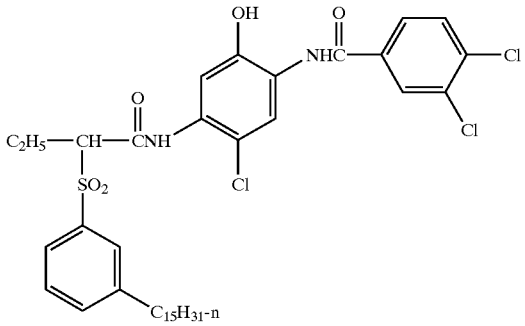
-continued
AC-8
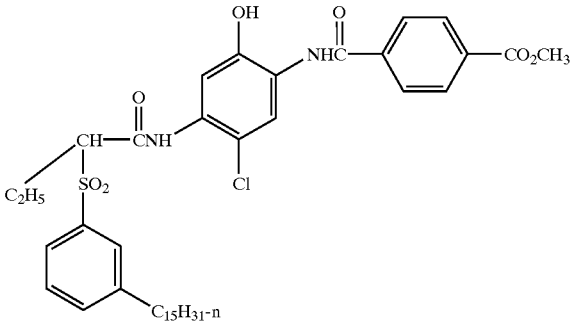
AC-9
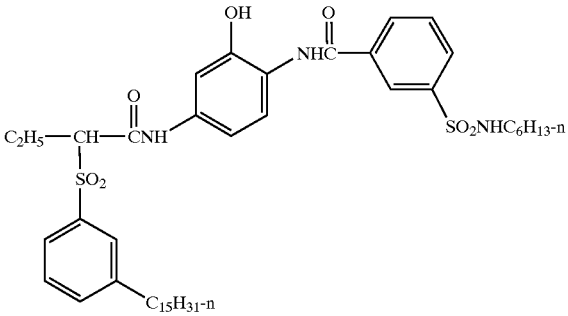
AC-10
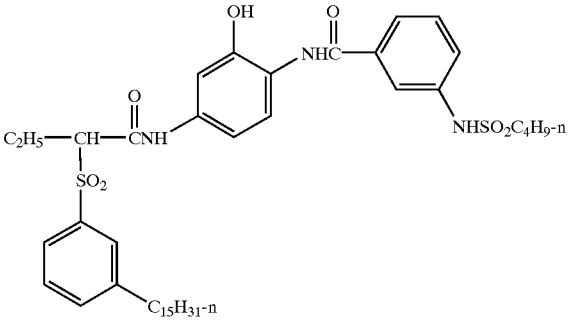
AC-11
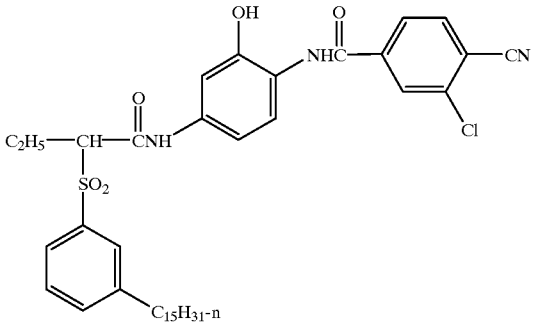

-continued
AC-12
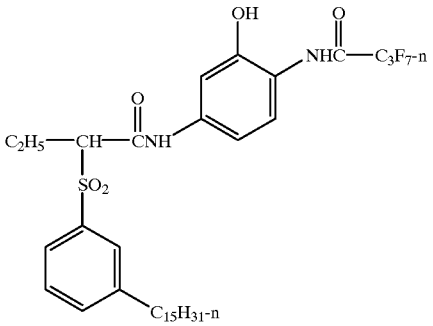
AC-13
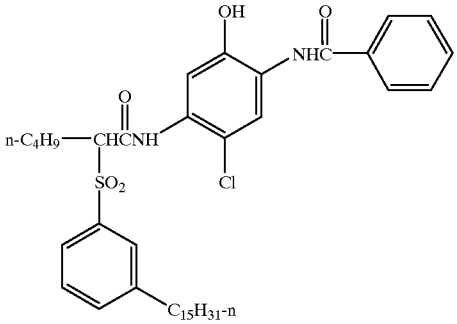
AC-14
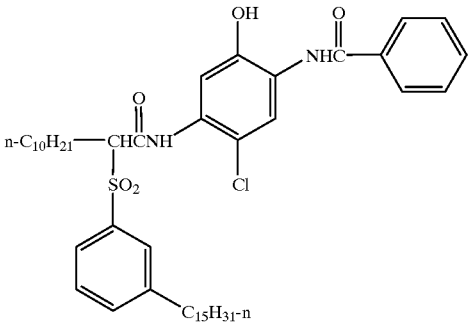
AC-15
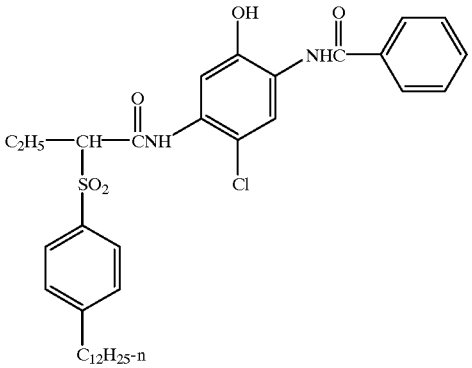
-continued
AC-16
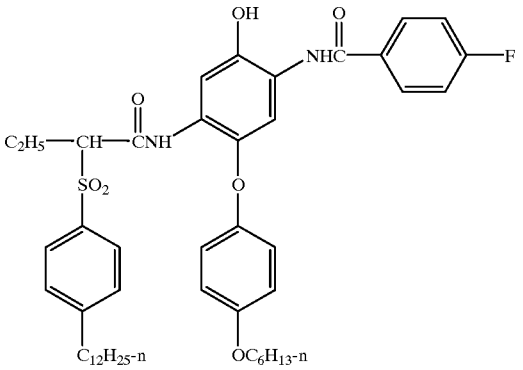
AC-17
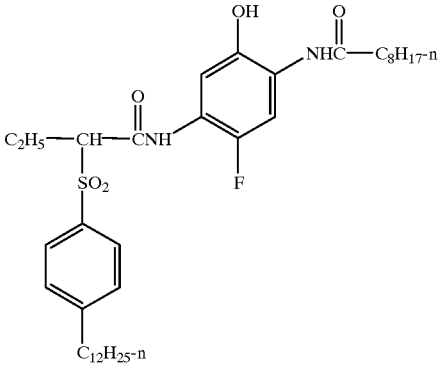
AC-18
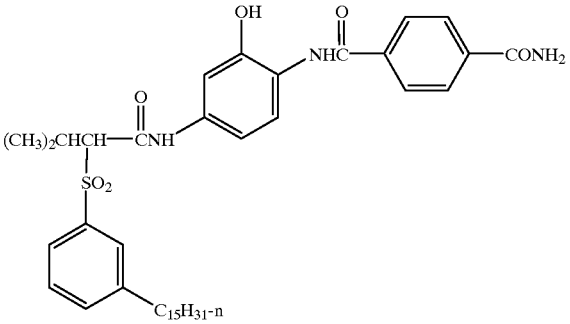
AC-19
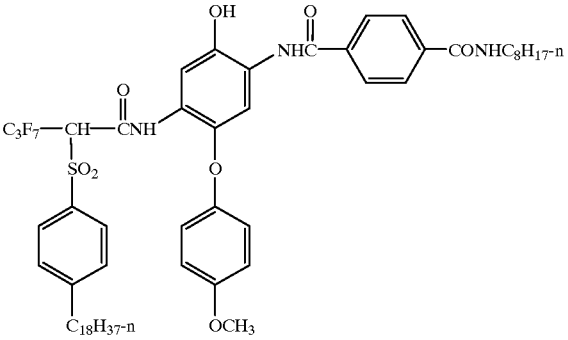

-continued
AC-20
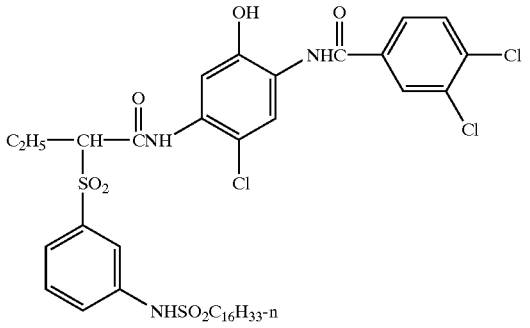
AC-21
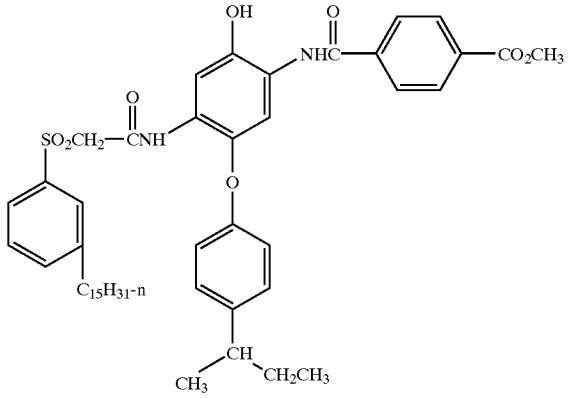
AC-22
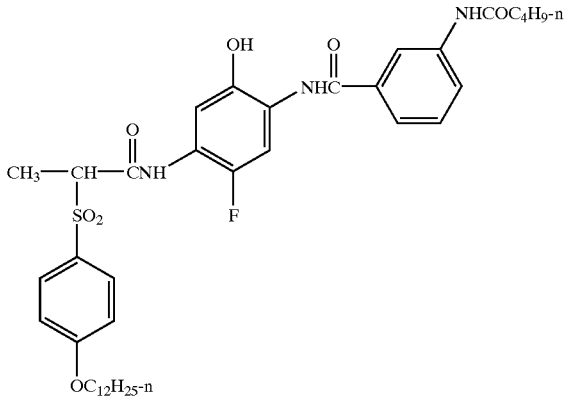
AC-23
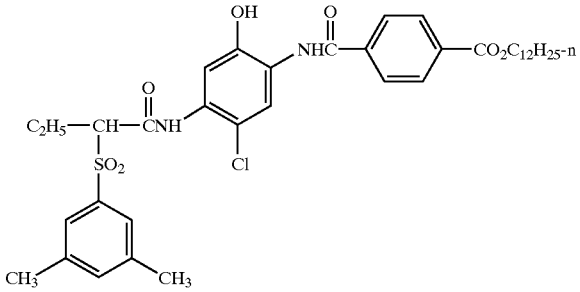
-continued
AC-24
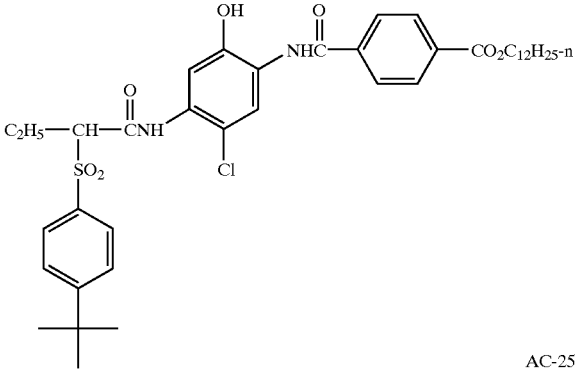
AC-25
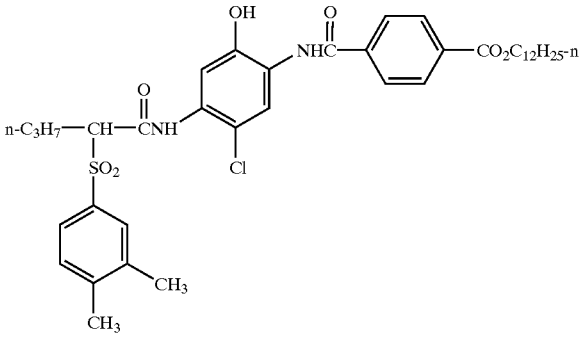
AC-26
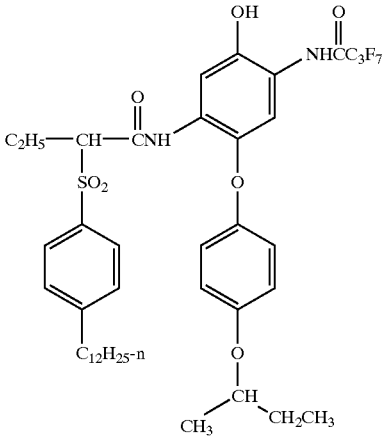
AC-27
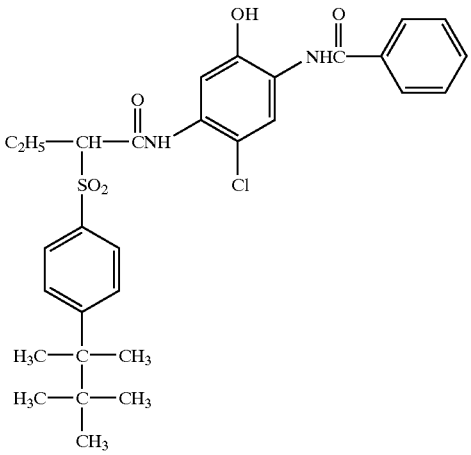

-continued
AC-28
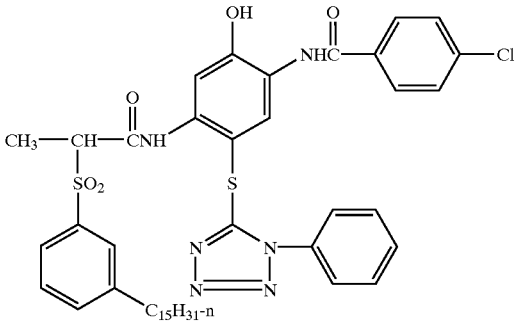
AC-29
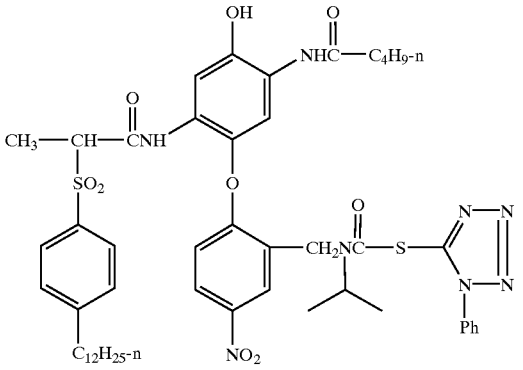
AC-30
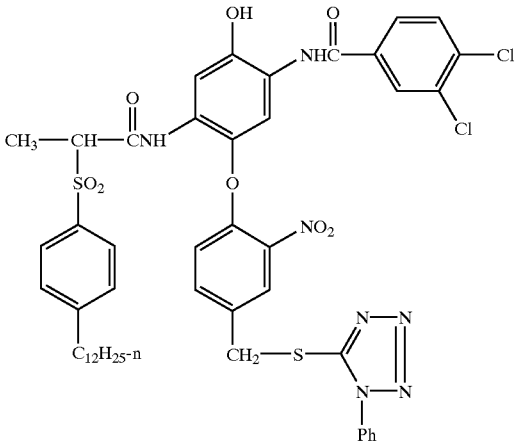
AC-31
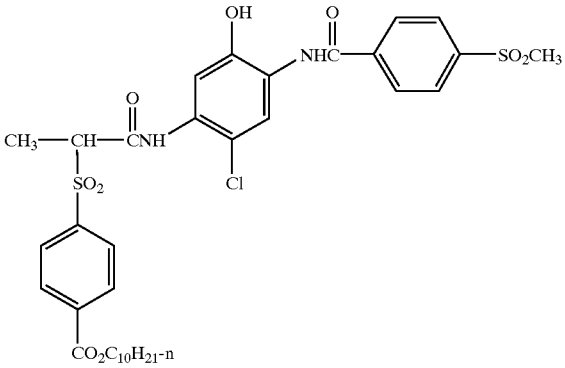
-continued
AC-32
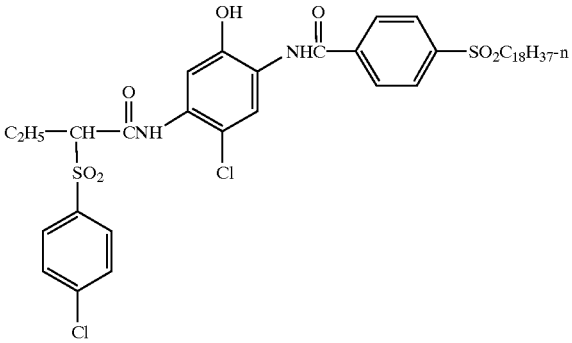
AC-33
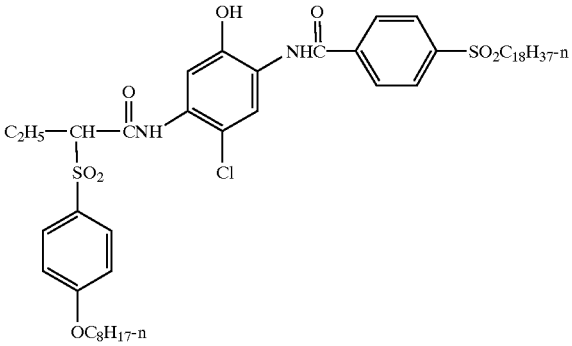
AC-34
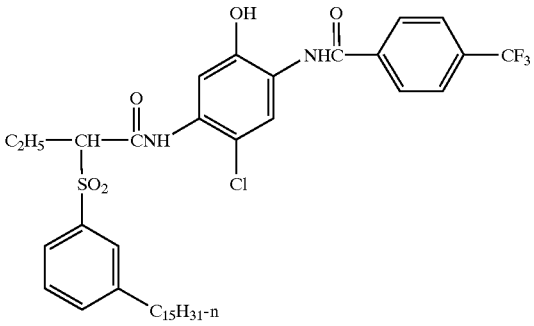
AC-35
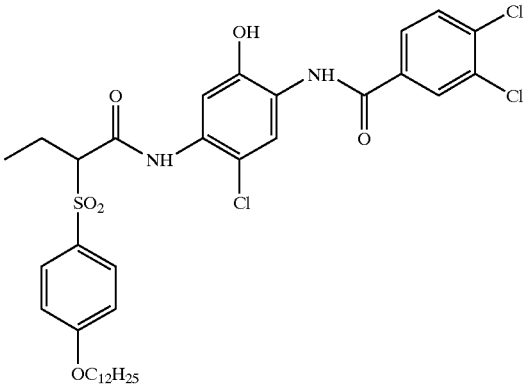

-continued
AC-36
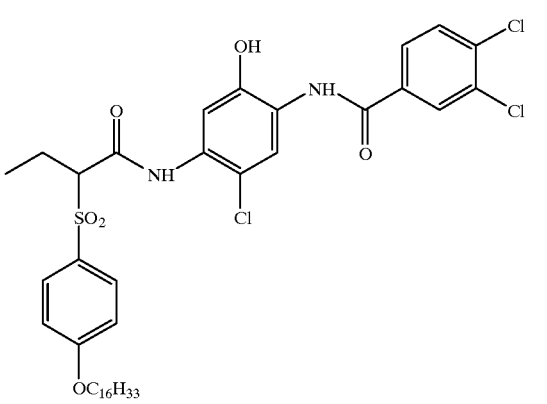
AC-37
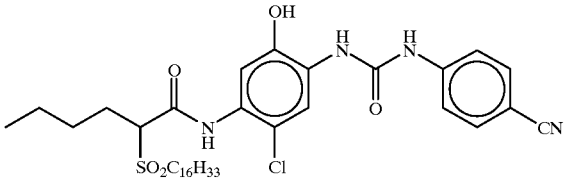
AC-38
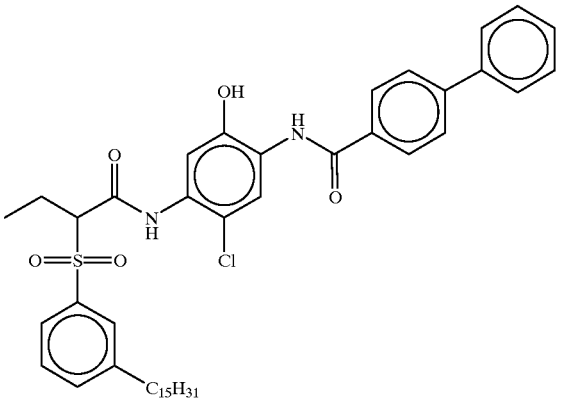
AC-39
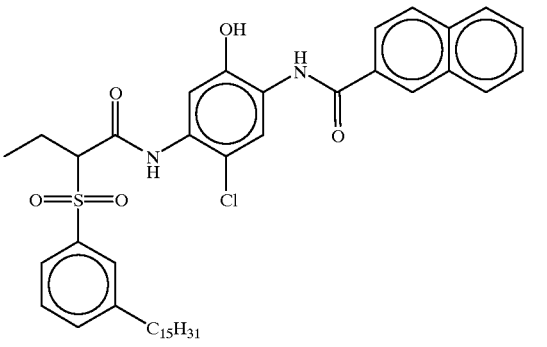
-continued
AC-40
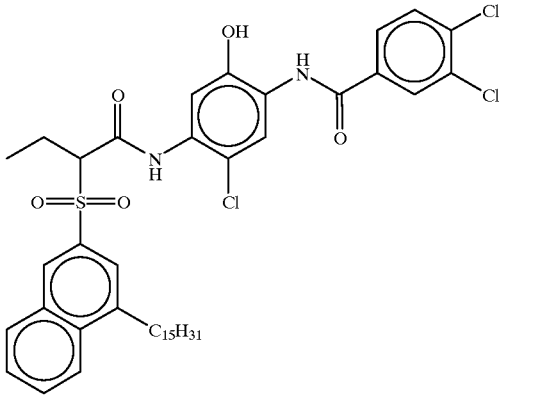
AC-41
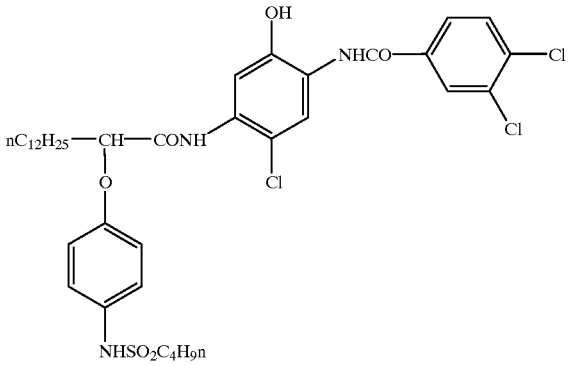
AC-42
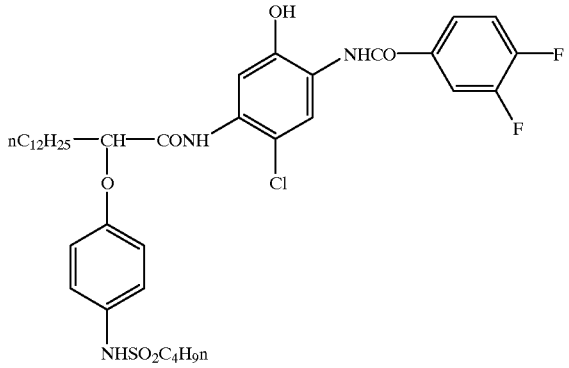
AC-43
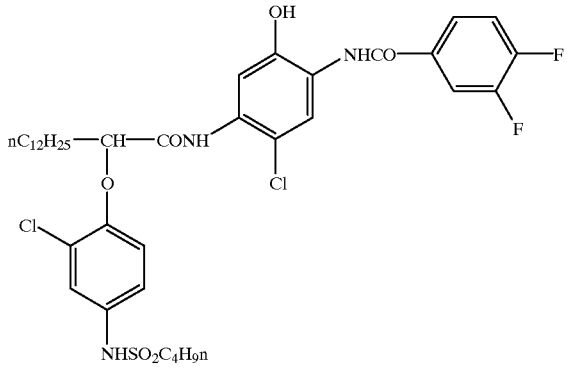

-continued
AC-44
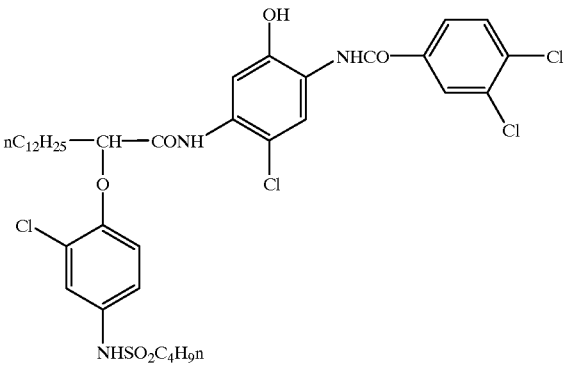
AC-45
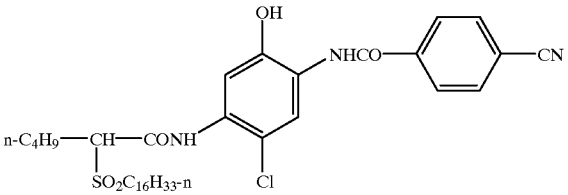
AC-46
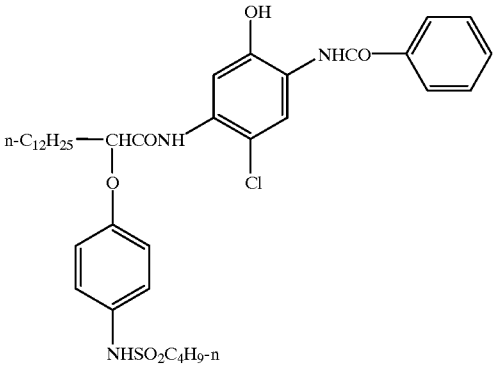
AC-47
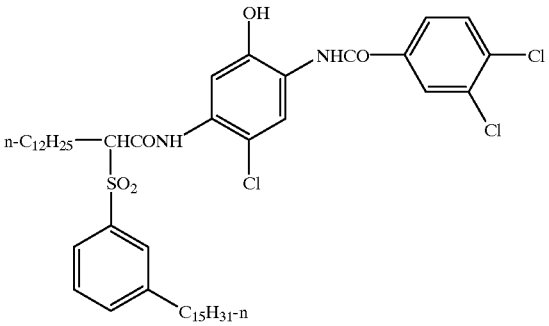
-continued
AC-48
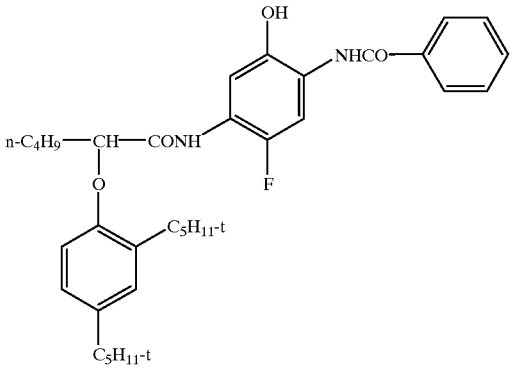
AC-49
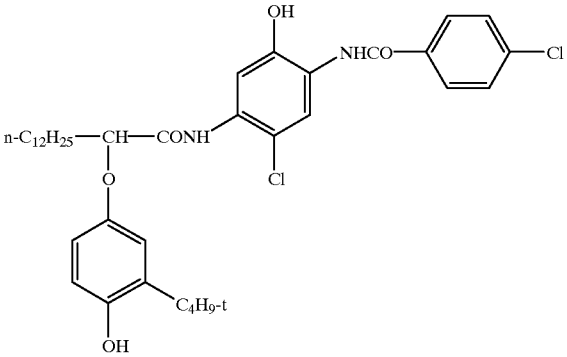
AC-50
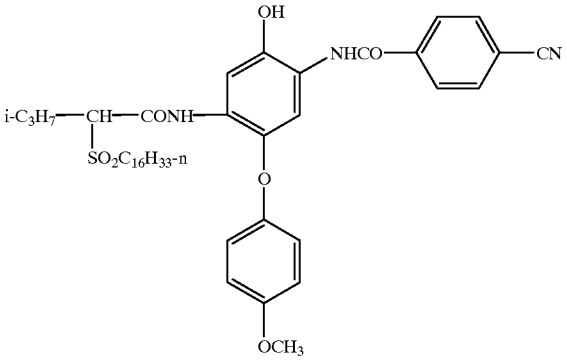
AC-51
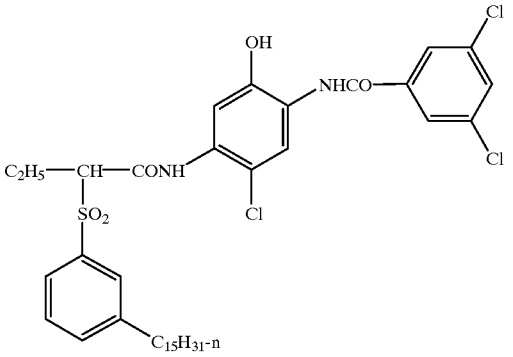

-continued
AC-52
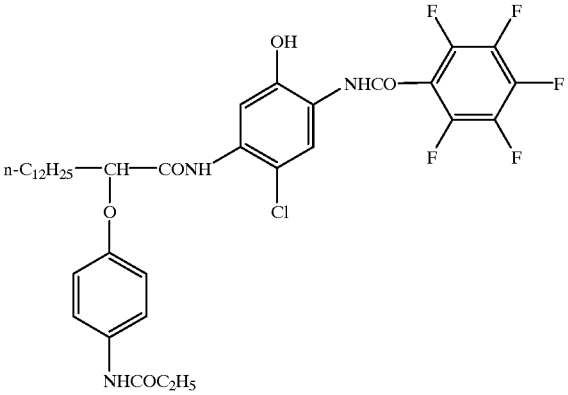
AC-53
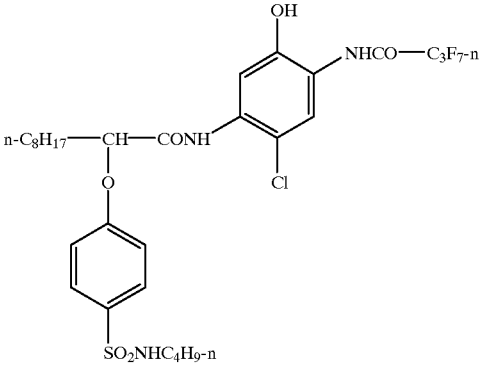
AC-54
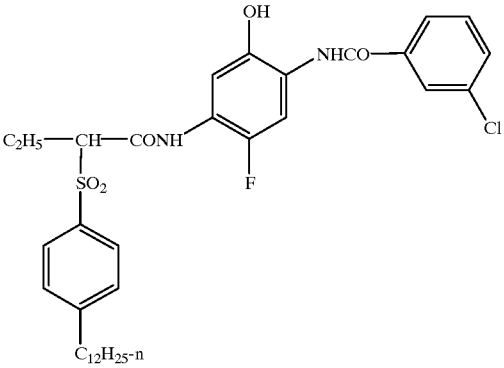
AC-55
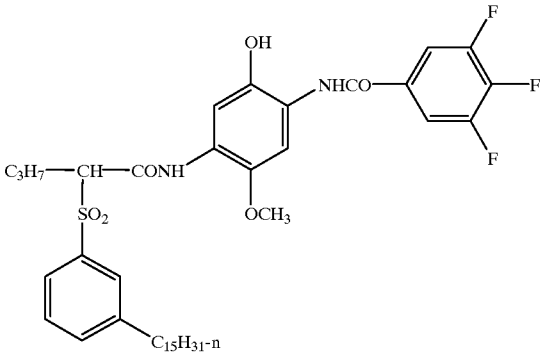
-continued
AC-56
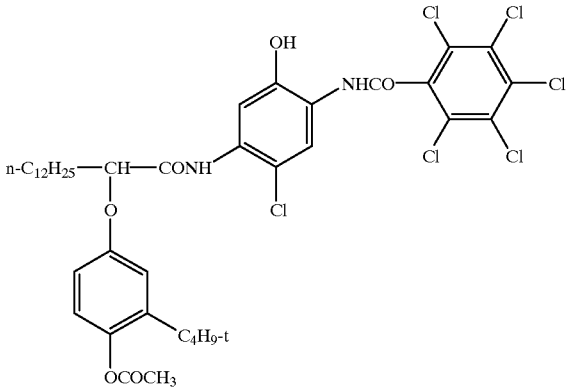
AC-57
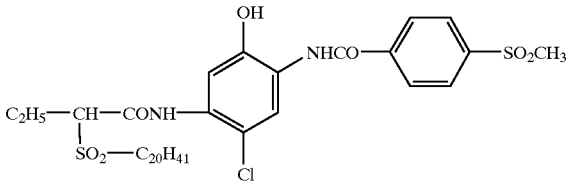
AC-58
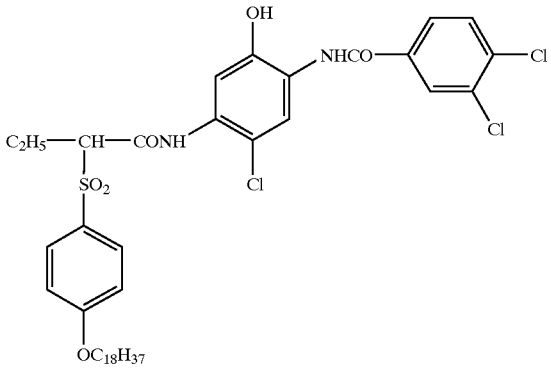
AC-59
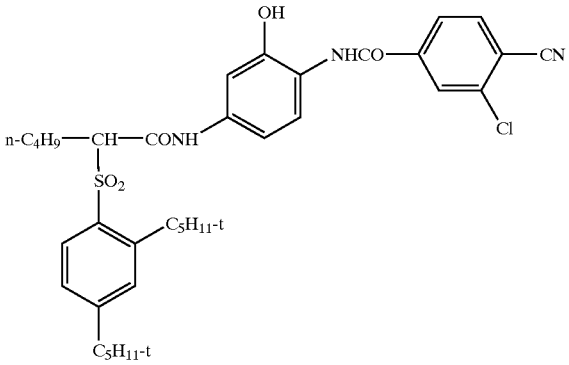

-continued
AC-60
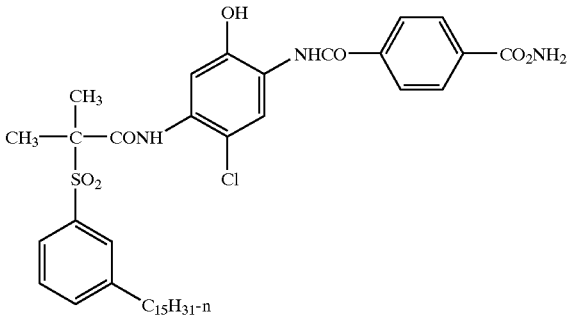
AC-61
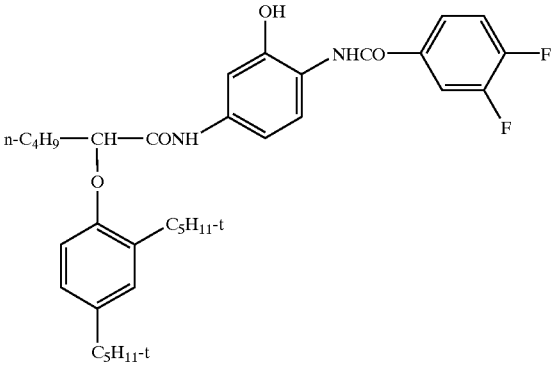
AC-62
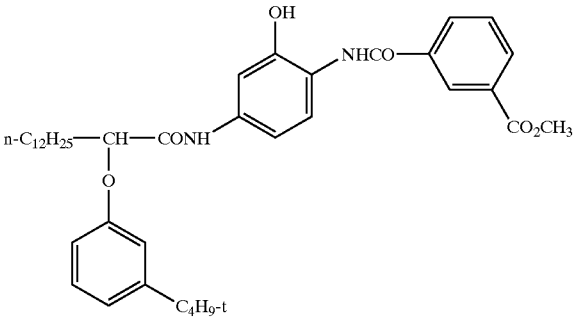
AC-63
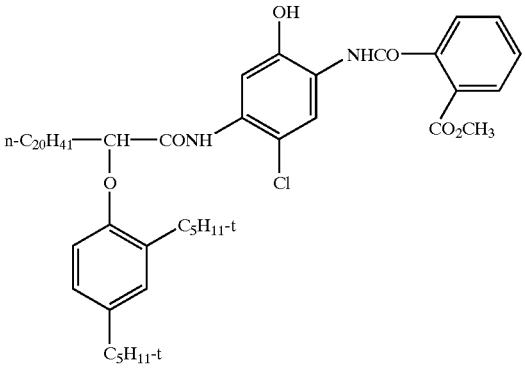
-continued
AC-64
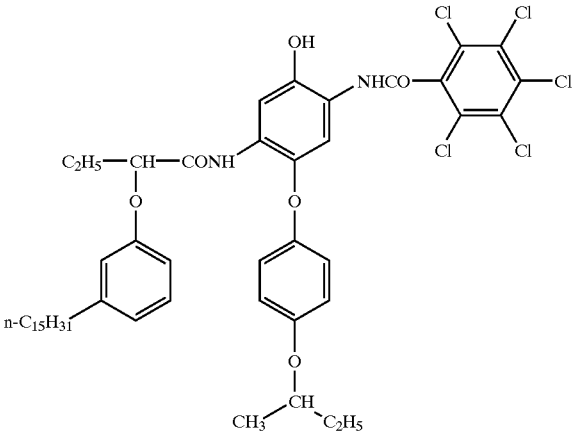
AC-65
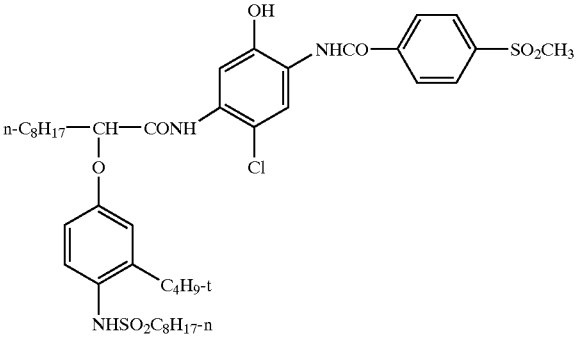
AC-66
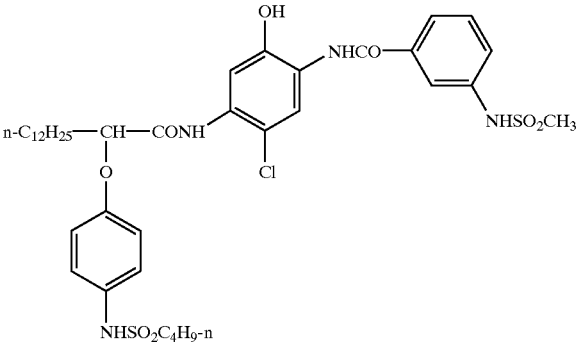
AC-67
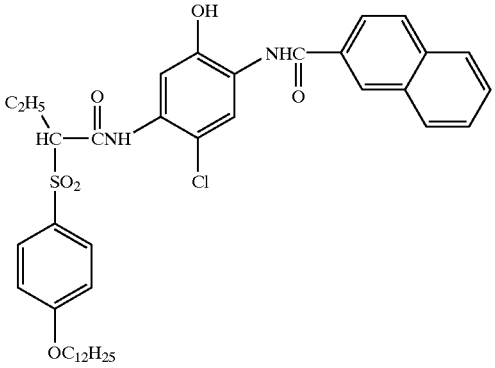

-continued
AC-68
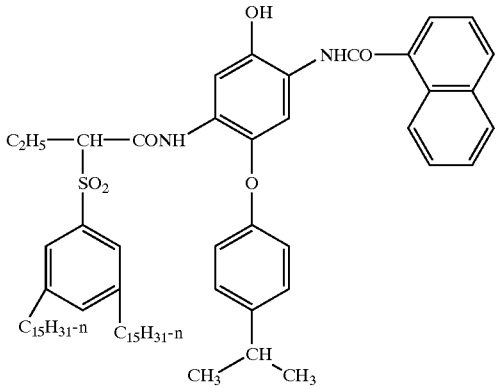
AC-69
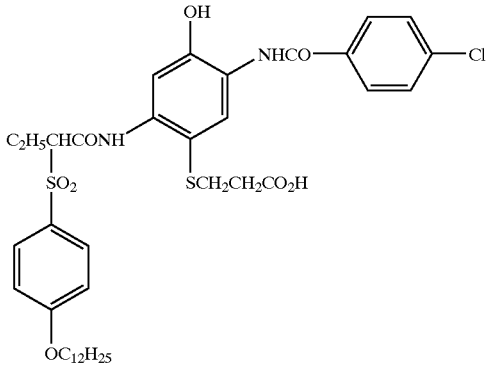
AC-70
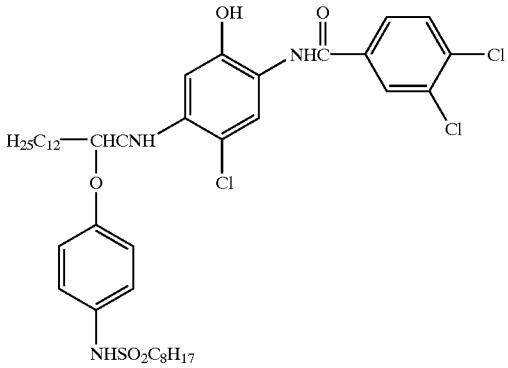
AC-62
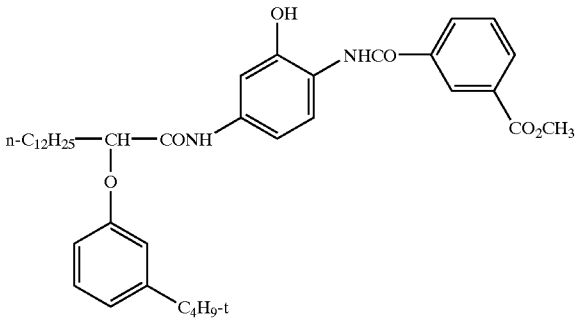
-continued
AC-63
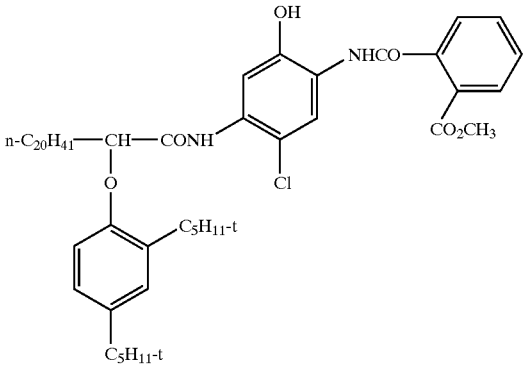
AC-64
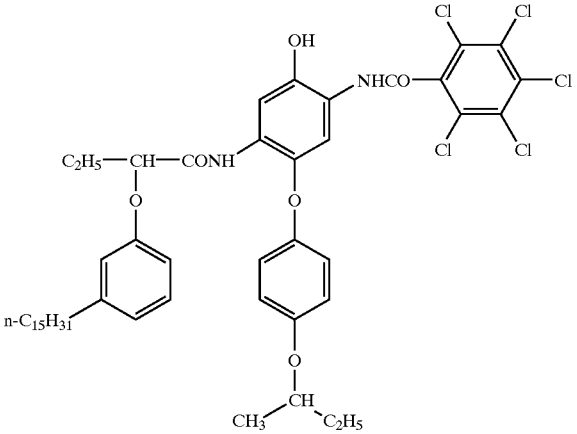
AC-65
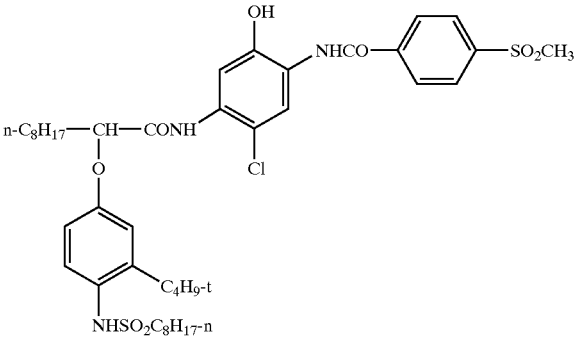
AC-66
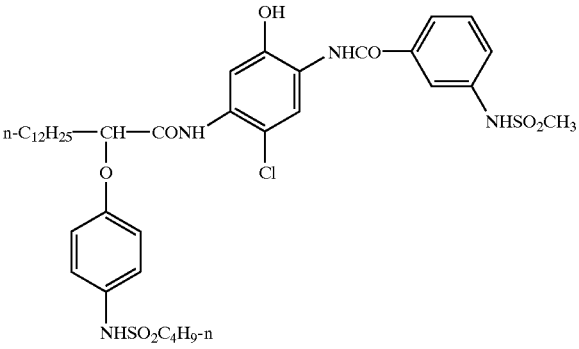

-continued
AC-67
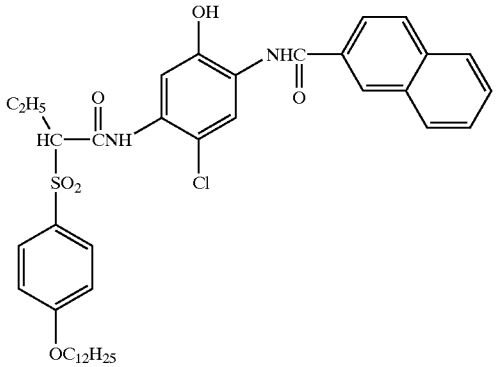
AC-68
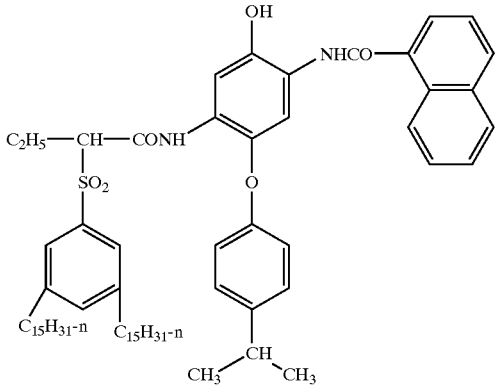
AC-69
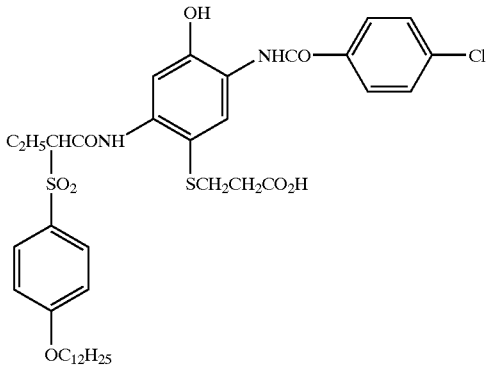
AC-70
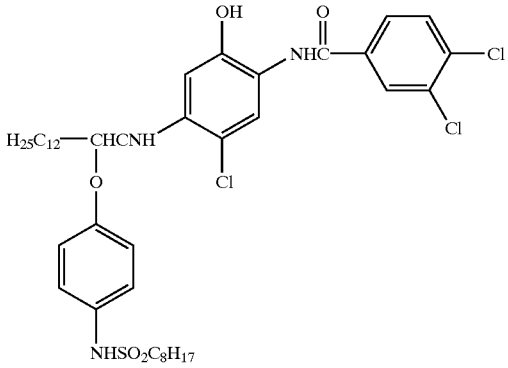
Preferred couplers are (AC-7), (AC-35), (AC-41) and (AC-70). Compounds of formula (IV)
BC-1
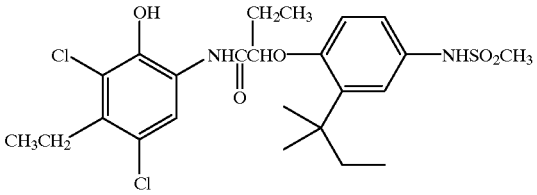
BC-2
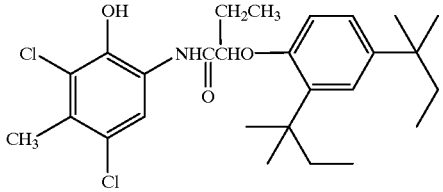
BC-3
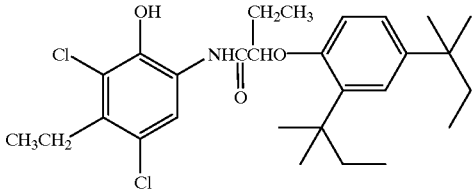
BC-4
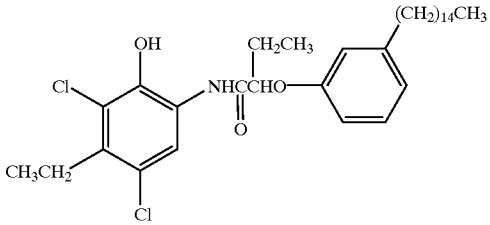
BC-5
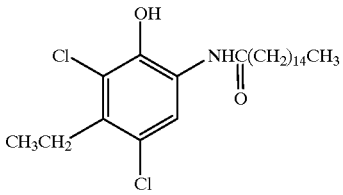
BC-6
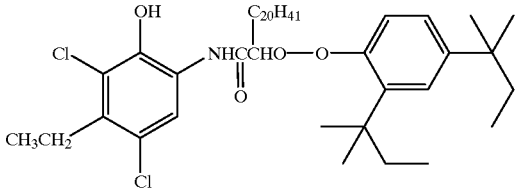
BC-7
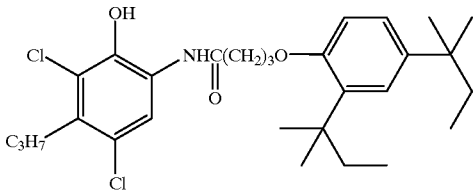

-continued
BC-8
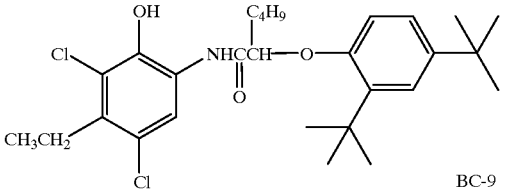
BC-9
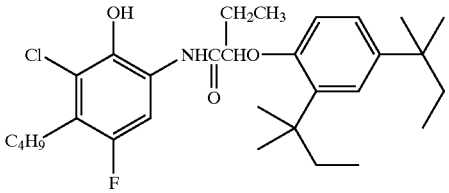
BC-10
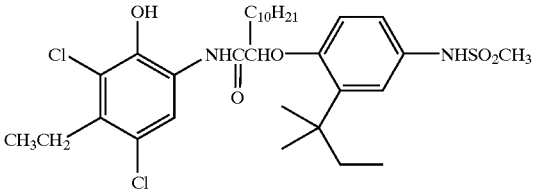
BC-11
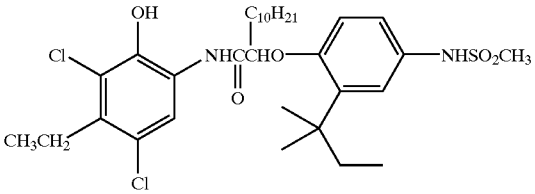
BC-12
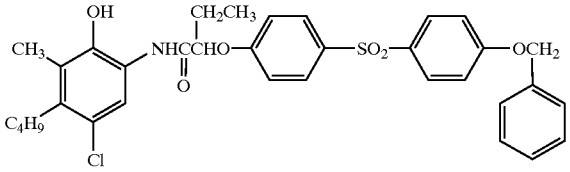
BC-13
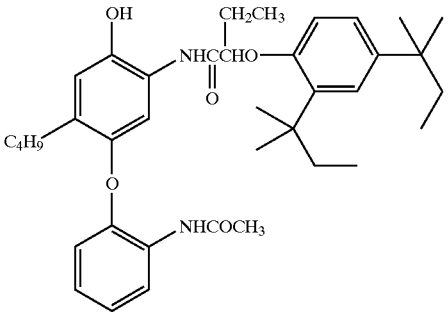
BC-14
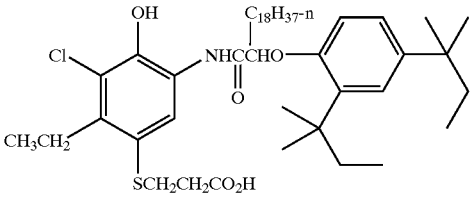
-continued
BC-15
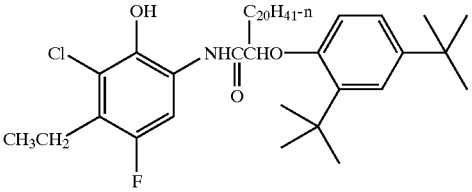
BC-16
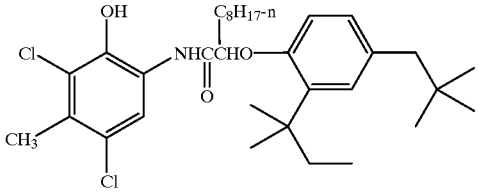
BC-17
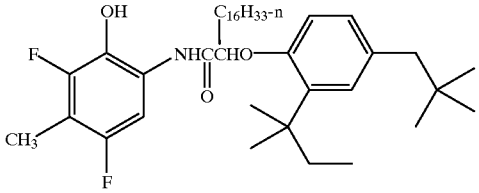
BC-18
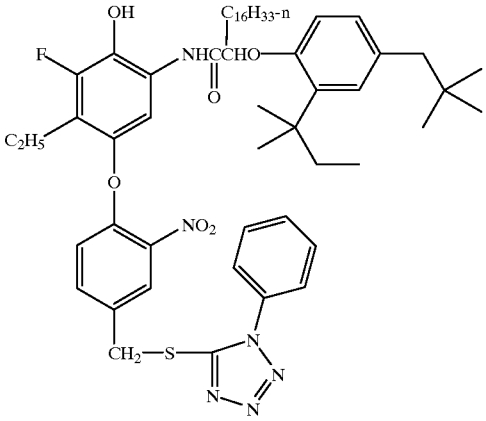
BC-19
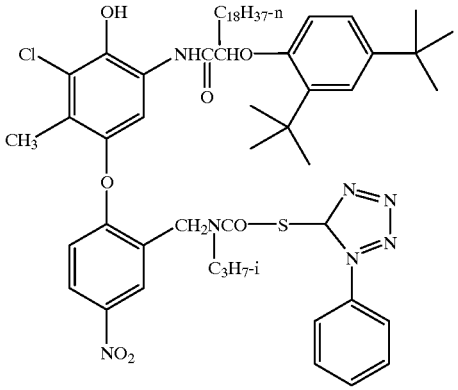

-continued

BC-20

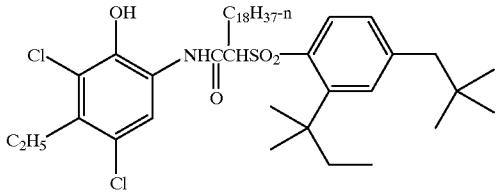

BC-21

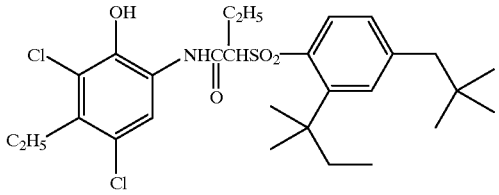

BC-22

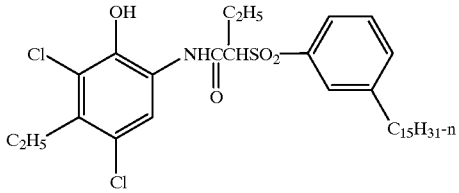

BC-23

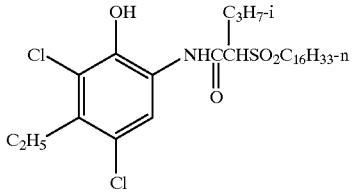

BC-24

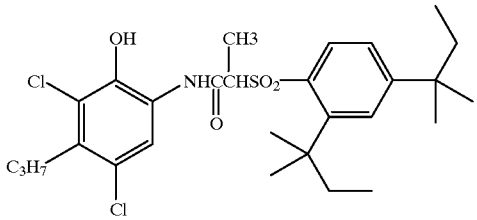

BC-25

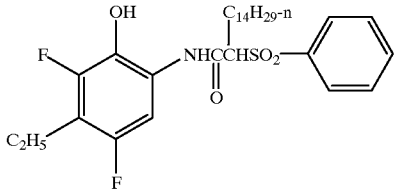

The preferred compound of formula (II) is BC-3

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy and 2-dodecyloxyethoxy; aryl such as phenyl, 4-t-butyl-phenyl, 2,4,6-trimethylphenyl, naphthyl; aryloxy, such as phenoxy, 2-methylphenoxy, alpha- or beta-naphthyloxy and 4-tolyloxy; carbonamido, such as acetamido, benzamido, butyramido, tetradecanamido, alpha-(2,4-di-t-pentylphenoxy)acetamido, alpha-(2,4-di-t-pentyl-phenoxy)butyramido, alpha-(3-pentadecylphenoxy)hexanamido, alpha-(4-hydroxy-3-t-butylphenoxy)tetradecanamido, 2-oxopyrrolidin-1-yl, 2-oxo-5-tetra-decylpyrrolin-1-yl, N-methyltetradecanamido, N-succinimido, N-phthalimido, 2,5-dioxo- 1-oxazolidinyl, 3-dodecyl-2,5-dioxo- 1-imidazolyl and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecyl-ureido, N-hexadecylureido, N,N-dioctadecylureido, N,N-dioctyl-N'-ethylureido, N-phenylureido, N,N-di-phenylureido, N-phenyl-N-p-toluylureido, N-(m-hexa-decylphenyl)ureido, N,N-(2,5-di-t-pentylphenyl)-N'-ethylureido and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl] sulfamoyl, N-methyl-N-tetradecylsulfamoyl and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl and N,N-di-octylcarbamoyl; acyl, such as acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl and p-toluylsulfonyl; sulfonyloxy, such as dodecylsulfonyloxy and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl and p-toluylsulfinyl; thio, such as ethylthio, octylthio, benzylthio, tetradecylthio, 2-(2,4-di-t-pentylphenoxy)-ethylthio, phenylthio, 2-butoxy-5-t-octylphenylthio and p-tolylthio; acyloxy, such as acetyloxy, benzoyloxy, octadecanoyloxy, p-dodecylamidobenzoyloxy, N-phenylcarbamoyloxy, N-ethylcarbamoyloxy and cyclohexylcarbonyloxy; amino, such as phenylanilino, 2-chloroanilino, diethylamino and dodecylamino; imino, such as 1 (N-phenylimido)ethyl, N-succinimido or 3-benzyl-hydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arylsulfonyl, sulfonamido and sulfamoyl groups wherein the substituents typically contain 1 to 42 carbon atoms. Such substituents can also be further substituted.

To increase the light stability of a coating it is customary to add a light stabilizer. A class of stabilizers frequently used are UV absorbers, especially benzotriazoles,that protect the material by absorbing damaging radiation. Another useful group of UV absorbers are the triphenyl-s-triazines, as described e.g. in the following patents: U.S. Pat. No. 3,118,887, U.S. Pat. No. 3,244,708, U.S. Pat. No. 5,461,151 and EP-A-0 704 437, and in particular. the hydroxyphenyltriazine stabilizers described in GB-A-2 317 174.

As used herein the term 'UV absorber' is used to denote a compound that is often used as a light stabilizer (via filtration of UV light) but in this invention can act as both dark and light stabilizer. In particular the UV absorber is a benzotriazole of formula (V):

(V)

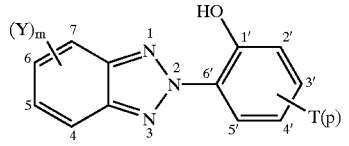

wherein each Y is an independently selected substituent and m is 0 to 4; and each T is an independently selected substituent and p is 0 to 4.

Suitably each Y is independently selected from hydrogen, halogen, nitro and a substituent selected from the group consisting of unsubstituted or substituted alkyl, aryl, alkoxy, aryloxy, acyloxy, alkyl- or aryl-thio, mono- or di-alkylamino, acylamino, alkoxycarbonyl and a 5-membered or 6-membered heterocyclic group containing a nitrogen, oxygen or sulfur atom, and m is 0 to 4.

Furthermore each T is suitably independently selected from hydrogen, halogen and a substituent selected from the group consisting of unsubstituted or substituted alkyl, aryl, alkoxy, aryloxy, acyloxy, alkyl- or aryl-thio, mono- or di-alkylamino, acylamino and a 5-membered or 6-membered heterocyclic group containing a nitrogen, oxygen or sulfur atom, and p is 0 to 4.

More preferably the 5-position and/or 6-position of the benzotriazole ring is unsubstituted or substituted with chlorine, a nitro group, an unsubstituted alkyl or an alkoxycarbonyl group. Furthermore the 3' and 5' positions of the phenyl ring are preferably unsubstituted and the 2'-and/or 4'-positions are preferably substituted with an unsubstituted or substituted alkyl, alkoxy or aryloxy group, especially a branched alkyl group, such as a t-butyl, t-pentyl or 2-ethylhexyl group, or an alkyl group substituted, for example, with an alkoxycarbonyl or substituted amino group. More preferably the ring is di-substituted at the 2'-and 4'-positions.

The following UV absorbers further illustrate the invention. It is not to be construed that the present invention is limited to these examples.

UV-1

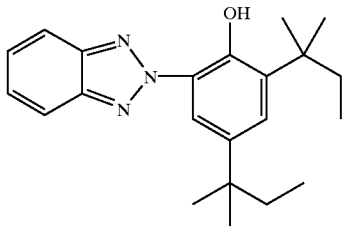

UV-2

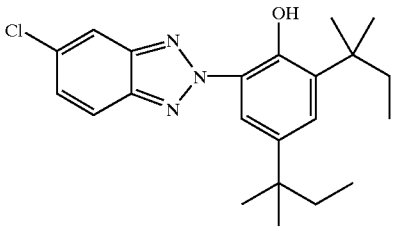

UV-3

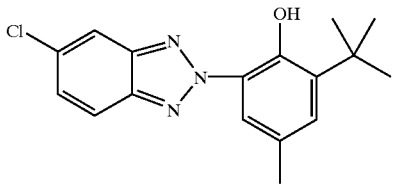

UV-4

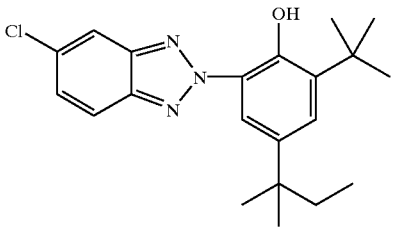

-continued
UV-5
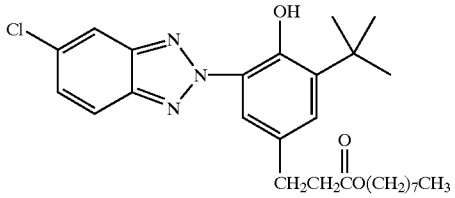
UV-6
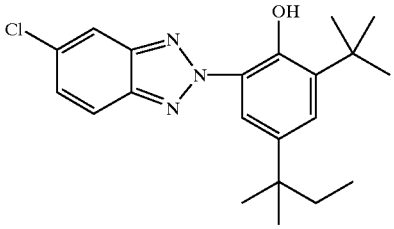
UV-7
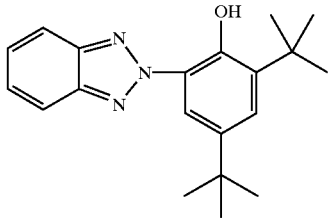
UV-8
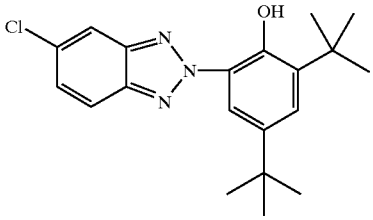
UV-9
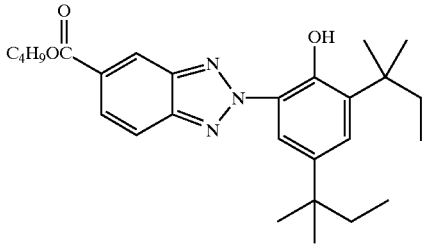
UV-10
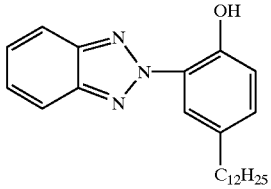
UV-11
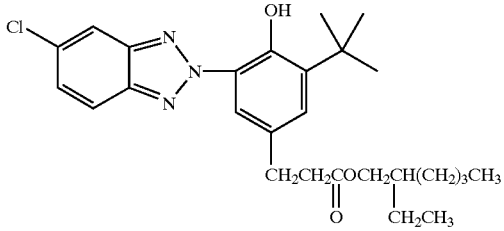
UV-12
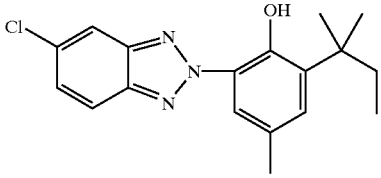
UV-13
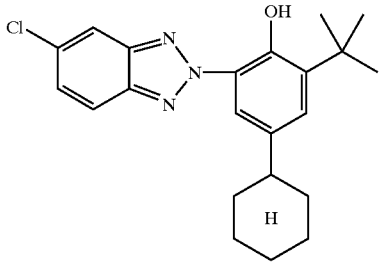
UV-14
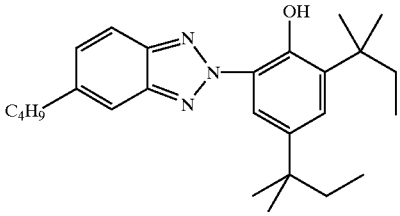
UV-15
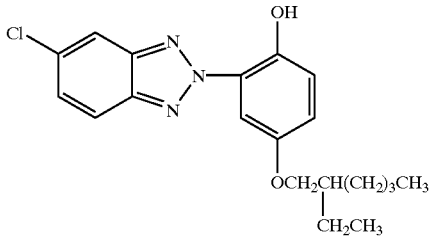
UV-16
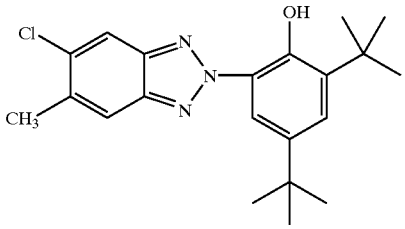

-continued
UV-17
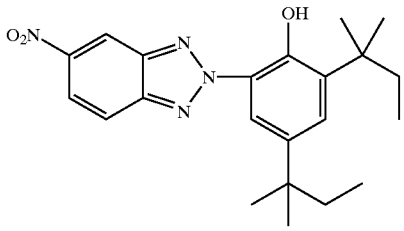
UV-18
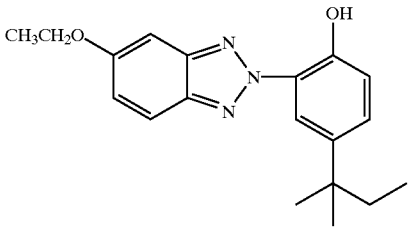
UV-19
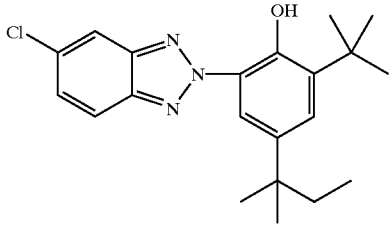
UV-20
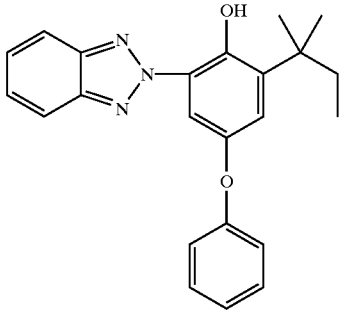
UV-21
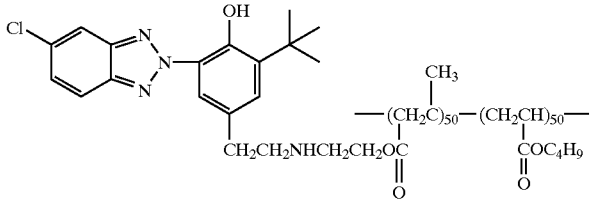
UV-22
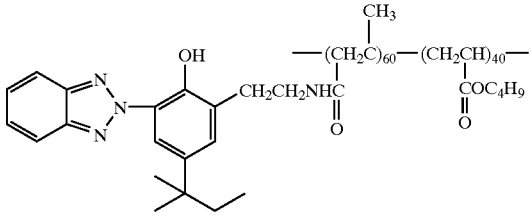
UV-23
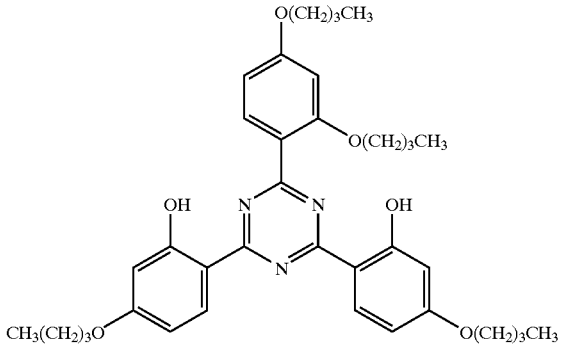
UV-24
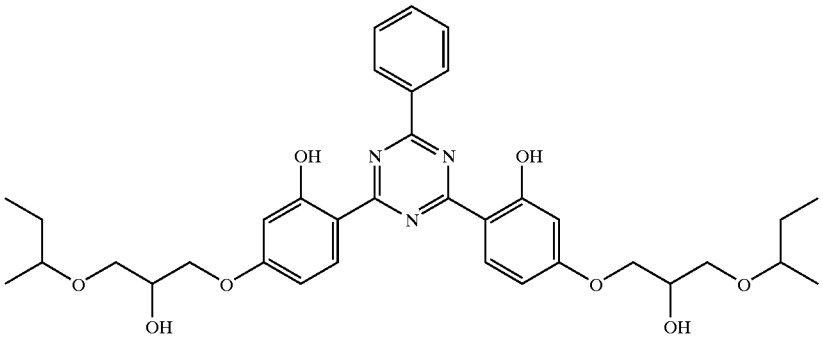

-continued

UV-25

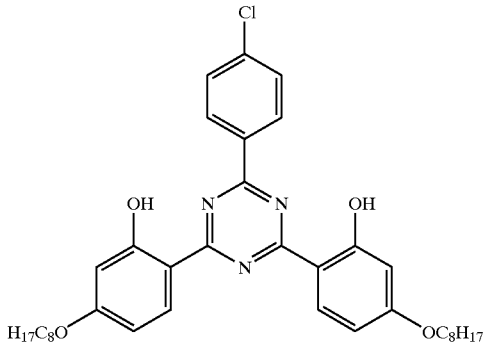

UV-26

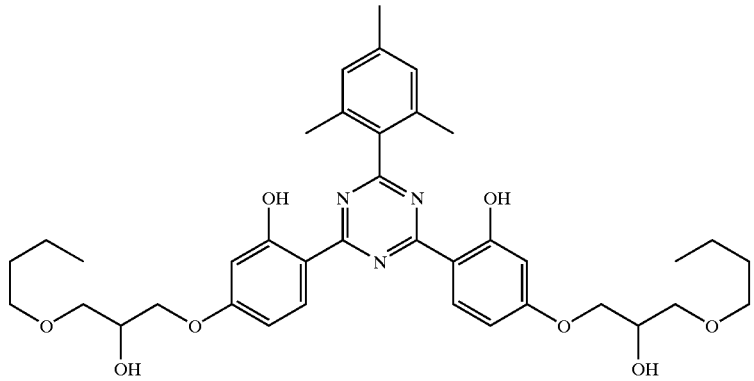

UV-27

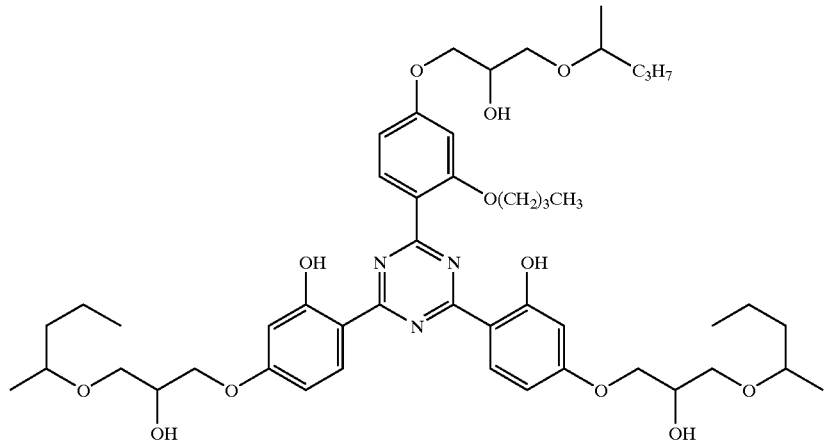

Embodiments of the invention enable lower amounts of coupler and silver to be used by improving the efficiency with which oxidized colour developer reacts with the coupler to form dye. They further exhibit reduction of low unwanted side-band absorption, especially unwanted green absorption, providing a colour record having improved stability to light, heat and humidity and improved hue.

The dispersion of the coupler(s), UV absorber and stabilizer for use in the invention can be prepared by dissolving the materials in a solvent represented by formula (II). A blend of permanent solvents may be advantageous to optimise the desired features, such as solubility, dye hue, thermal or light stability or the coupling reactivity of the dispersions.

The resulting organic solution may then be mixed with an aqueous gelatin solution and the mixture passed through a mechanical mixing device suitable for high-shear or turbulent mixing generally suitable for preparing photographic emulsified dispersions, such as a colloid mill, homogenizer, microfluidizer, high-speed mixer, ultrasonic dispersing apparatus, blade mixer, device in which a liquid stream is pumped at high pressure through an orifice or interaction chamber, Gaulin mill or blender to form small particles of the organic phase suspended in the aqueous phase. More than one type of device may be used to prepare the dispersions. The dispersion particles preferably have an average particle size of less than 2 $\mu$m, generally from about 0.02 to 2 $\mu$m, more preferably from about 0.02 to 0.5 $\mu$m, especially from about 0.02 to 0.3 $\mu$m. These methods are described in detail in U.S. Pat. Nos. 2,322,027, 2,787,544, 2,801,170, 2,801,171, 2,949,360 and 3,396,027, the disclosures of which are incorporated by reference herein.

The aqueous phase of the coupler dispersions for use in the invention preferably comprises gelatin as a hydrophilic colloid. This may be gelatin or a modified gelatin such as acetylated gelatin, phthalated gelatin or oxidized gelatin. Gelatin may be base-processed, such as lime-processed gelatin, or may be acid-processed, such as acid-processed ossein gelatin. Other hydrophilic colloids may also be used, such as a water-soluble polymer or copolymer including, but not limited to poly(vinyl alcohol), partially hydrolyzed poly(vinyl acetate-co-vinyl alcohol), hydroxyethyl cellulose, poly(acrylic acid), poly(1-vinylpyrrolidone), poly (sodium styrene sulfonate), poly(2-acrylamido-2-methane sulfonic acid) and polyacrylamide. Copolymers of these polymers with hydrophobic monomers may also be used.

A surfactant may be present in either the aqueous phase or the organic phase or the dispersions can be prepared without any surfactant present. Surfactants may be cationic, anionic, zwitterionic or non-ionic. Ratios of surfactant to liquid organic solution typically are in the range of 0.5 to 25 wt. % for forming small particle photographic dispersions. In a preferred embodiment of the invention, an anionic surfactant is contained in the aqueous gelatin solution. Particularly preferred surfactants which are employed in the present invention include an alkali metal salt of an alkarylene sulfonic acid, such as the sodium salt of dodecyl benzene sulfonic acid or sodium salts of isopropylnaphthalene sulfonic acids, such as mixtures of di-isopropyl- and tri-isopropylnaphthalene sodium sulfonates; an alkali metal salt of an alkyl sulfuric acid, such as sodium dodecyl sulfate; or an alkali metal salt of an alkyl sulfosuccinate, such as sodium bis (2-ethylhexyl) succinic sulfonate.

Aqueous dispersions of high-boiling solvents of formulae (II) can be prepared similarly to the coupler dispersion(s), e.g. by adding the solvent to an aqueous medium and subjecting such mixture to high shear or turbulent mixing as described above. The aqueous medium is preferably a gelatin solution, and surfactants may also be used as described above. Additionally, a hydrophobic additive may be dissolved in the solvent to prevent particle growth as described in U.S. Pat. No. 5,468,604, the disclosure of which is incorporated by reference. The mixture is then passed through a mechanical mixing device such as a colloid mill, homogenizer, microfluidizer, high speed mixer or ultrasonic dispersing apparatus to form small particles of the organic solvent suspended in the aqueous phase. These methods are described in detail in the aforementioned references on dispersion making.

An aqueous coating solution in accordance with the present invention may then be prepared by combining the coupler dispersion(s) with the separate dispersion of the high-boiling organic solvent of formula (II). Other ingredients may also be contained in this solution such as silver halide emulsions, dispersions or solutions of other photographically useful compounds, additional gelatin, or acids and bases to adjust the pH. These ingredients may then be mixed with a mechanical device at an elevated temperature (e.g. 30 to 50 C.) for a short period of time (e.g. 5 min to 4 h) prior to coating.

The materials for use in the invention can be used in any of the ways and in any of the combinations known in the art. Typically, the materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized colour developing agent. Thus, as used herein, the term "associated" signifies that the compound is in the silver halide emulsion layer or in an adjacent location where, during processing, it is capable of reacting with silver halide development products.

Suitable laydowns of total coupler are from about 0.01 mmol/$m^2$ to about 1.5 mmol/$m^2$, preferably from about 0.15 mmol/$m^2$to about 1 mmol/$m^2$, more preferably from about 0.19 mmol/$m^2$ to about 0.55 mmol/$m^2$. The ratio of stabilizer or UV absorber to total coupler is from about 0.01:1 to about 4:1, preferably from about 0.1:1 to about 2:1, more preferably from about 0.5:1 to about 2:1. The ratio of solvent to total coupler is from about 0.2:1 to about 4:1, preferably from about 0.5:1 to about 4:1, more preferably from about 0.5:1 to about 2:1.

The photographic elements comprising coupler dispersions for use in the invention can be single colour elements or multicolour elements. Multicolour elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolour photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler.

The element can be employed with a reflective support, as described in U.S. Pat. No. 5,866,282. The element can contain additional layers, such as filter layers, interlayers, overcoat layers and subbing layers.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230 provides suitable embodiments.

In the following discussion of suitable materials for use in the emulsions and elements of this invention, reference will be made to *Research Disclosure,* September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. colour negative, reversal or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials and physical property modifying addenda such as hardeners, coating aids, plasticizers, lubricants and matting agents are described, for example, in Sections II and VI through VIII. Colour materials are described in Sections X through XIII. Scan facilitating is described in Section XIV. Supports, exposure, development systems and processing methods and agents are described in Sections XV to XX. Certain desirable photographic elements and processing steps, particularly those useful in conjunction with colour reflective prints, are described in *Research Disclosure,* Item 37038, February 1995. U.S. Pat. No. 5,558,980 discloses loaded latex compositions, such as poly- and t-butylacrylarmides which can be incorporated into any photographic coating in any layer to provide extra dye stability.

Couplers that form cyan dyes upon reaction with oxidized colour developing agents are typically phenols, naphthols or pyrazoloazoles, described in such representative patents and publications as U.S. Pat. Nos. 2,367,531; 2,423,730; 2,474,293; 2,772,162; 2,895,826; 3,002,836; 3,034,892; 3,041,236; 4,333,999 and 4,883,746; European Patent Application Nos. 0 544 322; 0 556 700; 0 556 777; 0 565 096; 0 570 006 and 0 574 948 and "Farbkuppler-eine Literature Übersicht," published in Agfa Mitteilungen, Band III, pp. 156–175 (1961).

Couplers that form magenta dyes upon reaction with oxidized colour developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654 and "Farbkuppler-eine Literature Übersicht," published in Agfa Mitteilungen, Band III, pp. 126–156 (1961). Preferably such couplers are pyrazolones, pyrazolotriazoles or pyrazolobenzimidazoles that form magenta dyes upon reaction with oxidized colour developing agents.

Especially preferred couplers are 1H-pyrazolo [5,1-c]-1,2,4 triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465 and 5,023,170. Examples of 1H-pyrazolo [1,5-b]-1,2,4-triazoles can be found in European Patent applications 176,804; 177,765; U.S. Pat. Nos. 4,659,652; 5,066,575 and 5,250,400.

Typical pyrazoloazole and pyrazolone couplers are represented by the following formulae:

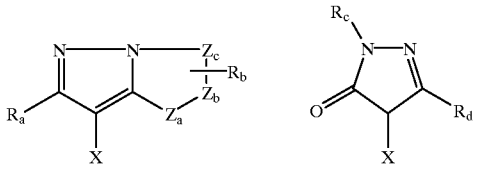

wherein $R_a$ and $R_b$ are independently hydrogen or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, ═N—, ═C— or —NH—, provided that one of either the $Z_a$–$Z_b$ bond or the $Z_b$–$Z_c$ bond is a double bond and the other is a single bond, and when the $Z_b$—$Z_c$ bond is a carbon—carbon double bond, it may form part of an aromatic ring, and at least one of $Z_a$, $Z_b$, and $Z_c$ is a methine group connected to the group $R_b$.

Specific examples of such couplers are:

M-1

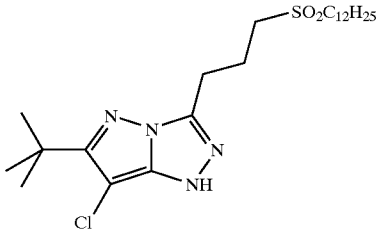

M-2

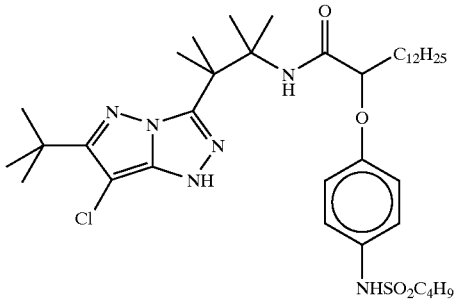

M-3

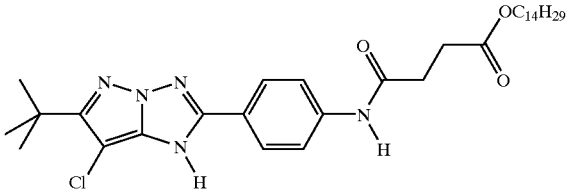

M-4

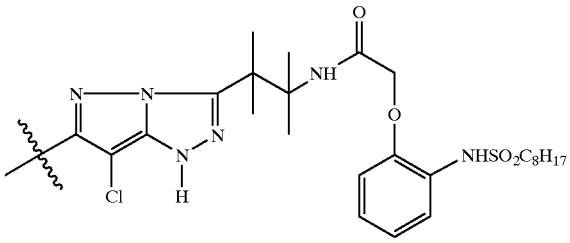

Couplers that form yellow dyes upon reaction with oxidized colour developing agent are described in such representative patents and publications as: U.S. Pat. Nos. 2,298,443, 2,407,210, 2,875,057, 3,048,194, 3,265,506, 3,447,928, 3,960,570, 4,022,620, 4,443,536, 4,910,126 and 5,340,703 and "Farbkuppler-eine Literature Übersicht", published in Agfa Mitteilungen, Band III, pp. 112–126 (1961). Such couplers are typically open chain ketomethylene compounds.

Also preferred are yellow couplers such as described in, for example, European Patent Application Nos. 482,552; 510,535; 524,540; 543,367 and U.S. Pat. No. 5,238,803. For improved colour reproduction, couplers which give yellow dyes that cut off sharply on the long wavelength side are particularly preferred (for example, see U.S. Pat. No. 5,360,713).

Typical preferred yellow couplers are represented by the following formulae:

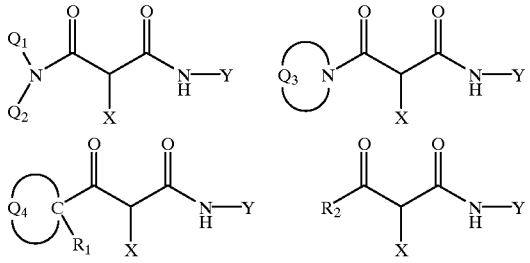

wherein $R_1$, $R_2$, $Q_1$ and $Q_2$ are each a substituent; X is hydrogen or a coupling-off group; Y is an aryl group or a heterocyclic group; $Q_3$ is an organic residue required to form a nitrogen-containing heterocyclic group together with the >N—; and $Q_4$ are nonmetallic atoms necessary to form a 3- to 5-membered hydrocarbon ring or a 3- to 5-membered heterocyclic ring which contains at least one hetero atom selected from nitrogen, oxygen, sulfur and phosphorous in the ring. Particularly preferred is when $Q_1$ and $Q_2$ are each an alkyl group, an aryl group or a heterocyclic group, and $R_2$ is an aryl or tertiary alkyl group.

Preferred yellow couplers have the following structures:

Y-1

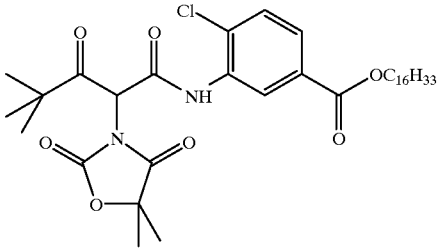

Y-2

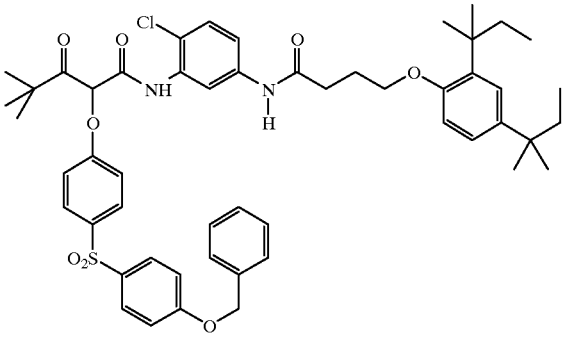

Y-3

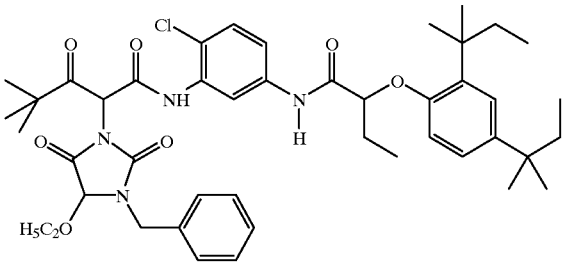

-continued

Y-4

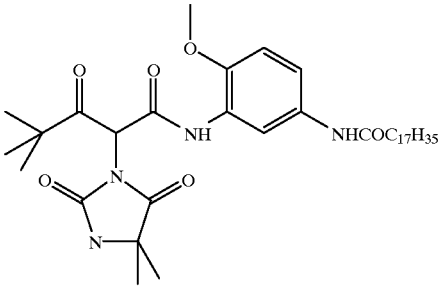

Y-5

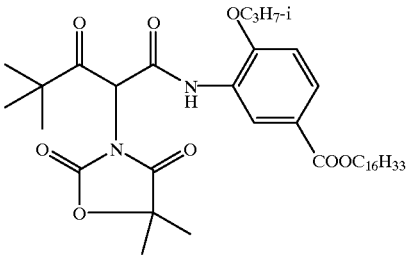

Y-6

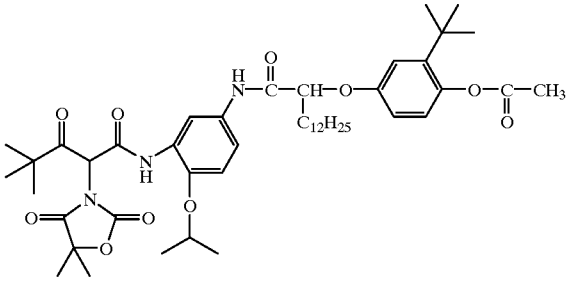

Couplers that form colourless products upon reaction with oxidized colour developing agent are described in such representative patents as: U.K. Patent No. 861,138; U.S. Pat. Nos. 3,632,345, 3,928,041, 3,958,993 and 3,961,959. Typically such couplers are cyclic carbonyl-containing compounds that form colourless products on reaction with an oxidized colour developing agent.

Couplers that form black dyes upon reaction with oxidized colour developing agent are described in such representative patents as U.S. Pat. Nos. 1,939,231; 2,181,944; 2,333,106 and 4,126,461; German OLS No. 2,644,194 and German OLS No. 2,650,764. Typically, such couplers are resorcinols or m-aminophenols that form black or neutral products on reaction with oxidized colour developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343 and 5,234,800.

It may be useful to use additional couplers any of which may contain known ballasts or coupling-off groups such as those described in U.S. Pat. Nos. 4,301,235, 4,853,319 and 4,351,897. The coupler may contain solubilizing groups such as described in U.S. Pat. No. 4,482,629. The coupler may also be used in association with "wrong" coloured couplers (e.g. to adjust levels of interlayer correction) and, in colour negative applications, with masking couplers such as those described in EP 213.490; Japanese Published Application 58-172,647; U.S. Pat. Nos. 2,983,608, 4,070,191 and 4,273,861; German Applications DE 2,706,117 and DE 2,643,965; UK Patent No. 1,530,272 and Japanese Application 58-113935. The masking couplers may be shifted or blocked, if desired.

The materials for use in the invention may be used in association with materials that accelerate or otherwise modify the processing steps e.g. of bleaching or fixing to improve the quality of the image. Bleach accelerator releasing couplers such as those described in EP 193,389; EP 301,477 and in U.S. Pat. Nos. 4,163,669, 4,865,956 and 4,923,784, may be useful. Also contemplated is use of the compositions in association with nucleating agents, development accelerators or their precursors (UK Patent Nos. 2,097,140 and 2,131,188); electron transfer agents (U.S. Pat. Nos. 4,859,578 and 4,912,025); antifogging and anti colour-mixing agents such as derivatives of hydroquinones, aminophenols, amines, gallic acid; catechol; ascorbic acid; hydrazides; sulfonamidophenols and non colour-forming couplers.

The materials for use in the invention may also be used in combination with filter dye layers comprising colloidal silver sol or yellow, cyan and/or magenta filter dyes, either as oil-in-water dispersions, latex dispersions or as solid particle dispersions. Additionally, they may be used with "smearing" couplers (e.g. as described in U.S. Pat. Nos. 4,366,237, 4,420,556, 4,543,323 and in EP 96,570) Also, the compositions may be blocked or coated in protected form as described, for example, in Japanese Application 61/258,249 or U.S. Pat. No. 5,019,492.

The materials for use in the invention may further be used in combination with image-modifying compounds such as "Developer Inhibitor-Releasing" compounds (DIRs). DIRs useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in Photographic Science and Engineering, Vol.13, p.174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercapto-benzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, tellurotetrazoles or benzisodiazoles. In a preferred embodiment, the inhibitor moiety or group is selected from the following formulae:

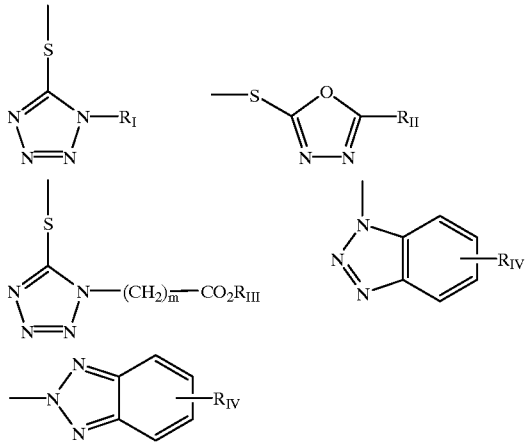

wherein $R_I$ is selected from the group consisting of straight and branched alkyl groups of from 1 to about 8 carbon atoms, benzyl, phenyl and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$, wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different colour as one associated with a different film layer. It may also be useful that the coupler moiety included in the developer inhibitor-releasing coupler forms colourless products and/or products that wash out of the photographic material during processing (so-called "universal" couplers).

As mentioned, the developer inhibitor-releasing coupler may include a timing group, which produces the time-delayed release of the inhibitor group, such as groups using an intramolecular nucleophilic substitution reaction (U.S. Pat. No. 4,248,962); groups utilizing an electron transfer reaction along a conjugated system (U.S. Pat. Nos.4,409,323, 4,421,845 and 4,861,701 and Japanese Applications 57-188035; 58-98728; 58-209736; 58-209738); groups utilizing ester hydrolysis (German Patent Application (OLS) No. 2,626,315); groups that function as a coupler or reducing agent after the coupler reaction (U.S. Pat. Nos.4,438,193 and 4,618,571) and groups that combine the features described above. It is typical that the timing group is of one of the formulae:

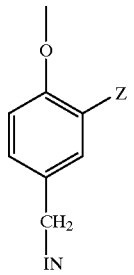

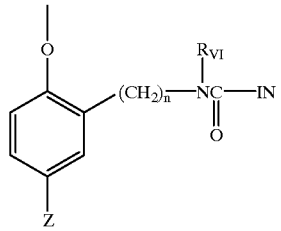

wherein IN is the inhibitor moiety, Z is selected from the group consisting of nitro, cyano, alkylsulfonyl; sulfamoyl ($—SO_2NR_2$) and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers that may be included in photographic light sensitive emulsion layer include, but are not limited to, the following:

D1

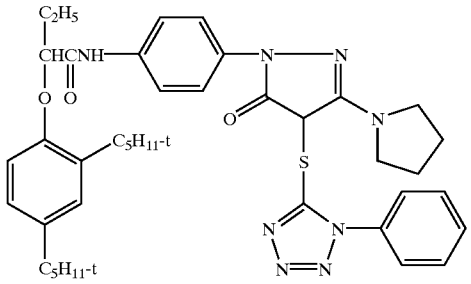

D2

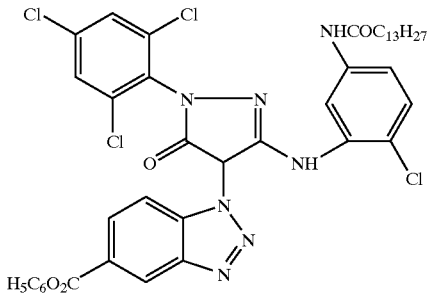

-continued

D3

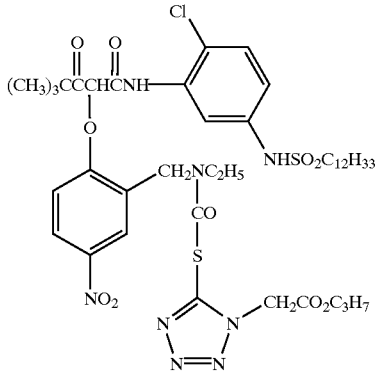

D4

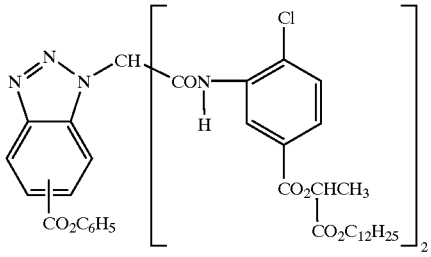

D5

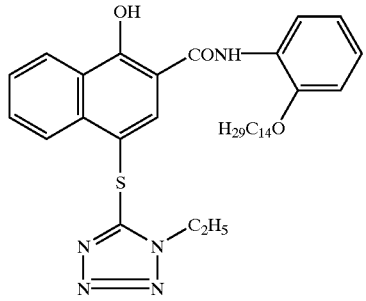

D6

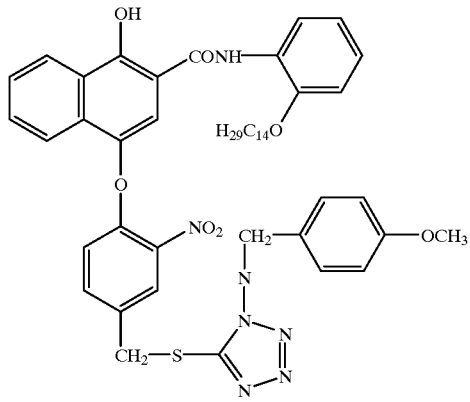

D7
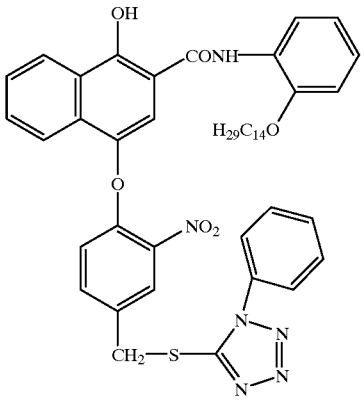
D8
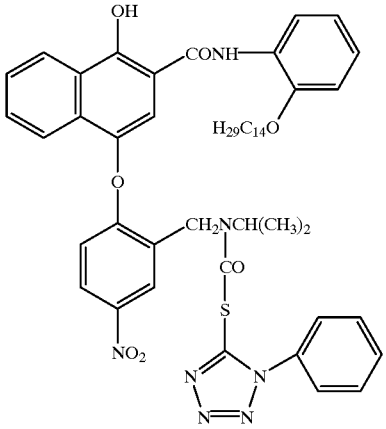
D9
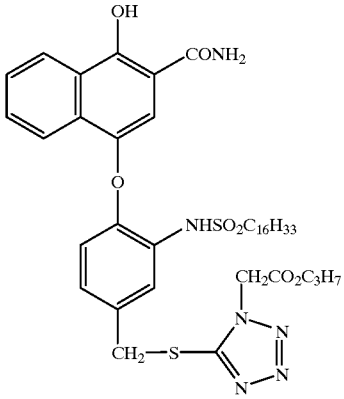
D10
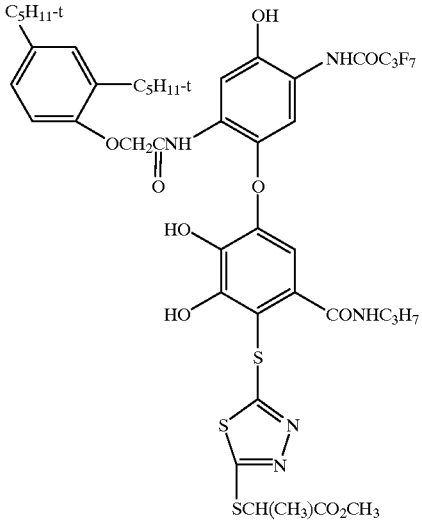
D11
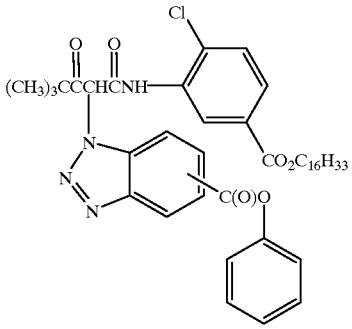
D12
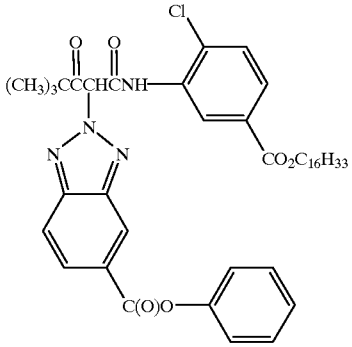

It is also contemplated that the concepts of the present invention may be employed to obtain reflection colour prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. Nos. 4,346,165, 4,540,653 and 4,906,559 for example); with ballasted chelating agents such as those in U.S. Pat. No. 4,994,359 to reduce sensitivity to polyvalent cations such as calcium and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072, 634; 90-077,822; 90-078,229; 90-078,230; 90-079,336; 90-079,337; 90-079,338; 90-079,690; 90-079,691; 90-080, 487; 90-080,488; 90-080,489; 90-080,490; 90-080,491; 90-080,492; 90-080,494; 90-085,928; 90-086,669; 90-086, 670; 90-087,360; 90-087,361; 90-087,362; 90-087,363; 90-087,364; 90-088,097; 90-093,662; 90-093,663; 90-093, 664; 90-093,665; 90-093,666; 90-093,668; 90-094,055; 90-094,056; 90-103,409; 83-62,586 and 83-09,959.

Any silver halide combination can be used for the photographic element, such as silver chloride, silver chlorobromide, silver chlorobromoiodide, silver bromide, silver bromoiodide or silver chloroiodide. In cases where the emulsion composition is a mixed halide, the minor component may be added in the crystal formation or after formation as part of the sensitization or melting. The shape of the silver halide emulsion grain can be cubic, pseudo-cubic, octahedral, tetradecahedral or tabular. The emulsions may be precipitated in any suitable environment such as a ripening environment, a reducing environment or an oxidizing environment.

Specific references relating to the preparation of emulsions of differing halide ratios and morphologies are Evans U.S. Pat. No. 3,618,622; Atwell U.S. Pat. No. 4,269,927; Wey U.S. Pat. No. 4,414,306; Maskasky U.S. Pat. No. 4,400,463, Maskasky U.S. Pat. No. 4,713,323; Tufano et al U.S. Pat. No. 4,804,621; Takada et at U.S. Pat. No. 4,738, 398; Nishikawa et at U.S. Pat. No. 4,952,491; Ishiguro et al U.S. Pat. No. 4,493,508, Hasebe et al U.S. Pat. No. 4,820, 624; Maskasky U.S. Pat. No. 5,264,337 and 5,275,930; House et al U.S. Pat. No. 5,320,938 and Chen et al U.S. Pat. No. 5,550,013, Edwards et al U.S. Ser. No. 08/362,283 filed on Dec. 22, 1994; U.S. Pat. No. 08/649,391 and U.S. Pat. No. 08/651,193 filed on May 17, 1996.

Emulsion precipitation is conducted in the presence of silver ions, halide ions and in an aqueous dispersing medium including, at least during grain growth, a peptizer. Grain structure and properties can be selected by control of precipitation temperatures, pH and the relative proportions of silver and halide ions in the dispersing medium. To avoid fog, precipitation is customarily conducted on the halide side of the equivalence point (the point at which silver and halide ion activities are equal). Manipulations of these basic parameters are illustrated by the citations including emulsion precipitation descriptions and are further illustrated by Matsuzaka et at U.S. Pat. No. 4,497,895, Yagi et at U.S. Pat. No. 4,728,603, Sugimoto U.S. Pat. No. 4,755,456, Kishita et al U.S. Pat. No. 4,847,190, Joly et al U.S. Pat. No. 5,017, 468, Wu U.S. Pat. No. 5,166,045, Shibayama et al EPO 0 328 042 and Kawai EPO 0 531 799.

Reducing agents present in the dispersing medium during precipitation can be employed to increase the sensitivity of the grains, as illustrated by Takada et at U.S. Pat. No. 5,061,614, Takada U.S. Pat. No. 5,079,138 and EPO 0 434 012, Inoue U.S. Pat. No. 5,185,241, Yamashita et at EPO 0 369 491, Ohashi et at EPO 0 371 338, Katsumi EPO 435 270 and 0 435 355 and Shibayama EPO 0 438 791. Conversely, oxidizing agents may be present during precipitation, used as a pretreatment of the dispersing medium (gelatin) or added to the emulsion after grain formation before or during sensitization, in order to improve the sensitivity/fog position of the silver halide emulsion or minimize residual ripening agent, as illustrated by Komatsu et at JP 56-167393 and JP 59-195232, Mifune et al EPA 144 990 and EP-A -0 166 347. Chemically sensitized core grains can serve as hosts for the precipitation of shells, as illustrated by Porter et al U.S. Pat. Nos. 3,206,313 and 3,327,322, Evans U.S. Pat. No. 3,761, 276, Atwell et al U.S. Pat. No. 4,035,185 and Evans et al U.S. Pat. No. 4,504,570.

Dopants (any grain occlusions other than silver and halide ions) can be employed to modify grain structure and properties. Periods 3–7 ions, including Group VIII metal ions (Fe, Co, Ni and platinum metals (pm) Ru, Rh, Pd, Re, Os, Ir and Pt), Mg, Al, Ca, Sc, Ti, V, Cr, Mn, Cu Zn, Ga, As, Se, Sr, Y, Mo, Zr, Nb, Cd, In, Sn, Sb, Ba, La, W, Au, Hg, Tl, Pb, Bi, Ce and U can be introduced during precipitation. The dopants can be employed (a) to increase the sensitivity of either (a1) direct positive-or (a2) negative-working emulsions, (b) to reduce (b1) high or (b2) low intensity reciprocity failure, (c) to (c1) increase, (c2) decrease or (c3) reduce the variation of contrast, (d) to reduce pressure sensitivity, (e) to decrease dye desensitization, (f) to increase stability, (g) to reduce minimum density, (h) to increase maximum density, (i) to improve room light handling and () to enhance latent image formation in response to shorter wavelength (e.g. X-ray or gamma radiation) exposures. For some uses any polyvalent metal ion (pvmi) is effective. The selection of the host grain and the dopant, including its concentration and, for some uses, its location within the host grain and/or its valence can be varied to achieve aim photographic properties, as illustrated by B. H. Carroll, "Iridium Sensitization: A Literature Review", *Photographic Science and Engineering,* Vol. 24, No. 6 Nov./Dec. 1980, pp. 265–267.

Dopants can be added in conjunction with addenda, antifoggants, dye and stabilizers either during precipitation of the grains or post precipitation, possibly with halide ion addition. These methods may result in dopant deposits near or in a slightly subsurface fashion, possibly with modified emulsion effects, as illustrated by Ihama et al U.S. Pat. No. 4,693,965; Shiba et al U.S. Pat. No. 3,790,390; Habu et al U.S. Pat. No. 4,147,542; Hasebe et al EPO 0 273 430 Ohshima et al EPO 0 312 999 and Ogawa U.S. Statutory Invention Registration H760.

Desensitizing, contrast increasing or reciprocity failure reducing ions or complexes are typically dopants which function to trap photogenerated holes or electrons by introducing additional energy levels deep within the bandgap of the host material. Examples include, but are not limited to, simple salts and complexes of Groups 8–10 transition metals (e.g. rhodium, iridium, cobalt, ruthenium, and osmium) and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2IrCl_6$, $K_3IrCl_6$, $K_2IrBr_6$, $K_2IrBr_6$, $K_2RuCl_6$, $K_2Ru(NO)Br_5$, $K_2Ru(NS)Br_5$, $K_2OsCl_6$, $Cs_2Os(NO)Cl_5$ and $K_2Os(NS)Cl_5$. Amine, oxalate, and organic ligand complexes or ions of these or other metals as disclosed in Olm et al U.S. Pat. Nos. 5,360,712 and 5,457,021 and in Kuromoto et al U.S. Pat. No. 5,462,849 are also contemplated. Specific examples include $[IrCl_4(ethylenediamine)_2]^{-1}$, $[IrCl_4(CH_3SCH_2CH_2SCH_3)]^{-1}$, $[IrCl_5(pyrazine)]^{-2}$, $[IrCl_5(chloropyrazine)]^{-2}$, $[IrCl_5(N\text{-}methylpyrazinium)]^{-1}$, $[IrCl_5(pyrimidine)]^{-2}$, $[IrCl_5(pyridine)]^{-2}$, $[IrCl_4(pyridine)_2]^{-1}$, $[IrCl_4(oxalate)_2]^{-3}$, $[IrCl_5(thiazole)]^{-2}$, $[IrCl_4(thiazole)_2]^{1-1}$, $[IrCl_4(2\text{-}bromothiazole)_2]^{-1}$, $[IrCl_5(5\text{-}methylthiazole)]^{-2}$, $[IrBr_5(thiazole)])^{-2}$ and $[IrBr_4(thiazole)_2]^{-1}$.

In a specific, preferred form it is contemplated to employ as a dopant a hexacoordination complex satisfying the formula: $[ML_6]^n$ where M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$, $Pt^{+4}$; $L_6$ represents six coordination complex ligands which can be independently selected, provided that least four of the ligands are anionic ligands and at least one (preferably at least 3 and optimally at least 4) of the ligands is more electro-negative than any halide ligand and n is −2, −3 or −4.

The following are specific illustrations of dopants capable of providing shallow electron traps:

| | | | |
|---|---|---|---|
| $[Fe(CN)_6]^{-4}$ | SET-1 | $[Ru(CN)_6]^{-4}$ | SET-2 |
| $[Os(CN)_6]^{-4}$ | SET-3 | $[Rh(CN)_6]^{-3}$ | SET-4 |
| $[Ir(CN)_6]^{-3}$ | SET-5 | $[Fe(pyrazine)(CN)_5]^{-4}$ | SET-6 |
| $[RuCl(CN)_5]^{-4}$ | SET-7 | $[OsBr(CN)_5]^{-4}$ | SET-8 |
| $[RhF(CN)_5]^{-3}$ | SET-9 | $[IrBr(CN)_5]^{-3}$ | SET-10 |
| $[FeCO(CN)_5]^{-3}$ | SET-11 | $[RuF_2(CN)_4]^{-4}$ | SET-12 |
| $[OsCl_2(CN)_4]^{-4}$ | SET-13 | $[RhI_2(CN)_4]^{-3}$ | SET-14 |
| $[IrBr_2(CN_4]^{-3}$ | SET-15 | $[Ru(CN)_5(OCN)]^{-4}$ | SET-16 |
| $[Ru(CN)_5(N_3)]^{-4}$ | SET-17 | $[Os(CN)_5(SCN)]^{-4}$ | SET-18 |
| $[Rh(CN)_5(SeCN)]^{-3}$ | SET-19 | $[Ir(CN)_5(HOH)]^{-2}$ | SET-20 |
| $[Fe(CN)_3Cl_3]^{-3}$ | SET-21 | $[Ru(CO)_2(CN)_{4]}^{-1}$ | SET-22 |
| $[Os(CN)Cl_5]^{-4}$ | SET-23 | $[Co(CN)_6]^{-3}$ | SET-24 |
| $[Ir(NCS)_6]^{-3}$ | SET-25 | $[In(NCS)_6]^{-3}$ | SET-26 |
| $[Ga(NCS)_6]^{-3}$ | SET-27 | | |

It is additionally contemplated to employ oligomeric coordination complexes to increase speed, as taught by Evans et al U.S. Pat. No. 5,024,931, the disclosure of which is here incorporated by reference.

The dopants are effective in conventional concentrations, where concentrations are based on the total silver, including both the silver in the grains and the silver in epitaxial protrusions. Generally shallow electron trap forming dopants are contemplated to be incorporated in concentrations of at least $1\times10^{-8}$ mole per silver mole up to their solubility limit, typically up to about $10^{-3}$ mole per silver mole. Preferred concentrations are in the range of from about $10^{-6}$ to $10^{-4}$ mole per silver mole. When used in the presence of other deep electron trapping dopants, such as $Cs_2Os(NO)Cl_5$, preferred concentrations of shallow electron traps may approach $10^{-8}$ to $10^{-7}$ mole per silver mole. Combinations of deep and shallow electron trapping dopants may be used to increase contrast as taught by MacIntyre and Bell in U.S. Pat. No. 5,597,686 and by Bell in U.S. Pat. Nos. 5,252,451, 5,256,530, 5,385,817, 5,474,888, 5,480,771 and 5,500,335. It is, of course, possible to distribute the dopant so that a portion of it is incorporated in grains and the remainder is incorporated in the silver halide epitaxial protrusions.

Emulsion addenda that adsorb to grain surfaces, such as antifoggants, stabilizers and dyes can also be added to the emulsions during precipitation. Precipitation in the presence of spectral sensitizing dyes is illustrated by Locker U.S. Pat. No. 4,183,756, Locker et al U.S. Pat. No. 4,225,666, Ihama et al U.S. Pat. Nos. 4,683,193 and 4,828,972, Takagi et al U.S. Pat. No. 4,912,017, Ishiguro et al U.S. Pat. No. 4,983,508, Nakayama et al U.S. Pat. No. 4,996,140, Steiger U.S. Pat. No. 5,077,190, Brugger et al U.S. Pat. No. 5,141,845, Metoki et al U.S. Pat. No. 5,153,116, Asami et al EP 287,100 and Tadaaki et al EP 301,508. Non-dye addenda are illustrated by Klotzer et al U.S. Pat. 4,705,747, Ogi et al U.S. Pat. No. 4,868,102, Ohya et al U.S. Pat. No. 5,015,563, Bahnmuller et al U.S. Pat. No. 5,045,444, Maeka et al U.S. Pat. No. 5,070,008 and Vandenabeele et al EP 392,092. Water soluble disulfides are illustrated by Budz et al U.S. Pat. No. 5,418,127.

Chemical sensitization of the materials in this photographic element is accomplished by any of a variety of known chemical sensitizers. The emulsions described herein may or may not have other addenda such as sensitizing dyes, supersensitizers, emulsion ripeners, gelatin or halide conversion restrainers present before, during or after the addition of chemical sensitization.

The use of sulfur, sulfur plus gold or gold only sensitizations are very effective sensitizers. Typical gold sensitizers are chloroaurates, aurous dithiosulfate, aqueous colloidal gold sulfide or aurous bis(1,4,5-trimethyl-1,2,4-triazolium-3-thiolate) tetrafluoroborate (e.g. U.S. Pat. No. 5,049,485). Sulfur sensitizers may include thiosulfate, thiocyanate, N,N'-carbothioyl-bis(N-methyl-glycine) or 1,3-dicarboxymethyl-1,3-dimethyl-2-thiourea sodium salt.

The addition of one or more antifoggants as stain reducing agents is also common in silver halide systems. Tetrazaindenes, such as 4-hydroxy-6-methyl-(1,3,3a,7)-tetrazaindene, are commonly used as stabilizers. Also useful are mercaptotetrazoles such as 1-phenyl-5-mercaptotetrazole or acetamido-1-phenyl-5-mercaptotetrazole. Arylthiosulfonates, such as tolylthiosulfonate (optionally used with arylsulfinates such as tolylsulfinate) or esters thereof are especially useful (e.g. U.S. Pat. No. 4,960,689). The use of water-soluble disulfides is illustrated in U.S. Pat. No. 08/729,127 filed Oct. 11, 1996.

Tabular grain silver halide emulsions may be used in the present invention. Specifically contemplated tabular grain emulsions are those in which greater than 50 percent of the total projected area of the emulsion grains are accounted for by tabular grains having a thickness of less than 0.3 micrometers (0.5 micrometers for blue sensitive emulsion) and an average tabularity (T) of greater than 25 (preferably greater than 100), where the term "tabularity" is employed in its art recognized usage as $$T=ECD/t^2$$

wherein

ECD is the average equivalent circular diameter of the tabular grains in micrometers and t is the average thickness in micrometers of the tabular grains.

The average useful ECD of photographic emulsions can range up to about 10 micrometers, although in practice emulsion ECDs seldom exceed about 4 micrometers. Since both photographic speed and granularity increase with increasing ECDs, it is generally preferred to employ the smallest tabular grain ECDs compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. 4,672,027 reports a 3 mole percent iodide tabular grain silver bromoiodide emulsion having a grain thickness of 0.017 micrometer. Ultrathin tabular grain high chloride emulsions are disclosed by Maskasky in U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e. emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a colour developing agent to reduce developable silver halide and oxidize the colour developing agent. Oxidized colour developing agent in turn reacts with the coupler to yield a dye.

With negative-working silver halide, the processing step described above provides a negative image. The described elements can be processed in the known Kodak C-41™ colour process as described in The British Journal of Photography Annual of 1988, pp 191–198. Where applicable, the element may be processed in accordance with colour print processes such as the RA-4™ process of Eastman Kodak Company as described in the British Journal of Photography Annual of 1988, pp 198–199. Such negative working emulsions are typically sold with instructions to process using a colour negative method such as the C-41υ or RA-4™ process. To provide a positive (or reversal) image, the colour development step can be preceded by development with a non-chromogenic developing agent to develop exposed silver halide, but not form dye, and followed by uniformly fogging the element to render unexposed silver halide developable. Such reversal emulsions are typically sold with instructions to process using a colour reversal process such as E-6™. Alternatively, a direct positive emulsion can be employed to obtain a positive image.

The multicolour photographic elements of the invention may be processed alternatively in a developer solution that will provide reduced processing times of one minute or less (dry to dry), and particularly reduced colour development times of less than about 25 seconds, such that all colour records are fully developed with aim sensitometry.

Preferred colour developing agents are p-phenylenediamines such as:

4-amino-N,N-diethylaniline hydrochloride,
4-amino-3-methyl-N,N-diethylaniline hydrochloride,
4-amino-3-methyl-N-ethyl-N-(2-methanesulfonamidoethyl) aniline sesquisulfate hydrate,
4-amino-3-methyl-N-ethyl-N-(2-hydroxyethyl)aniline sulfate,
4-amino-3-(2-methanesulfonamidoethyl)-N,N-diethylaniline hydrochloride and
4-amino-N-ethyl-N-(2-methoxyethyl)-m-toluidine di-p-toluene sulfonic acid.

Development is usually followed by the conventional steps of bleaching, fixing or bleach-fixing, to remove silver or silver halide, washing and drying.

The coupler dispersions may be coated with emulsions to form photographic elements at very low levels of silver (less than 100 mg/m$^2$). Reasons for doing this include reducing cost, reducing the thickness of silver halide emulsion layers to gain sharpness advantages and reducing the environmental impact during and after processing.

One class of low silver photographic material is colour material intended for redox amplification processes wherein the developed silver acts as a catalyst to the formation of the dye image. This process can take place in a low volume thin processor, such as a low volume thin tank (LVTT), for example, as disclosed in U.S. Pat. No. 5,436,118. Redox amplification processes have been described for example in GB 1,268,126, GB 1,399,481, GB 1,403,418, GB 1,560,572, U.S. Pat. Nos. 3,748,138, 3,822,129 and 4,097,278. In such processes, colour materials are developed to produce a silver image (which may contain only small amounts of silver) and are then treated with a redox amplifying solution (or a combined developer-amplifier) to form a dye image.

The following examples illustrate the invention but are in no way to be construed as being limiting thereof.

EXAMPLES

Preparative Examples

Example 1. Synthesis of ST-1

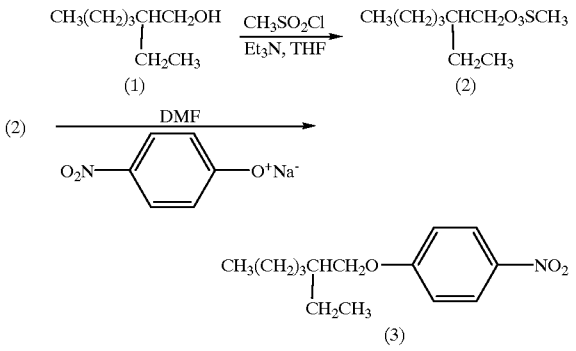

-continued

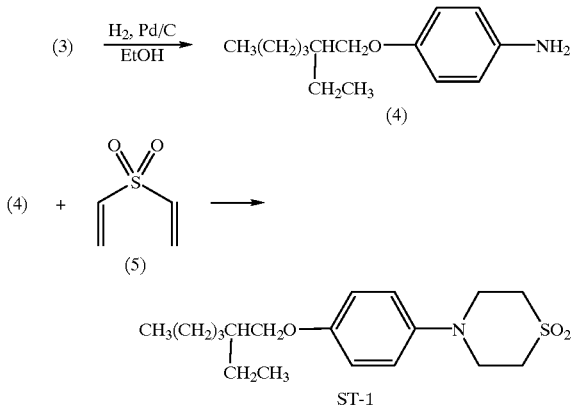

2-ethylhexanol ((1) 236.6 g, 1.82 mol) in 800 ml tetrahydrofuran (THF) was mixed with methanesulfonylchloride (250 g, 2.18 mol). The solution was cooled to 20 C. in an ice/acetone bath. Triethylamine (220.6 g, 2.18 mol) was then added dropwise maintaining the temperature between 25 and 29 C. The reaction mixture was then stirred at room temperature overnight. The triethylamine hydrochloride was removed by filtration and the resulting THF solution of the mesylate (2 ) was concentrated to a pale yellow oil which was used as such for the next step.

A mixture of the sodium salt of p-nitrophenol (39.5 g, 0.2 mol), the mesylate ((2), 54.0 g, 0.2 mol) and dimethylformamide (DMF) (160 ml) was heated for 2 days at 94 C. The mixture was then poured into a beaker containing ice and water. The resulting oil was taken up in ether, washed with water and saturated sodium chloride solution, dried over sodium sulphate and concentrated to yield a red/orange oil. The crude product was passed through a plug of silica gel, eluting with dichloromethane. Upon concentration the product was obtained as a pale yellow oil (3). This material(15.0 g,0.06 mol) was subjected to hydrogenation in a Parr apparatus (ethanol, 200 ml, palladium on charcoal, 1 g). After hydrogen uptake ceased, the solution was filtered and to the filtrate was added divinyl sulfone ((5), 7.7 g, 0.065 mol). The reaction mixture was heated at reflux overnight and concentrated to get a viscous oil. Upon trituration with hexane, a crystalline solid (ST-1) was obtained which was further purified by recrystallisation from ethanol.

These compounds of formula (I) are known in the art (primarily for use as magenta stabilizers as discussed above), and may generally be formed, e.g., as disclosed in the following referenced U.S. Pat. Nos. 5,017,465, 5,082,766, 5,236,819, 5,484,696, 5,491,054, and 5,561,037.

The solvents of formula (II) and the UV absorbers used in this invention were all available either commercially or prepared using standard methods.

The synthesis of the cyan dye-forming couplers is well described in the literature, for example as described in U.S. Pat. No. 6,004,738 and EP-A-1 037 103.

Example 2. Solubility Effects of Stabilizer (I).

0.2 g samples of each coupler (or coupler blend) were placed in test tubes with 0.1 g of solvent and the required level of stabilizer was also added. To each test tube a small magnetic stirrer bar was placed, then the test tubes were suspended within clear silicone oil which was stirred in a large, transparent heating bath. This was heated using controlled heating and stirring. The temperature in C. at which dissolution of solid material took place in each test tube was noted and is recorded in TABLE 1 below.

TABLE 1

| Mixture Content | Ratio (by wt) | BC-3 Temp. (C.) | AC-35 Temp. (C.) | BC-3 + AC-35 (0.5:0.5) Temp. (C.) |
|---|---|---|---|---|
| Coupler + S-1 | 1:0.5 | 115 | 142 | 134 |
| Coupler + S-1 + UV-1 | 1:0.5:1 | 104 | 130 | 132 |
| Coupler + S-1 + UV-1 + ST-1 | 1:0.5:0.5:0.5 | 101 | 121 | 115 |
| Coupler + S-1 + ST-1 | 1:0.5:1 | 111 | 113 | 113 |

It can be seen that although the UV absorber lowered the liquidus temperature of the coupler solution, addition of the stabilizer ST-1, lowered this temperature even further.

Example 3. Determination of 'NB' Coupler

The procedure described in EP-A-1 037 103 can be used to establish whether a particular coupler falls within the definition of an 'NB coupler' which can be used with advantage in the present invention.

PHOTOGRAPHIC EXAMPLES

Dispersion Examples

Example 4

The coupler solutions were prepared by heating to 140 C. mixtures of a coupler of formula (III), a coupler of formula (IV), a solvent, a UV absorber of formula (V) and a stabilizer of formula (I) in the combinations, which when coated would give the laydowns shown in the tables below. Gelatin solutions made from decalcified gelatin in demineralised water and a 10% solution of surfactant Alkanol XC™ were heated at 80 C.

In each case the coupler and gelatin solutions were combined and mixed for 4 min at 10000 rpm using a Polytron (a rotor stator device manufactured by Kinematica instruments, Switzerland). The mixture was then homogenised by passing it once through an M-110F Microfluidizer (manufactured by Microfluidics Corp.) at 55C. and 62,046 kPa (9000 psi) pressure. Each dispersion was placed in cold storage until ready for coating.

A light sensitive photographic multilayer coating was made to the following format shown in TABLE 2 below. The cyan dye forming dispersions were incorporated in layer 5 at the laydowns shown in the TABLE 3. Materials other than those of the invention which were used in the comparative dispersions or in the preparation of the photographic elements are shown below.

Coupler MC-1

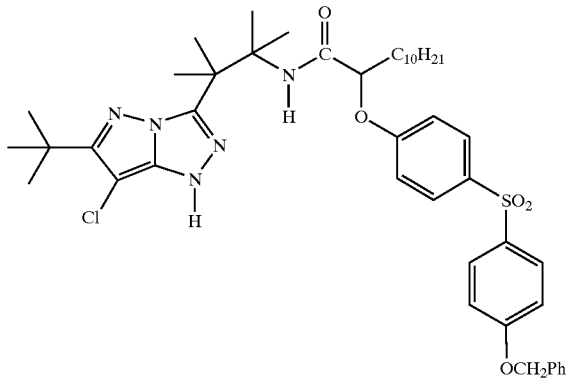

-continued

Coupler YC-1

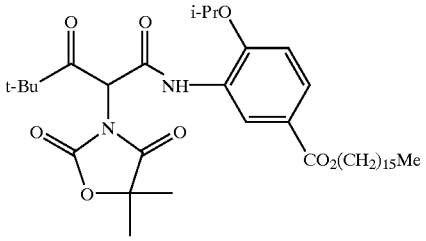

Solvent A $CH_3(CH_2)_7CH{=}CH(CH_2)_8OH$

Solvent B

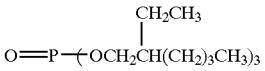

Solvent C

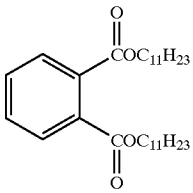

Solvent D

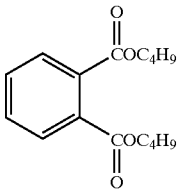

Solvent E

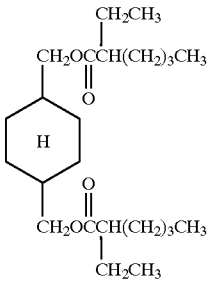

Stain prevention agent G

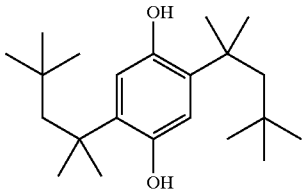

Fade prevention agent H

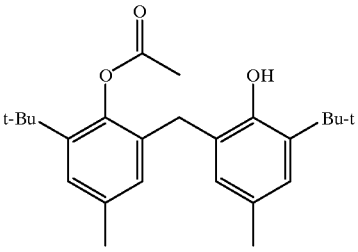

-continued

Fade prevention agent I

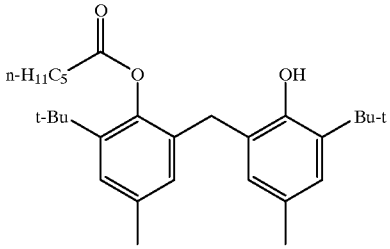

Hardener K

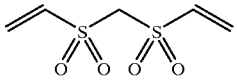

TABLE 2

Structure of Photographic Element

| Layer | Component | Coverage |
|---|---|---|
| Layer 7 | Gelatin | 0.57 g/m$^2$ |
| Layer 6 (UV light absorbing layer) | Gelatin | 0.51 g/m$^2$ |
| | UV light absorbing agents: (UV-1:UV-7 1:0.18) | 0.15 g/m$^2$ |
| | Stain prevention agent, G | 38.38 mg/m$^2$ |
| | Solvents for UV absorbing agents: (D:E, 1:1) | 50.93 mg/m$^2$ |
| Layer 5 (Red-sensitive layer) | Gelatin | 1.36 g/m$^2$ |
| | Silver Chloride emulsion | 0.19 g Ag/m$^2$ |
| | Coupler(s) | See Tables below |
| | Stabilizer(s) for cyan coupler(s) | See Tables below |
| | Solvent for cyan coupler(s) | See Tables below |
| | Hardener, K | 0.18 g/m$^2$ |
| Layer 4 (UV light absorbing layer) | Gelatin | 0.74 g/m$^2$ |
| | UV light absorbing agents: (UV-1:UV-7, 1:0.18) | 0.22 g/m$^2$ |
| | Stain prevention agent, G | 55.50 mg/m$^2$ |
| | Solvent for UV absorbing agents: (D:E, 1:1) | 73.66 mg/m$^2$ |
| Layer 3 (green-sensitive layer) | Gelatin | 1.73 g/m$^2$ |
| | Silver chloride emulsion | 0.12 g/m$^2$ |
| | Magenta coupler, MC-1 | 0.30 g/m$^2$ |
| | Fade prevention agents: (ST-2: ST-1, 1.9:0.3) | 0.64 g/m$^2$ |
| | Solvents for magenta coupler: (A:C, 0.35:0.67) | 0.31 g/m$^2$ |
| Layer 2 (colour stain preventing layer) | Gelatin | 0.75 g/m$^2$ |
| | Stain prevention agent, G | 65.91 mg/m$^2$ |
| | Solvent for stain prevention agent, D | 0.19 g/m$^2$ |
| Layer 1 (blue-sensitive layer) | Gelatin | 1.19 g/m$^2$ |
| | Silver chloride emulsion | 0.28 g/m$^2$ |
| | Yellow coupler, YC-1 | 0.65 g/m$^2$ |
| | Fade prevention agents: (H:I, 0.17:0.06) | 0.15 g/m$^2$ |
| | Solvent for yellow coupler, C | 0.28 g/m$^2$ |
| Support | Gelatin over polyethylene laminated paper base | 0.30 g/m$^2$ |

Preparation of Processed Photographic Examples

Processed samples were prepared by exposing the coatings through a step tablet (density range 0–3, 0.15 inc.) and developed for 0.s and processed through a Kodak Process RA-4™ as follows.

| Process Step | Time min. | Temp. (C) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts/litre solution):

| Developer | |
|---|---|
| Triethanolamine | 12.41 g |
| Blankophor REU ™ | 2.30 g |
| Lithium polystyrene sulfonate | 0.09 g |
| N,N-Diethylhydroxylamine | 4.59 g |
| Lithium sulfate | 2.70 g |
| Developing agent, Dev-1 | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7 C. | |
| **Bleach-Fix** | |
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetraacetate | 48.58 g |
| Ethylenediaminetetraacetic acid | 3.86 g |
| pH adjusted to 6.7 at 26.7 C. | |

Dev-1

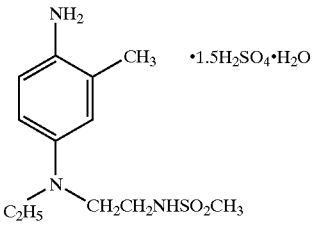

The Status A red densities of the processed strips were read and sensitometric curves (density vs. log exposure (D logE)) were generated. The contrast (γ) was measured by calculating the slope of the D logE plot over the range of 0.6 logE centred on the exposure yielding 1.0 density.

The reflectance spectra of the image dyes were also measured and normalised to a maximum absorption of 1.00. From these spectra the wavelength at the midpoint position of the waveband envelope was recorded as $\lambda_{mid}$. This was measured at the central point of the width of the main absorption band in the visible region of the spectrum at the normalised density of 0.5. A measure of unwanted green absorption from the cyan dye is the density at 530 nm ($D_{530}$) in the normalised spectra. A lower value indicated less unwanted green absorption, which was preferable. However, if $\lambda_{mid}$ values were more than 10 nm below the value of the commercial example (represented by element 101) and with a $D_{530}$ value greater than that of element 101, they were unacceptable. The values for $\lambda_{mid}$, and density at 530 nm ($D_{530}$) are shown in TABLE 3.

The light stability of the image dyes was tested by exposing the processed strips to the light from a Xenon arc lamp at an intensity of 50 klx for four weeks. The fade from the initial density of 1.00 was reported as a percentage under the column heading "Light fade" in TABLE 3. Any values greater than that of the commercial example (represented by element 101) were undesirable.

The dark stability of the image dyes was tested by maintaining the processed strips for 12 weeks at a temperature of 75 C. and 50% relative humidity. The fade from the initial density of 1.00 is reported as a percentage and values less than half that of the commercial example (represented by element 101) were desirable.

The data in TABLE 3 show that although it is possible to gain good gamma (contrast) by combining two types of coupler with one of the stabilizers, light stability is poor when compared with the element 101 check used in commercial materials. Also the choice of solvent is crucial for good light stability as shown by the much lower level of dye light fade in Element 108, this was unexpected and when considered with the high gamma value suggests that coupler laydowns can be reduced significantly. It is the combination of coupler types, UV absorber V with stabilizer I, an aliphatic ester solvent, such as S-2 which provides the superior light stability without compromising gamma (contrast) or dark stability.

TABLE 3

| Element | Coupler III & laydown ($g/m^2$) | Coupler IV & laydown ($g/m^2$) | Solvent II & laydown ($g/m^2$) | UV abs. V & laydown ($g/m^2$) | Stabilizer I & laydown ($g/m^2$) | λmid (nm) | $D_{530}$ | γ | % Light Fade | % Dark Fade | Comment |
|---|---|---|---|---|---|---|---|---|---|---|---|
| 101 | — | BC-3 0.423 | D 0.415 | UV-1 0.272 | — | 658.0 | 0.22 | 2.69 | −24 | −27 | Comp. |
| 102 | AC-70 0.323 | BC-3 0.199 | A 0.603 | — | ST-1 0.603 | 653.5 | 0.24 | 3.77 | −32 | −10 | Comp. |
| 103 | AC-70 0.323 | BC-3 0.199 | A 0.603 | — | ST-2 0.603 | 656.5 | 0.23 | 3.43 | −31 | −8 | Comp. |
| 104 | AC-70 0.323 | BC-3 0.199 | A 0.603 | UV-1 0.603 | — | 650.7 | 0.25 | 3.33 | −29 | −9 | Comp. |
| 105 | AC-41 0.302 | BC-3 0.199 | A 0.603 | UV-1 0.389 | — | 652.3 | 0.25 | 3.52 | −30 | −14 | Comp. |
| 106 | AC-41 0.302 | BC-3 0.199 | A 0.603 | UV-1 0.389 | ST-1 0.603 | 652.3 | 0.25 | 3.68 | −29 | −3 | Comp. |
| 107 | AC-41 0.302 | BC-3 0.199 | A 0.603 | UV-1 0.389 | ST-2 0.603 | 655.6 | 0.24 | 3.77 | −27 | −9 | Comp. |
| 108 | AC-41 0.302 | BC-3 0.199 | S-2 0.603 | UV-1 0.389 | ST-2 0.603 | 655.6 | 0.24 | 3.69 | −19 | −2 | Inv. |

Example 5

In this example there are more comparisons with other solvents to illustrate the effect that the aliphatic solvents have on gamma and dye stability when compared with other solvents. Lower coupler laydowns were used than in example 1 and coupler ratios and UV absorber laydowns were kept constant throughout. The comparisons were carried out using two different stabilizers—the data for ST-1 are shown in TABLE 5; the data for ST-2 are shown in TABLE 6.

The dispersions in this example were made in the same way as described in Example 4. They were coated in the format shown below in TABLE 4 at the layer 5 laydowns shown in TABLES 5 and 6. The coatings were exposed, processed and tested in the same way as in Example 4 and the results are shown in TABLES 5 and 6 below. In this example improvements in dye hue, gamma, and dye stability were looked for relative to a coating which contained the couplers, a solvent and UV absorber but did not have a stabilizer of formula (I).

TABLE 4

Structure of Photographic Element.

| Layer | Component | Coverage |
|---|---|---|
| Layer 7 | Gelatin | 0.65 g/m$^2$ |
| Layer 6 | Gelatin | 0.51 g/m$^2$ |
| (UV light absorbing layer) | UV light absorbing agents: (UV-1:UV-7 1:0.18) | 0.15 g/m$^2$ |
| | Stain prevention agent, G | 66.7 mg/m$^2$ |
| | Solvents for UV absorbing agents: (D:E, 1:1) | 73.8 mg/m$^2$ |
| Layer 5 | Gelatin | 1.36 g/m$^2$ |
| (Red-sensitive layer) | Silver Chloride emulsion | 0.17 g Ag/m$^2$ |
| | Coupler(s) | See Tables below |
| | Stabilizer(s) for cyan coupler(s) | See Tables below |
| | Solvent for cyan coupler(s) | See Tables below |
| | Hardener, K | 0.18 g/m$^2$ |
| Layer 4 | Gelatin | 0.74 g/m$^2$ |
| (UV light absorbing layer) | UV light absorbing agents: (UV-1:UV-7, 1:0.18) | 0.22 g/m$^2$ |
| | Stain prevention agent, G | 97.3 mg/m$^2$ |
| | Solvent for UV absorbing agents: (D:E, 1:1) | 73.8 mg/m$^2$ |
| Layer 3 | Gelatin | 1.42 g/m$^2$ |
| (green-sensitive layer) | Silver chloride emulsion | 0.12 g/m$^2$ |
| | Magenta coupler, MC-1 | 0.31 g/m$^2$ |
| | Fade prevention agents: (ST-2:ST-1, 1.9:0.3) | 0.68 g/m$^2$ |

TABLE 4-continued

Structure of Photographic Element.

| Layer | Component | Coverage |
|---|---|---|
| | Solvents for magenta coupler: (A:C, 0.35:0.67) | 0.32 g/m$^2$ |
| Layer 2 | Gelatin | 0.75 g/m$^2$ |
| (colour stain preventing layer) | Stain prevention agent, G | 107.6 mg/m$^2$ |
| | Solvent for stain prevention agent, D | 0.19 g/m$^2$ |
| Layer 1 | Gelatin | 1.31 g/m$^2$ |
| (blue-sensitive layer) | Silver chloride emulsion | 0 .27 g/m$^2$ |
| | Yellow coupler, YC-1 | 0.65 g/m$^2$ |
| | Fade prevention agents: (H:I, 0.17:0.06) | 0.15 g/m$^2$ |
| | Solvent for yellow coupler, C | 0.28 g/m$^2$ |
| Support | Gelatin over polyethylene laminated paper base | 0.30 g/m$^2$ |

The data in TABLE 5 show that stabilizer ST-1provides a small improvement in dark stability when compared with Element 109. However the use of solvents other than the aliphatic ester solvents of the invention can either diminish gamma or light stability (both are made worse in element 110 by solvent A) relative to Element 109. Only Solvent C in Element 112 shows an improvement in light fade compared with element 109 and a very small improvement in gamma; however, this improvement in gamma is dwarfed by the more significant improvements shown by the solvents of the invention.

TABLE 6 also illustrates the effect of different solvents on dye hue, gamma, and dye stability using a different stabilizer. As in TABLE 5, adding stabilizer ST-2 provides a small improvement in dark stability compared with Element 117. However, incorporating solvent A (Element 118) results in an improvement in gamma but no improvement in light stability. Solvent B provides a small improvement in light stability but only a tiny 0.01 improvement in gamma. The more significant improvements in light stability and gamma are provided by the solvents of the invention.

When compared with the UV-absorber-only comparison elements (109 and 117) the stabilizers of formula (I) are effective only when the aliphatic ester solvents of the invention are incorporated as well. In these cases they show a significant improvement in gamma and light stability as well as a desirable bathochromic shift in dye hue and a diminution of unwanted green absorption.

TABLE 5

| Element | Coupler III & laydown (g/m$^2$) | Coupler IV & laydown (g/m$^2$) | Solvent II & laydown (g/M$^2$) | UV abs. V & laydown (g/m$^2$) | Stabilizer I & laydown (g/m$^2$) | $\lambda_{mid}$ (nm) | $D_{530}$ | $\gamma$ | % Light Fade | % Dark Fade | Comm. |
|---|---|---|---|---|---|---|---|---|---|---|---|
| 109 | AC-70 0.165 | BC-3 0.110 | S-2 0.350 | UV-1 0.252 | — | 648.9 | 0.26 | 2.40 | −31 | −11 | Comp. |
| 110 | AC-70 0.165 | BC-3 0.110 | A 0.350 | UV-1 0.252 | ST-1 0.350 | 649.1 | 0.27 | 1.83 | −44 | −9 | Comp. |
| 111 | AC-70 0.165 | BC-3 0.110 | B 0.350 | UV-1 0.252 | ST-1 0.350 | 647.6 | 0.24 | 2.36 | −34 | −7 | Comp. |
| 112 | AC-70 0.165 | BC-3 0.110 | C 0.350 | UV-1 0.252 | ST-1 0.350 | 649.0 | 0.25 | 2.44 | −28 | −7 | Comp. |
| 113 | AC-70 | BC-3 | S-2 | UV-1 | ST-1 | 649.4 | 0.25 | 2.62 | −28 | −8 | Inv. |

TABLE 5-continued

| Element | Coupler III & laydown ($g/m^2$) | Coupler IV & laydown ($g/m^2$) | Solvent II & laydown ($g/M^2$) | UV abs. V & laydown ($g/m^2$) | Stabilizer I & laydown ($g/m^2$) | $\lambda_{mid}$ (nm) | $D_{530}$ | $\gamma$ | % Light Fade | % Dark Fade | Comm. |
|---|---|---|---|---|---|---|---|---|---|---|---|
| | 0.165 | 0.110 | 0.350 | 0.252 | 0.350 | | | | | | |
| 114 | AC-70 | BC-3 | S-3 | UV-1 | ST-1 | 651.2 | 0.24 | 2.53 | −29 | −9 | Inv. |
| | 0.165 | 0.110 | 0.350 | 0.252 | 0.350 | | | | | | |
| 115 | AC-70 | BC-3 | S-4 | UV-1 | ST-1 | 649.2 | 0.25 | 2.60 | −29 | −7 | Inv. |
| | 0.165 | 0.110 | 0.350 | 0.252 | 0.350 | | | | | | |
| 116 | AC-70 | BC-3 | S-5 | UV-1 | ST-1 | 650.8 | 0.23 | 2.56 | −28 | −7 | Inv. |
| | 0.165 | 0.110 | 0.350 | 0.252 | 0.350 | | | | | | |

TABLE 6

| Element | Coupler III & laydown ($g/m^2$) | Coupler IV & laydown ($g/m^2$) | Solvent III & laydown ($g/m^2$) | UV abs. V & laydown ($g/m^2$) | Stabilizer I & Laydown ($g/m^2$) | $\lambda_{mid}$ (nm) | $D_{530}$ | $\gamma$ | % Light Fade | % Dark Fade | Comm. |
|---|---|---|---|---|---|---|---|---|---|---|---|
| 117 | AC-70 | BC-3 | S-2 | UV-1 | — | 648.9 | 0.26 | 2.40 | −31 | −11 | Comp. |
| | 0.165 | 0.110 | 0.350 | 0.252 | | | | | | | |
| 118 | AC-70 | BC-3 | A | UV-1 | ST-2 | 652.9 | 0.24 | 3.13 | −31 | −7 | Comp. |
| | 0.165 | 0.110 | 0.350 | 0.252 | 0.350 | | | | | | |
| 119 | AC-70 | BC-3 | B | UV-1 | ST-2 | 649.4 | 0.25 | 2.41 | −28 | −6 | Comp. |
| | 0.165 | 0.110 | 0.350 | 0.252 | 0.350 | | | | | | |
| 120 | AC-70 | BC-3 | S-2 | UV-1 | ST-2 | 652.2 | 0.24 | 2.76 | −23 | −8 | Inv. |
| | 0.165 | 0.110 | 0.350 | 0.252 | 0.350 | | | | | | |
| 121 | AC-70 | BC-3 | S-3 | UV-1 | ST-2 | 654.2 | 0.23 | 2.66 | −26 | −8 | Inv. |
| | 0.165 | 0.110 | 0.350 | 0.252 | 0.350 | | | | | | |
| 122 | AC-70 | BC-3 | S-4 | UV-1 | ST-2 | 650.9 | 0.24 | 2.57 | −24 | −6 | Inv. |
| | 0.165 | 0.110 | 0.350 | 0.252 | 0.350 | | | | | | |
| 123 | AC-70 | BC-3 | S-5 | UV-1 | ST-2 | 653.1 | 0.24 | 2.70 | −24 | −6 | Inv. |
| | 0.165 | 0.110 | 0.350 | 0.252 | 0.350 | | | | | | |
| 124 | AC-70 | BC-3 | S-1 | UV-1 | ST-2 | 649.2 | 0.25 | 2.77 | −27 | −6 | Inv. |
| | 0.165 | 0.110 | 0.350 | 0.252 | 0.350 | | | | | | |
| 125 | AC-70 | BC-3 | S-6 | UV-1 | ST-2 | 649.4 | 0.25 | 2.78 | −26 | −5 | Inv. |
| | 0.165 | 0.110 | 0.350 | 0.252 | 0.350 | | | | | | |

Example 6

In this example there are more examples of the invention, where the blend of couplers III and IV in a formulation of the invention are compared with similar formulations, using the same solvents, but using either coupler III or coupler IV.

The dispersions in this example were made in the same way as described in Example 4. They were coated in the format shown below in Table 4 at the layer 5 laydowns shown in Table 7. The coatings were exposed, processed and tested in the same way as in Example 4 and the results are shown in Table 7 below. In this example improvements in gamma, and dye stability were looked for relative to a coating of the commercial example. Values of gamma lower than that of the commercial example represented by elements 126, 131 or 137 were deemed unacceptable. Any percentage of dye loss (light or dark) worse than that of the commercial example (elements 126, 131 and 137) was undesirable.

The data in TABLE 7 supports the findings from example 1, that the combination of the aliphatic ester solvent (II), UV absorber (V) and amine stabilizer (I) provides the best all round performance even where only one phenolic cyan coupler is used (as in elements 127 and in elements 146 to 149). Incorporating only the uv absorber, even with an aliphatic ester solvent (as in Elements 128, 133) results in worsened light stability. Comparison element 139 is a combination of couplers (an 'NB coupler' and coupler of formula (IV)) with aliphatic ester solvent and UV stabilizer which shows improvements in gamma, light stability and dark stability relative to the comparison example 137; however, adding an amine stabilizer of formula (I) , as in element 140, increases gamma substantially and shows further improvements in light and dark stability.

In the subsequent inventive elements (141 to 145) the total laydown of coupler is reduced still further, yet gamma and dye stability are still superior to the commercial check coating, 137. Comparison element 138 contains an 'NB coupler' combined with an aliphatic ester solvent and uv absorber but shows worse light stability than comparison element 137. However, addition of the amine stabilizer to this combination yields significant improvements in gamma, and dye stability (elements 146 to 149) even where coupler laydown has been reduced (in elements 147 to 149).

The invention has been described in detail with particular reference to certain preferred embodiments thereof, but it will be understood that variations and modifications can be effected within the spirit and scope of the invention.

TABLE 7

| Element | Coupler III & laydown (g/m$^2$) | Coupler IV & laydown (g/m$^2$) | Solvent II laydown (g/m$^2$) | UV abs. V & laydown (g/m$^2$) | Stabilizer I & Laydown (g/m$^2$) | □ | % Light Fade | % Dark Fade | Comm. |
|---|---|---|---|---|---|---|---|---|---|
| 126 | — | BC-3 0.423 | D 0.415 | UV-1 0.272 | — | 2.67 | −24 | −28 | Comp. |
| 127 | — | BC-3 0.350 | S-2 0.337 | UV-1 0.242 | ST-2 0.337 | 2.73 | −20 | −17 | Inv. |
| 128 | AC-70 0.175 | BC-3 0.175 | S-1 0.337 | UV-1 0.242 | — | 2.81 | −27 | −12 | Comp. |
| 129 | AC-70 0.175 | BC-3 0.175 | S-1 0.337 | UV-1 0.242 | ST-2 0.337 | 2.95 | −23 | −7 | Inv. |
| 130 | AC-70 0.175 | BC-3 0.175 | S-2 0.337 | UV-1 0.242 | ST-2 0.337 | 2.91 | −21 | −2 | Inv. |
| 131 | — | BC-3 0.423 | D 0.415 | UV-1 0.272 | — | — | — | −28 | Comp. |
| 132 | AC-41 0.165 | BC-3 0.110 | D 0.415 | — | — | 3.02 | −31 | −19 | Comp. |
| 133 | AC-41 0.165 | BC-3 0.110 | S-2 0.400 | UV-1 0.100 | — | 2.93 | −24 | −13 | Comp. |
| 134 | AC-41 0.165 | BC-3 0.110 | S-2 0.400 | UV-1 0.100 | ST-3 0.175 | 2.95 | −22 | −11 | Inv. |
| 135 | AC-41 0.165 | BC-3 0.110 | S-2 0.400 | UV-1 0.100 | ST-2 0.175 | 3.08 | −21 | −12 | Inv. |
| 136 | AC-41 0.165 | BC-3 0.110 | S-2 0.400 | UV-1 0.100 | ST-2 0.350 | 3.04 | −19 | −9 | Inv. |
| 137 | — | BC-3 0.423 | D 0.415 | UV-1 0.272 | — | 2.67 | −24 | −28 | Comp. |
| 138 | AC-7 0.350 | — | S-1 0.200 | UV-1 0.209 | — | 2.86 | −31 | −9 | Comp. |
| 139 | AC-7 0.175 | BC-3 0.175 | S-1 0.337 | UV-1 0.242 | — | 3.19 | −22 | −15 | Comp. |
| 140 | AC-7 0.175 | BC-3 0.175 | S-1 0.337 | UV-1 0.242 | ST-2 0.337 | 3.42 | −20 | −9 | Inv. |
| 141 | AC-7 0.165 | BC-3 0.110 | S-1 0.350 | UV-1 0.252 | ST-2 0.350 | 3.25 | −20 | −11 | Inv. |
| 142 | AC-7 0.165 | BC-3 0.110 | S-2 0.350 | UV-1 0.252 | ST-2 0.350 | 3.16 | −18 | −10 | Inv. |
| 143 | AC-7 0.165 | BC-3 0.110 | S-3 0.350 | UV-1 0.252 | ST-2 0.350 | 3.26 | −19 | −10 | Inv. |
| 144 | AC-7 0.165 | BC-3 0.110 | S-4 0.350 | UV-1 0.252 | ST-2 0.350 | 3.18 | −20 | −8 | Inv. |
| 145 | AC-7 0.165 | BC-3 0.110 | S-5 0.350 | UV-1 0.252 | ST-2 0.350 | 3.12 | −20 | −8 | Inv. |
| 146 | AC-7 0.350 | — | S-2 0.337 | UNV-1 0.242 | ST-2 0.337 | 3.50 | −21 | −7 | Inv. |
| 147 | AC-7 0.275 | — | S-2 0.400 | UV-1 0.100 | ST-3 0.175 | 3.12 | −16 | −8 | Inv. |
| 148 | AC-7 0.275 | — | S-2 0.400 | UV-1 0.100 | ST-2 0.175 | 3.60 | −13 | −7 | Inv. |
| 149 | AC-7 0.275 | — | S-2 0.400 | UV-1 0.100 | ST-3/ST-2/ 0.175/0.175 | 3.47 | −15 | −8 | Inv. |

What is claimed is:

1. A photographic element comprising at least one light-sensitive silver halide emulsion layer having associated therewith at least one cyan dye-forming coupler, UV absorber and (A) a stabilizer of formula (I)

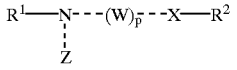

(I)

wherein $R^1$ is an unsubstituted or substituted alkyl or aryl group or a 5- to 10- membered heterocyclic ring which contains one or more heteroatoms selected from nitrogen, oxygen and sulfur, which ring is unsubstituted or substituted;

Z is a hydrogen atom or a substituent group;

X is a group selected from —$SO_2$—, —SO—, —COO—,—CO— and —CS—,

W is one or more unsubstituted or independently substituted alkylene groups connecting the nitrogen atom to X, and p is 0 or 1;

$R^2$ is a substituent group; or the groups represented by Z and $R^2$ can be joined to form a ring which may be substituted; and (B) a high-boiling solvent of formula (II)

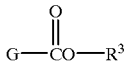

(II)

wherein $R^3$ is an unsubstituted or substituted alkyl or aryl group; and

G is an unsubstituted or substituted alkyl group.

2. The photographic element of claim 1 wherein $R^1$ is an unsubstituted aryl or heterocyclic group.

3. The photographic element of claim 1 wherein the compound of formula (I) has the formula (IA)

(IA)

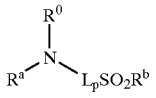

wherein $R^0$ represents an unsubstituted or substituted aryl or heterocyclic group;

$R^a$ is hydrogen or a substituent group;

L represents an unsubstituted or substituted alkylene linking group and p represents 0 or 1; and $R^b$ is a substituent group, provided that substituent groups represented by $R^a$ and $R^b$ may be joined to form a ring.

4. The photographic element of claim 3 wherein $R^0$ is a substituted phenyl group.

5. The photographic element of claim 3 wherein p is 1 and L is a substituted ethylene linking group.

6. The photographic element of claim 3 wherein $R^a$ and $R^b$ are each an unsubstituted or substituted alkyl group.

7. The photographic element of claim 3 wherein $R^a$ and $R^b$ combine together to form a thiomorpholine dioxide group.

8. The photographic element of claim 1 wherein the compound of formula (I) has the formula (IB)

$$R^0—NHSO_2—R^c \quad \text{(IB)}$$

wherein at least one of $R^0$ and $R^c$ is an unsubstituted or substituted aryl group.

9. The photographic element of claim 1 wherein the compound of formula (I) is selected from

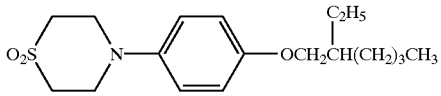

and

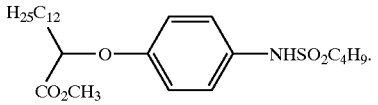

10. The photographic element of claim 1 wherein in formula (II) $R^3$ is an unsubstituted alkyl group.

11. The photographic element of claim 1 wherein $R^3$ is an alkyl group substituted with one or more hydroxy, alkoxy, alkoxycarbonyl or carboxylic ester groups.

12. The photographic element of claim 1 wherein G is an alkyl group substituted with one or more hydroxy or carboxylic ester groups.

13. The photographic element of claim 1 wherein there is associated therewith a phenolic dye-forming coupler of formula (III):

(III)

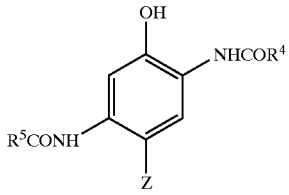

wherein $R^4$ and $R^5$ are independently selected from an unsubstituted or substituted alkyl, aryl, amino or alkoxy group or a 5–10 membered heterocyclic ring which contains one or more heteroatoms selected from nitrogen, oxygen and sulfur, which ring is unsubstituted or substituted; and Z is a hydrogen atom or a group which can be split off by the reaction of the coupler with an oxidized colour developing agent.

14. The photographic element of claim 13 wherein $R^4$ is an unsubstituted or substituted aryl group or heterocyclic ring.

15. The photographic element of claim 13 wherein $R^5$ is a substituted alkyl group.

16. The photographic element of claim 13 wherein the coupler is an 'NB coupler' of formula (IIIA)

(IIIA)

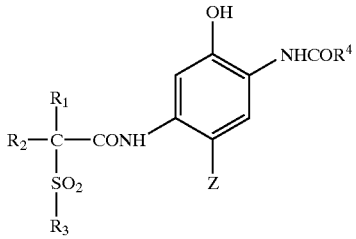

wherein $R_1$ and $R_2$ are independently hydrogen or an unsubstituted or substituted alkyl group; and $R_3$ is an unsubstituted or substituted alkyl, amino, alkoxy or aryl group or a 5–10 membered heterocyclic ring which contains one or more heteroatoms selected from nitrogen, oxygen and sulfur, which ring is unsubstituted or substituted;

$R^4$ is selected from an unsubstituted or substituted alkyl, aryl, amino or alkoxy group or a 5–10 membered heterocyclic ring which contains one or more heteroatoms selected from nitrogen, oxygen and sulfur, which ring is unsubstituted or substituted; and Z is a hydrogen atom or a group which can be split off by the reaction of the coupler with an oxidized colour developing agent.

17. The photographic element of claim 16 wherein at least one of $R^1$ and $R^2$ is a hydrogen atom.

18. The photographic element of claim 16 wherein $R^3$ is an unsubstituted or substituted phenyl group.

19. The photographic element of claim 1 wherein there is associated therewith a phenolic dye-forming coupler of formula (IV):

(IV)

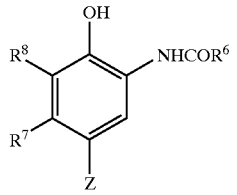

wherein $R^6$ is an unsubstituted or substituted alkyl or aryl group or a 5–10 membered heterocyclic ring which contains one or more heteroatoms selected from nitrogen, oxygen and sulfur, which ring is unsubstituted or substituted;

$R^7$ is an unsubstituted or substituted alkyl group;

$R^8$ is hydrogen, halogen or an unsubstituited or substituted alkyl or aryl group or a 5–10 membered heterocyclic ring which contains one or more heteroatoms selected from nitrogen, oxygen and sulfur, which ring is unsubstituted or substituted; and Z is a hydrogen atom or a group which can be split off by the reaction of the coupler with an oxidized colour developing agent.

20. The photographic element of claim 19 wherein $R^6$ is an unsubstituted or substituted alkyl group.

21. The photographic element of claim 19 wherein $R^7$ is an unsubstituted alkyl group.

22. The photographic element of claim 19 wherein $R^8$ is halogen or an unsubstituted or substituted alkyl group.

23. A photographic element according to claim 1 wherein the cyan dye-forming coupler is selected from:

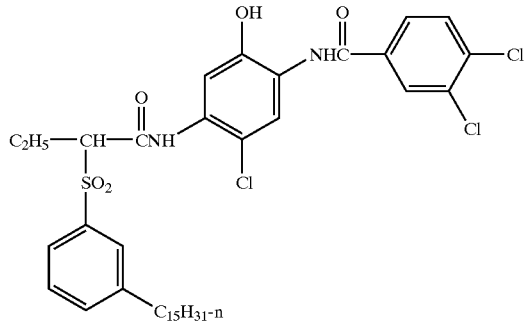

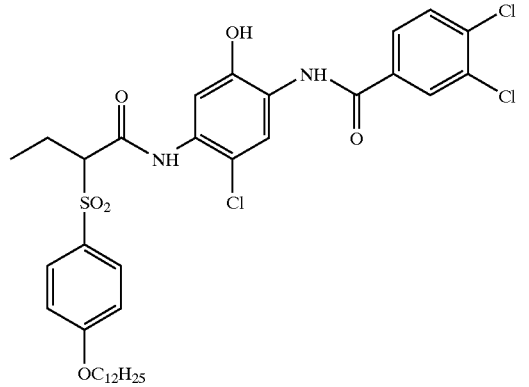

-continued

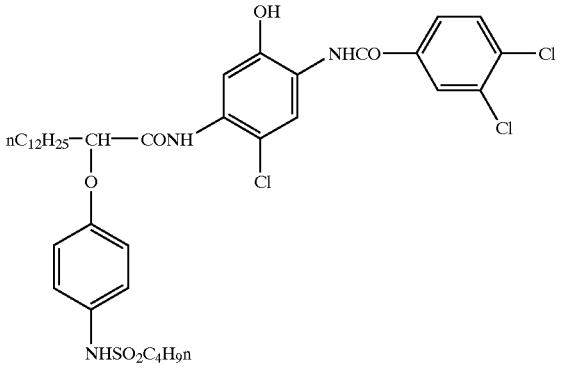

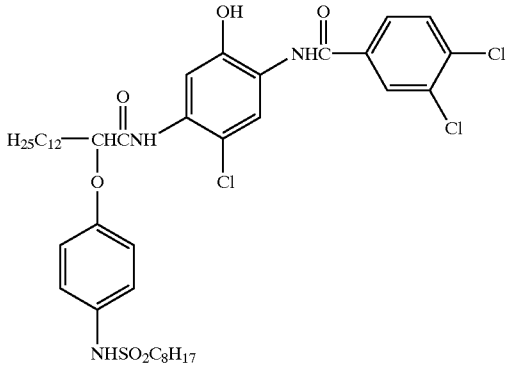

and

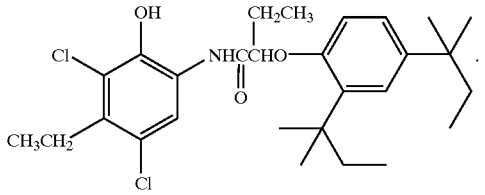

24. The photographic element of claim 1 wherein the UV absorber is a benzotriazole, triphenyl-s-triazine or hydroxyphenyltriazine.

25. The photographic element of claim 24 wherein the benzotriazole has the formula (V):

(V)

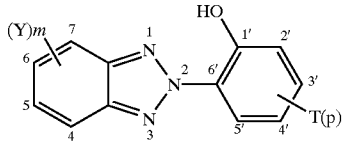

wherein each Y is an independently selected substituent and m is 0 to 4; and each T is an independently selected substituent and p is 0 to 4.

26. The photographic element of claim 1 wherein the laydown of total coupler is from about 0.01 mmol/$m^2$ to about 1.5 mmol/$m^2$.

27. The photographic element of claim 1 wherein the ratio of stabilizer of formula (I) or UV absorber of formula (V) is from about 0.01:1 to about 4:1.

28. The photographic element of claim 1 wherein the ratio of solvent to total coupler is from about 0.2:1 to about 4:1.

29. A multi-colour photographic element comprising a support bearing yellow, magenta and cyan image-dye-forming units comprising at least one blue-, green- or red-sensitive silver halide emulsion layer having associated therewith at least one yellow, magenta or cyan dye-forming coupler respectively, wherein the element comprises at least one light-sensitive silver halide emulsion layer having associated therewith at least one cyan dye-forming coupler, UV absorber and (A) a stabilizer of formula (I)

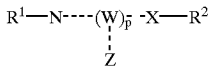

(I)

wherein $R^1$ is an unsubstituted or substituted alkyl or aryl group or a 5- to 10- membered heterocyclic ring which contains one or more heteroatoms selected from nitrogen, oxygen and sulfur, which ring is unsubstituted or substituted;

Z is a hydrogen atom or a substituent group;

X is a group selected from —$SO_2$—, —SO—, —COO—,—CO— and —CS—,

W is one or more unsubstituted or independently substituted alkylene groups connecting the nitrogen atom to X, and p is 0 or 1;

$R^2$ is a substituent group; or the groups represented by Z and $R^2$ can be joined to form a ring which may be substituted; and (B) a high-boiling solvent of formula (II)

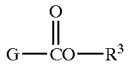

(II)

wherein $R^3$ is an unsubstituted or substituted alkyl or aryl group; and

G is an unsubstituted or substituted alkyl group.

30. A process of forming an image in a photographic element after the element has been imagewise exposed to light, comprising contacting an element with a colour developing agent, wherein the element comprises at least one light-sensitive silver halide emulsion layer having associated therewith at least one cyan dye-forming coupler, UV absorber and (A) a stabilizer of formula (I)

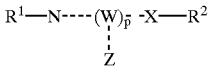

(I)

wherein $R^1$ is an unsubstituted or substituted alkyl or aryl group or a 5- to 10- membered heterocyclic ring which contains one or more heteroatoms selected from nitrogen, oxygen and sulfur, which ring is unsubstituted or substituted;

Z is a hydrogen atom or a substituent group;

X is a group selected from —$SO_2$—, —SO—, —COO—,—CO— and —CS—, each W is one or more unsubstituted or independently substituted alkylene groups connecting the nitrogen atom to X, and p is 0 or 1;

$R^2$ is a substituent group; or the groups represented by Z and $R^2$ can be joined to form a ring which may be substituted; and (B) a high-boiling solvent of formula (II)

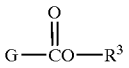

(II)

wherein $R^3$is an unsubstituted or substituted alkyl or aryl group; and

G is an unsubstituted or substituted alkyl group.

* * * * *